US008766174B1

(12) United States Patent
Baykut et al.

(10) Patent No.: US 8,766,174 B1
(45) Date of Patent: Jul. 1, 2014

(54) CORRECTION OF ASYMMETRIC ELECTRIC FIELDS IN ION CYCLOTRON RESONANCE CELLS

(71) Applicant: Bruker Daltonik GmbH, Bremen (DE)

(72) Inventors: Goekhan Baykut, Bremen (DE); Jochen Friedrich, Bremen (DE); Roland Jertz, Bremen (DE); Claudia Kriete, Bremen (DE)

(73) Assignee: Bruker Daltonik GmbH, Bremen (DE)

( * ) Notice: Subject to any disclaimer, the term of this patent is extended or adjusted under 35 U.S.C. 154(b) by 0 days.

(21) Appl. No.: 14/096,847

(22) Filed: Dec. 4, 2013

Related U.S. Application Data

(63) Continuation-in-part of application No. 13/767,595, filed on Feb. 14, 2013.

(51) Int. Cl.

| | |
|---|---|
| ***H01J 49/26*** | (2006.01) |
| ***H01J 49/38*** | (2006.01) |
| ***H01J 49/00*** | (2006.01) |
| ***H01J 49/02*** | (2006.01) |
| *H01J 49/34* | (2006.01) |

(52) U.S. Cl.
CPC ..... *H01J 49/38* (2013.01); *H01J 49/0004* (2013.01); *H01J 49/0027* (2013.01); *H01J 49/027* (2013.01); *H01J 49/34* (2013.01)
USPC ..... 250/282

(58) Field of Classification Search
CPC . H01J 49/0004; H01J 49/0027; H01J 49/027; H01J 49/38; H01J 49/34
USPC ..... 250/281, 282, 290, 291, 292, 293, 294, 250/295, 296, 297, 298
See application file for complete search history.

(56) References Cited

U.S. PATENT DOCUMENTS

| | | | | |
|---|---|---|---|---|
| 2009/0084948 | A1* | 4/2009 | Baykut et al. | 250/282 |
| 2011/0240841 | A1* | 10/2011 | Lange | 250/282 |
| 2012/0043461 | A1* | 2/2012 | Nikolaev et al. | 250/282 |

FOREIGN PATENT DOCUMENTS

| | | |
|---|---|---|
| WO | 2011045144 | 4/2011 |

OTHER PUBLICATIONS

Hanson et al., "Field-Corrected Ion Cell for Ion Cyclotron Resonance", Analytical Chemistry, vol. 62, No. 5, Mar. 1, 1990, pp. 520-526.
Nikolaev et al., "Analysis of harmonics for an elongated FTMS cell with multiple electrode detection", International Journal of Mass Spectrometry and Ion Processes 157/158, 1996, pp. 215-232.

* cited by examiner

*Primary Examiner* — Nicole Ippolito
(74) *Attorney, Agent, or Firm* — O'Shea Getz P.C.

(57) ABSTRACT

The invention relates to a method and a device for optimization of electric fields in measurement cells of Fourier transform ion cyclotron resonance mass spectrometers. The invention is based on the rationale that asymmetric electric fields with uniformly or non-uniformly perturbed field axes can appear in ion cyclotron resonance cells and therefore the axis of the magnetron orbit can become radially displaced. Shifted magnetron orbits negatively affect the cyclotron excitation, deteriorate the FT-ICR signal, increase the intensity of an even-numbered harmonics peak, lead to stronger side bands of the FT-ICR signal, and in extreme cases, cause loss of ions. The present invention helps in probing the shift of the magnetron motion, detecting parameters indicative of the offset of the electric field axis and/or correcting it by trimming it back to the geometric axis of the cell.

20 Claims, 26 Drawing Sheets

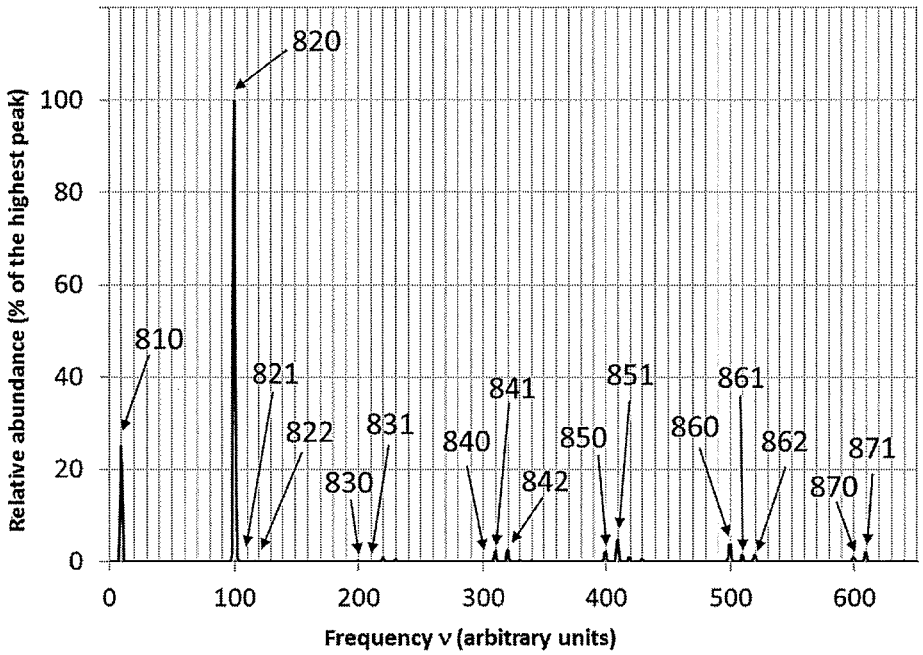

Fig. 18f

| Det \ Exc | 120° EXCITE | | 90° EXCITE | | 60° EXCITE | |
|---|---|---|---|---|---|---|
| Ion Position> | Ion off axis | Ion or magnetron on axis | Ion off axis | Ion or magnetron on axis | Ion off axis | Ion or magnetron on axis |
| 120° DETECT | No $2\nu_R$, No $2\nu_R+\nu_M$ | No $2\nu_R$, No $2\nu_R+\nu_M$ | *No $2\nu_R$, No $2\nu_R+\nu_M$* | *No $2\nu_R$, No $2\nu_R+\nu_M$* | No $2\nu_R$, No $2\nu_R+\nu_M$ | No $2\nu_R$, No $2\nu_R+\nu_M$ |
| 90° DETECT | *Fix $2\nu_R$, Fix $2\nu_R+\nu_M$* | *No $2\nu_R$, Fix $2\nu_R+\nu_M$* | Fix $2\nu_R$, Osc $2\nu_R+\nu_M$ | No $2\nu_R$, Osc $2\nu_R+\nu_M$ | *Fix $2\nu_R$, Osc $2\nu_R+\nu_M$* | *No $2\nu_R$, Osc $2\nu_R+\nu_M$* |
| 60° DETECT | Fix $2\nu_R$, Fix $2\nu_R+\nu_M$ | No $2\nu_R$, Fix $2\nu_R+\nu_M$ | *Fix $2\nu_R$, Osc $2\nu_R+\nu_M$* | *No $2\nu_R$, Osc $2\nu_R+\nu_M$* | Fix $2\nu_R$, Osc $2\nu_R+\nu_M$ | No $2\nu_R$, Osc $2\nu_R+\nu_M$ |

Fig. 19

CORRECTION OF ASYMMETRIC ELECTRIC FIELDS IN ION CYCLOTRON RESONANCE CELLS

PRIORITY INFORMATION

This patent application is a continuation-in-part of U.S. patent application Ser. No. 13/767,595 filed on Feb. 14, 2013, which is hereby incorporated by reference.

FIELD OF THE INVENTION

The invention relates to methods and devices for the compensation of asymmetric electric fields in the measurement cells of Fourier transform ion cyclotron resonance mass spectrometers (FT-ICR MS).

BACKGROUND OF THE INVENTION

The cyclotron radius $r_c$ of an ion with the mass m, the elementary charge e, the charge number z, and the kinetic energy $E_{kin}$ in a magnetic field of the flux density B is given by the following equation:

$$r_c = \frac{\sqrt{2mE_{kin}}}{zeB} \tag{1}$$

In the thermal energy range, e.g. at a temperature of 298 K, and in a magnetic field with the flux density of 7 Tesla, the cyclotron radius of a singly charged ion with mass 1,000 dalton is approximately a tenth of a millimeter. Normally, the ICR cell contains a large number of ions, and their masses can be quite different. Before detection, the cyclotron motion of the ions is excited by an oscillating (RF) electric field with a scanned frequency ("Chirp"). When the frequency of the scanned oscillating field becomes equal to the cyclotron frequency $$\nu_c = \frac{zeB}{2\pi m} \tag{2}$$

of an ion with mass m and charge number z, its cyclotron motion gets resonantly excited. In this equation e is the elementary charge. Depending on the duration and the amplitude of the irradiated field, ions become accelerated and move to larger (excited) cyclotron orbits. This resonant excitation also forces ions with the same charge number-related mass (m/z), which initially circle randomly on small cyclotron orbits having completely different phases, to a completely coherent motion. At the end of the excitation process ions with the same charge number-related mass (m/z) form a cloud in which all ions move in phase. Coherently moving ions in this excited cloud induce image charges of the same magnitude at the detection electrodes that oscillate with the same frequency and with the same phase. Such oscillating image charges (image currents) generated by all excited ion clouds are recorded, amplified, and after Fourier transformation displayed as a frequency spectrum or, when a frequency to mass mapping exists, as a mass spectrum.

The magnetic field can trap ions in the plane perpendicular to the magnetic field lines so that they cannot radially escape the cell. To prevent the ions from escaping in the axial direction, an electric trapping field is required. Therefore, axially, at both ends of the cell, end electrodes (or end plates) are placed to which a relatively low DC voltage is applied, for example normally 1-2 volts. The polarity of this DC voltage is the same as that of the ions to be trapped. The mantle electrodes of a simple conventional cylindrical ICR cell are grounded, thus, an electric trapping field is formed in the cell between the end electrodes and the cylinder mantle. Ions with the mass m and the charge number z oscillate axially in the cell of the length a between the two end electrodes with a trapping frequency $\nu_T$ if a trapping voltage $V_T$ is applied:

$$\nu_T = \frac{1}{2\pi}\sqrt{\frac{2\alpha zeV_T}{ma^2}}. \tag{3}$$

Here e is the elementary charge, and $\alpha$ a constant depending on the cell geometry. With this additional oscillation the ion performs a combination of three independent periodic motions in the cell: cyclotron and magnetron motions in the radial plane, and the trapping oscillations in the axial direction.

Although the applied electric trapping field helps keeping the ions from escaping the cell, it deteriorates the conditions for a clean measurement of the cyclotron frequency. Due to the radial components of the trapping field, the ions do not only circle on their pure cyclotron orbits. As a superimposed motion they follow epicycloidal magnetron orbits and they additionally oscillate in the axial direction with the trapping frequency. The magnetron motion is relatively slow compared to the cyclotron motion. Its frequency only depends on the magnetic field and the electric field. The size (or diameter) of the initial magnetron orbits of ions in the cell right after they are captured depends on how the ions are transferred to the cell: transferred by an electrostatic ion transfer optics or by an RF-multipole transfer optics, or whether or not they are captured using an electric field pulse orthogonal to their path and to the magnetic field ("sidekick"), etc. The initial magnetron radii are normally small, but they can be increased by asymmetric magnetic or electric fields that may excite the magnetron motion. A resistive detection circuit can also induce an increase in magnetron radii due to loss of the potential energy by image current damping.

In the presence of a trapping field, the frequency measured at the detection electrodes of the cell is no longer the unperturbed cyclotron frequency $\nu_c$ but the reduced cyclotron frequency $\nu_R$:

$$\nu_R = \frac{\nu_c}{2} + \sqrt{\frac{\nu_c^2}{4} - \frac{\nu_T^2}{2}}, \tag{4}$$

which is smaller by a magnetron frequency $\nu_M$ than the unperturbed cyclotron frequency:

$$\nu_R = \nu_c - \nu_M. \tag{5}$$

The magnetron frequency of an ion of cyclotron frequency $\nu_c$ and a trapping frequency $\nu_T$ is:

$$\nu_M = \frac{\nu_c}{2} - \sqrt{\frac{\nu_c^2}{4} - \frac{\nu_T^2}{2}}. \tag{6}$$

FIG. 1 shows the combined motion of an ion in an ICR cell in the magnetic field of the flux density B 1. The combination of the cyclotron motion 2, the trapping oscillation 3, of which the sinusoidal curve is shown in dashed lines 4, and the magnetron motion 5 produces the complicated resulting motion 6 of the ion around the electric field axis 7.

When an ion is axially introduced exactly in the middle of the ICR cell, it should normally not experience any electric field component perpendicular to its path. The radial components of the electric trapping field are distributed symmetrically around the axis of the DC electric field, i.e., normally around the axis of the cell. Thus, there is no perpendicular electric field component at the cell axis. However, if the electric field axis is displaced and does not coincide with the axis of the cell, then a perpendicular electric field component does exist at the cell axis. An ion that is introduced on axis into the cell experiences this field component, and the influence of the E×B fields immediately diverts it from its initial path. The same would happen if the ion were not introduced on axis, regardless of the presence of a field asymmetry. The ion now drifts perpendicular to both the magnetic field and that radial electric field component into the third dimension and starts an epicycloidal orbit that winds on a circle around the offset electric field axis. This is a magnetron orbit with an offset axis in reference to the cell axis. The magnetron radius is basically equal to the displacement of the electric field axis.

FIG. 2*a* is a partial drawing of a trapping plate 21 of an ICR cell with the ion introduction hole 20. The electric field axis 23 does not coincide here with the geometric axis 30 of the cell, and the radial electric field components 22 make the ion start moving on an epicycloidal 25 magnetron orbit around the electric field axis 23. The virtual magnetron circle 26 is shown in dashed lines. The magnetron radius is here equal to the displacement 27 of the electric field. Numeral 24 indicates the direction of the magnetic field lines being aligned perpendicular to the plane of illustration.

FIG. 2*b* shows an electric field axis 23*a* that is displaced by a much smaller amount 27*a* than in FIG. 2*a*. In this case, the ion entering the cell on axis is also influenced by the radial field components 22*a* and moves on a smaller magnetron orbit 25*a* around the displaced field axis. The virtual magnetron circle is here also shown in dashed lines 26*a* and has the same magnitude as the displacement 27*a* of the electric field. It is to be noted that the displacement of the field axis as well as the complete magnetron orbit 25*a* remains here within the limits of the ion introduction hole 20 of the ICR cell.

In a trapping field which is asymmetric and not concentric with the cell, severely shifted magnetron orbits can be formed, on which ions can come close to the mantle electrodes. During a cyclotron excitation on such a shifted magnetron orbit, ions can hit the cell walls and be lost before they are detected.

An asymmetry of the electric field inside the FT-ICR cell can be a consequence of many different effects. Some of them are discussed in the following.

FIG. 10*a* shows a classical cylindrical ICR cell with four mantle electrodes. Two of the opposite-sided mantle electrodes are used for the excitation of the ion cyclotron motion by applying an oscillating electric field and the other two mantle electrodes are used for the image current detection of the cyclotron frequency of the excited ion clouds. In conventional ICR cells the excitation and detection electrodes are of equal size (90° segments). In FIG. 10*a* the detection electrodes are numbered as 210, 212, but only one of the excitation electrodes 211 is visible in the figure. One of the trapping electrodes 205 is at the front end with the ion entrance hole 20 and the other one 206 at the back end of the cell.

A deviation of individual electrode shapes from the calculated ideal shapes or a deviation of the assembled cell from its ideal shape can cause asymmetry of the electric field inside the cell. Most of the conventional cylindrical cells have only four cell mantle electrodes which are cylindrically bent rectangular electrodes, and their end electrodes are flat circle shaped parts (confer 205, 206 in FIG. 10*a*). Although these shapes are mostly straightforward, deviations from perfect shapes can still occur if the tolerances are not correctly defined, if the individual electrodes are not cut out of one and the same cylindrical raw material, or if the assembly of the cell is not perfect. In the FT-ICR cells of more complex nature this remains a challenge. Cylindrical cells specially made for high resolution acquisitions contain, for example, more than one detection electrode pair for detection of multiples of the cyclotron frequency. Some of them can have sixteen cylinder mantle electrodes which need to be manufactured and assembled within narrow tolerances. There is a non-zero probability that some individual electrodes of a multitude of mantle electrodes of an ICR cell may deviate to a different extent from the corresponding ideal shape and/or alignment so that the ensuing perturbation of the desired ideal electric field axis may also be non-uniform, for instance, in that a radial shift of the electric field center varies along the longitudinal extension of the cell.

Manufacturing tolerances of parts, as well as deviations from precise assembly in case of compensated cylindrical FT-ICR cells which usually contain 28 or 36 cylinder mantle electrodes (7-section and 9-section cells are known in the art) can influence the electric field symmetry throughout the cell.

Dynamically harmonized cells do have a specially shaped cylinder mantle which usually contains twenty or more cylinder mantle electrodes. If the tolerances of the electrodes are not correctly kept, or if the final assembly of so many electrodes is not perfectly performed these cells are also susceptible to generate electric field errors inside. In a simplest case, these field errors can lead to a parallel displacement of the electric field axis from the geometric axis of the cell (uniform perturbation). In more complicated cases, however, these field errors may also lead to at least one of a tilting (e.g., the electric field axis and geometric axis of the ICR cell are not parallel any more), a bending (e.g., the electric field axis is not a straight line any more, but a non-linear 2D or 3D curve), and a rippling (e.g., the electric axis comprises a stepped pattern with abrupt shifts where a perturbation changes significantly) of the electric field axis (e.g., non-uniform perturbation).

FIG. 3*a* shows an example for a dynamically harmonized ICR cell 50, known from the patent application WO 2011/045144 A1 (E. Nikolaev et al.). This cell has leaf-shaped (e.g., 58) and inverse-leaf shaped (e.g., 55, 57, 59, 61) cylinder mantle electrodes. In FIG. 3*a*, the letter X denotes the cell axis. In order to divide the cell mantle into four equal 90°-individual electrode groups, four of the eight leaf electrodes are longitudinally divided into two halves (e.g., 56*a*, 56*b*). Thus the cell has four integral leaf electrodes, four split leaf electrodes or half-leaf electrodes, and eight inverse-leaf electrodes.

FIG. 3*b* displays the cylinder mantle electrodes open and unwound. There are two excitation groups E including five electrodes (60*b*, 61, 62, 63, 64*a*) and (69*b*, 70, 71, 72, 56*a*), respectively. Furthermore, there are two detection groups including five electrodes (56*b*, 57, 58, 59, 60*a*) and (65*b*, 66, 67, 68, 69*a*), respectively. In the detection groups often only the leaf and half-leaf electrodes (e.g., 56*b*, 58, 60*a*) and (e.g., 65*b*, 67, 69*b*) are used. The inverse-leaf electrodes (e.g., 57, 59, 66, 68) are normally not used as detection electrodes since these are connected to DC voltage power supplies and thus lead to noisy ICR signals. However, if the DC voltages are generated by a battery, the noise can be avoided, and all five electrodes in a detection group can be used for signal detection. All inverse-leaf plates may be supplied with a common variable DC voltage which normally does not differ too much from the trapping voltage of the end electrodes (e.g., 80, 81) of the cell.

Another cause of symmetry errors of the electric field inside the ICR cell may originate from the contact potentials of connectors from the power supply. The contact potentials can change the effective potentials appearing on the individual electrodes, and they can be slightly different from the voltages applied by the user at the instrument console. Depending on the location of these contact potential effects this problem can cause asymmetric electric field inside the cell.

Asymmetric electric fields in the ICR cell can also be a consequence of charging up of individual electrodes. Charging is a general process, which can appear due to various reasons. One of the reasons for electrode charging can be a high resistive connection of this electrode to the ground. Normally, after every acquisition cycle, the detection electrodes in the cell should be at ground potential. However, if they are connected to the ground over a large resistor, which picks up the extremely low induced image charge signal, this can make it difficult to have a quick and easy discharge after every acquisition cycle. The electrode may maintain its charged state for a while, even after the next acquisition cycle starts. In this way, an asymmetric electric field is induced in the cell due to an imperfectly discharged electrode. Needless to say that this type of charging may manifest itself at different individual mantle electrodes with different magnitudes whereby a non-uniform electric field perturbation along the cell axis may emerge.

A different type of electrode charging is surface charging. This usually happens if the metallic surface of the electrode carries a dielectric layer, which (a) can be polarized or charged and (b) cannot easily be discharged due to its lack of conductance. These non-conductive layers usually appear on electrodes due to chemical contamination of the vacuum system. It is known in mass spectrometry that in contaminated vacuum systems or in the presence of outgassing vacuum components, nonconductive layers can be deposited on surfaces of electrodes. This way, the actual voltage at the surface of this electrode can differ from the applied voltage. Applied voltages in the range of 1-2 volts can easily be varied due to surface charging by an amount of 20 to 100 mV, although in selected cases larger values can be observed. Experience shows that such dielectric layers can be dynamic. Depending on their chemical composition they can grow or they can get thinner. Their consistency can even change with time, heat and/or applied chemical "stress" (additional compounds introduced into the vacuum). As a consequence, the ratio of the applied voltage to the actual voltage of the electrode may change with time.

Contaminations of surfaces can also be caused by ions in the cell, but they can also originate from other sources in the vacuum system, external to the ICR cell. Trapped ions can be the source of the contamination within an ICR cell. In the long term, repeated ion ejections can lead to deposition of substances on the inside surface of the mantle electrodes which form a dielectric layer. An uneven distribution of surface contamination on individual longitudinal electrodes can lead to asymmetric surface charging. As a consequence, a radial displacement of the electric field center can have different magnitudes at different points along the cell axis, which in turn leads to a non-uniform electric field perturbation within the cell. Quenching prior to each acquisition cycle cleans the cell from remaining ions for the next acquisition. During a quench pulse a DC voltage of 20-30 volts of a polarity opposite to that of the trapped ions is applied to one of the trapping electrodes, and as a consequence all remaining ions in the cell are attracted to and hit this electrode. Depending on the compounds being measured, the quench event can also produce a dielectric layer on the inside of this trapping plate, which can then, due to surface charging, deteriorate the axial symmetry of the electric field. It depends on the chemical composition of the contaminant layer whether or not a strong bake-out at e.g., 300° C. eliminates it or if it even strengthens the insulation properties of the layer. Bake-out temperatures are often kept lower (around 150° C.) due to material-related reasons. Thus, the layers may not get completely eliminated. Layers of some specific compositions tend to polymerize at higher temperatures and can sometimes only be removed by mechanic scrubbing.

Contamination sources external to the ICR cell include the vacuum components that, for some reason, cannot be kept clean enough. In many cases external heating jackets used for bake-outs first increase the temperature of the walls of the vacuum chamber. The ICR cell is initially cold, and it gets warmer with some delay depending on the heat transfer coefficients of various components used in vacuum. Due to this delay, contaminants can initially thermally desorb off the vacuum chamber walls, can condense at the electrode surfaces of the cold ICR cell and cause surface charging.

One intrinsic property of the (fast) Fourier transform detection method is the appearance of harmonic frequencies of the measured (fundamental) mass peaks in a spectrum. In the ideal case of a perfectly symmetric electric field, and if the ions are injected in the middle into the ICR cell, only odd-numbered harmonic frequencies should appear in the spectrum due to a pure cyclotron motion around the center of the ICR cell. The intensities and distribution of the odd-numbered harmonics depend on the ion cyclotron radius and the arrangement of the detection electrodes. Any distortion/asymmetry of the electric field or improper injection of an ion packet into the ICR cell, however, entails a magnetron motion of the ions in the ICR cell. In such case, additional even-numbered harmonic frequencies of the main or fundamental ion signal appear in the spectrum.

In the following some fundamental rules about the appearance of the harmonics and the satellite peaks thereof are presented. The intensity of the second harmonic peak with the frequency of $2v_R$ can be, for example, related to the position of the magnetron motion ($v_R$ being the reduced cyclotron frequency). If an ion is on the ICR cell axis prior to cyclotron excitation, the second harmonic peak no longer exists. Also, if the magnetron circle is concentric with the cell axis, the second harmonic does not exist either. Usually the ion detection time is long enough and takes several magnetron periods. Therefore, the averaging effect annihilates the second harmonic peak. As a general rule, if the center of the magnetron orbit approaches the cell axis, the intensity of the second harmonics becomes smaller. If the magnetron axis coincides with the cell axis, the second harmonics peak disappears, as simulations also show. It is always desirable that the axis of the magnetron orbit be as close as possible to the axis of the ICR cell. It should be coaxial with the cell axis, if possible.

The intensity of the second harmonic peak group, especially of the one peak with the frequency $2v_R+v_M$ ($v_M$ being the magnetron frequency), is related to the position of the corresponding ion in the cell prior to cyclotron excitation. Thus, it is related to both the position and the size of the magnetron orbit. If the magnetron diameter is large, this satellite peak is abundant and it oscillates and goes through two maxima and two minima during one single magnetron period. The maxima are generated by the ions that are on magnetron orbits at offset positions, specifically in sections with detection electrodes prior to their cyclotron excitation. The minima are generated by the ions that are on magnetron orbits at offset positions, specifically in sections with excitation electrodes, prior to their cyclotron excitation. During one complete cycle of the magnetron orbit, the $2v_R+v_M$ peak shows two maxima and two minima. The time between the capture of the ion in the FT-ICR cell and the excitation event defines this phase on the magnetron orbit. In the FT-ICR experiment, the time between the ion capture and the ion excitation can be varied and the ion can be cyclotron-excited at different points of the magnetron orbit. The (relative) abundance of the major satellite peak of the second harmonics can be plotted against this "post capture delay" (PCD) time for displaying the oscillating behavior of this peak. In the following, we will call such a plot a "post capture delay curve" or "PCD curve".

A large and offset magnetron orbit limits the cyclotron excitation process of the ions and impairs the detected signal, leads to an increase of the intensity of the peaks associated with the even-numbered, e.g., second, harmonics in the Fourier transformed spectrum and to more abundant sidebands of the ion signal. In extreme cases, ions can be lost during the cyclotron excitation, when they are on large and offset magnetron orbits that are close to the cylinder mantle electrodes.

Additionally, a large magnetron orbit can cause problems when using a multiple frequency detection method. Multiple frequency detection multiplies the resolving power of the detected mass peaks. In an ICR cell multiple frequency signals can be obtained if more than two detection electrodes (e.g., four, eight, etc.) are used. However, this method can only be successfully applied if ions have no magnetron orbits or if these are vanishingly small. Moderate or large magnetron orbits severely complicate the ICR mass spectra and reduce the signal intensity of the multiple-frequency mass peaks.

The invention described in the patent application of G. Baykut, J. Friedrich, R. Jertz, and C. Kriete, (U.S. Ser. No. 13/767,595 filed on Feb. 14, 2013, the priority of which is herewith claimed for its entire disclosure) can be used for correction of asymmetric electric fields in an ICR cell that lead to offset magnetron orbits. It helps identifying a displacement of the electric field axis and trimming the displaced magnetron axis back to the cell axis. Another submitted but not yet published European patent application of R. Jertz and G. Baykut (application number 13004771.5, filed on Oct. 11, 2013) describes a different approach for a further reduction of the size of the initial magnetron orbit.

If the magnetron orbit of an ion has any radial offset from the ICR cell axis, the intensity oscillation of the peak with the frequency of $2v_R+v_M$ shows differently abundant maxima and minima during one single magnetron period. Thus, the PCD curve shows two maxima and two minima which are not of equal intensity. If the radial offset is in direction of one of the excitation electrodes the PCD curve has one deep and one shallow minimum, but two equally high maxima within one magnetron period. If the offset is in the direction of one of the detection electrodes the PCD curve shows one high and one low maximum but two equally deep minima within one magnetron period. If the offset is directed between the excitation and detection electrodes, then "mixtures" of the above described cases appear. When the center of the offset magnetron orbit is moved back to the geometric axis of the ICR cell, the intensity oscillation of the satellite peak $2v_R+v_M$ becomes quite regular with two equally deep minima and two equally high maxima.

In an FT-ICR measurement, it is basically advantageous if the magnetron orbit has a relatively small diameter or if it does not exist at all. Unfortunately, experimental methods to reduce the magnetron motion with cooling using a resonant buffer gas are not generally applicable since they are very mass selective and require the introduction of relatively high amounts of gas into the ultrahigh vacuum chamber. In addition, it is also desirable that the axis of the magnetron orbit be as close as possible to the axis of the ICR cell. In the best case, it should be coaxial with the cell axis. A compromise would be a small magnetron orbit very close to the cell axis. If the electric field in the cell is asymmetric, its axis may be radially displaced against the cell axis. In this case, the magnetron orbit is also shifted and located around this radially displaced electric field axis.

For a good performance of any ICR cell the magnetron orbit size needs to be reduced, ideally minimized. If the electric field axis is radially displaced in reference to the cell axis, the magnetron orbit will also be displaced. It will be located around this radially displaced field axis, since the magnetron orbit winds around the electric field axis. Simulations of ion motion in the ICR cell show (as will be discussed in detail below) that, for example, the second harmonic peak with the frequency $2v_R$ disappears if the magnetron orbit is concentric with the cell, i.e., if its center is on the cell axis. If the electric field axis does not coincide with the cell axis, i.e., if it is radially displaced, this will also shift the magnetron orbit radially to be wound around this offset electric field axis. Thus, the second harmonics peak will appear. On the other hand, the intensity of the satellite peak $2v_R+v_M$ of the second harmonic, for instance, increases with the radially offset position of the ion, both with the offset magnetron radius and/or offset magnetron orbit. In order to achieve small magnetron orbits which are as central as possible, electric field conditions are corrected or compensated for by using varying compensation voltages at least one, several or all individual mantle electrodes so that the intensities of, for example, the second harmonic and its satellite peak become as small as possible.

Most of the contemporary ion cyclotron resonance cells have a cylindrical geometry. In conventional ICR cells the excitation and detection electrodes are of equal size. They are four 90° segments of the cylinder mantle or, in other words, four individual electrodes covering an angular range of about 90°. For ion excitation, an oscillating electric field with several hundred volts amplitude can be used while the DC trapping voltages in a cell are in the range of 1-2 volts. Under these circumstances during the excitation process inhomogeneous oscillating fields are formed not only in the radial direction of the cell (transverse to the cell axis) but also in the longitudinal direction of the ICR cell.

If an ion is placed in an oscillating inhomogeneous electric field, it observes a force that drives it from a zone of higher electric field to a zone of lower electric field, i.e., from a zone with electric field lines of higher density to a zone with lower density of electric field lines. An effective electric potential can be defined to be responsible for this drift that is a function of the alternating electric field's amplitude and frequency, as well as the mass to charge ratio (m/z) of the affected ions. This potential is called the "pseudo potential" or the "effective potential". Operation of RF multipole ion guides and Paul traps is based on this effect.

FIG. 14*a* schematically shows the direction of the movement of an ion in an inhomogeneous electric field due to the pseudo potential. An oscillating electric field between the curved electrodes 461, 462 of the two electrode system 460 is depicted in FIG. 14*a*. Electric field lines 463 of the alternating field are illustrated as double sided arrows, and the equipotential lines 464 are also shown. Due to the pseudo potential in the oscillating inhomogeneous electric field, ions tend to drift from higher field to lower field areas and orthogonal to the convex curvature of the equipotential lines 464. As a comparison, an oscillating homogenous field is shown in FIG. 14*b* between the parallel electrodes 471, 472 of the two electrode system 470 that is assumed to be of infinite extension to illustrate the effect. The oscillating homogeneous electric field has no such effect on the ions. Here the oscillating electric field is equally strong everywhere, the electric field lines 473 shown as double sided arrows here, and the equipotential lines 474 are parallel straight lines, and there are no special zones of the field ions would prefer, i.e., to which the ion in this oscillating field would drift. This indifference is shown with the double sided arrow 475 in a circle.

Similarly, the drift of the cyclotron orbit's center during a resonant cyclotron excitation is an effect due to the pseudo potential in the oscillating RF excitation field within the ICR cell. FIG. 15 shows a graph of the oscillating field equipotential lines 501 in a cross sectional view of a conventional cylindrical ICR cell 500. The cell mantle is divided into four 90° individual electrodes. The excitation process is performed using two 90° excitation electrodes 502, 503 opposite to each other, and the remaining two 90° electrodes 504, 505 are used for detection. Also in this figure, circles in dashed lines with arrows are used to show the drift direction of the cyclotron orbit during a resonant cyclotron excitation process. In the middle of the cross sectional view of the cell, there is an area with parallel equipotential lines. In this area 506 no cyclotron orbit drift will be observed during the cyclotron excitation, as long as the excited cyclotron orbit stays within parallel equipotential lines. As expected, a simulation of the excitation of a central cyclotron orbit does not show a displacement during the excitation process. In the circles 509, 510 the cyclotron orbit will move away from the excitation electrodes towards the center of the cell during a cyclotron excitation (which is shown in the simulation in FIG. 5*a*). In the areas indicated with the circles 507, 508 the cyclotron orbit will drift towards the detection electrodes during a cyclotron excitation process (as also shown in the cyclotron excitation simulation in FIG. 5*b*). In the areas 511, 512, 513, 514 the drift of the cyclotron orbits will be perpendicular to the cell radius and follows the convex equipotential lines in these areas. The shape of the equipotential lines helps predict and understand the simulated displacement direction of the cyclotron orbits during the resonant excitation. In the dashed ellipses 517, 518 which are relatively close to the excitation electrodes there are small areas of parallel and straight equipotential lines. When ions are in these zones during their cyclotron excitation, then they will experience no drift of the cyclotron orbit, i.e., a magnetron orbit will not be excited. However, these are not realistic conditions to fulfill. The convex equipotential lines in the areas 515, 516 which are very close to the excitation electrodes let us predict a drift direction of the cyclotron orbit towards (and not away from) the excitation plates. However these are zones which are too close to the electrodes and have no practical importance during (most of the) regular operations of an ICR cell.

FIG. 6 shows a PCD diagram 250 in which the change of the relative intensity of the peak with the measured frequency $2v_R+v_M$ is plotted as a function of the post capture delay time of the ions in the cell. As described above the PCD curve 251 shows maxima 260, 262, 264 and minima 261, 263. The distance between a first maximum 260 and a third maximum 262 corresponds to the period 252 of the magnetron motion, which is in this case about 200 ms. This in turn corresponds to a magnetron frequency of about 5 Hz. In the lower half of the figure the corresponding positions of an ion in the cell are shown, at which the cyclotron excitation took place. Here, the excitation electrodes 160, 161 and the detection electrodes 162, 163 can be seen in the cross sectional views of ICR cells. In these simulated pictures, ions start the cyclotron excitation at an ion position which is not on the cell axis. Starting positions of the ion cyclotron excitations are marked as white dots 270, 280 and the shift direction of the center of the cyclotron orbit during the excitation process is shown by white arrows 271, 281. As described above, this shift is in the direction 281 to a detection electrode 162 if the excitation process takes place near a detection electrode 162. This in turn means an excitation of the magnetron motion during the cyclotron excitation. However, if a cyclotron excitation is in the quadrant of an excitation electrode 160, the center of the cyclotron path is shifted away from the excitation electrode 160, in the direction 271 to the cell center. This in turn means a de-excitation or a relaxation of the magnetron motion during the cyclotron excitation.

If the axis of the DC field coincides with the ICR cell axis the cyclotron motion winds as a magnetron orbit on a circle around the cell axis. In this case, the maxima in the PCD curve should be equally high. However, in FIG. 6 the maxima in the PCD curve 251 are not equally high. They are alternatingly higher and lower. This means that the magnetron motion does not circle around the cell axis since the electric field axis is shifted.

An ideal dipole field for the cyclotron resonance excitation of ions is provided if the RF irradiation is performed using two infinitely large parallel planar electrodes. The excitation using a small planar electrode with a finite size together with the trapping electrodes perpendicular to it generates an inhomogeneous oscillating electric field. As shown above, an excitation using 90° electrodes of the cylindrical mantle also generates oscillating electric fields of which the really homogeneous range is only in a very small volume close to the axis of the cell, even if the electrodes would be infinitely large. As the ion gets excited to larger cyclotron orbits, it becomes exposed to rather inhomogeneous parts of the RF excitation field.

The largest homogeneous portion of the oscillating electric excitation field with parallel equipotential lines is obtained if 120° electrodes are used for ion excitation. This is described by Alan Marshall Group (61$^{st}$ ASMS Conference on Mass Spectrometry and Allied Topics, Jun. 9-13, 2013, Minneapolis, Minn.). Two 120° cylinder electrodes for excitation geometrically leave only space for two 60° detection electrodes within a circular cross section. However, it is not advantageous to detect with small electrodes like 60° since the generated image current signal will be smaller than a signal detected e.g., using 90° electrodes. Also the abundance of harmonics, especially second and third harmonic peaks is higher, as illustrated in FIGS. 18*a-f* and described below. The best solution would be also to detect with electrodes or electrically coupled electrode groups that each cover an angular range of 120°. In a cell having 2×120°/2×60° individual integral electrodes, these have to be inevitably the same electrodes which are also used for excitation. Electronically, it is possible to use one electrode for excitation and detection by switching an electrode from excitation to detection mode. Another possibility is using anti-parallel diodes to permanently connect the electrodes used for excitation and detection as described in conference presentations of Alan G. Marshall and coworkers [(1) Chen, T.; Kaiser, N. K.; Beu, S. C.; Hendrickson, C. L.; and Marshall, A. G., "Excitation and Detection with the Same Electrodes for Improved FT-ICR MS Performance", 60th Proceedings of Annual Conference of American Society for Mass Spectrometry, Vancouver, BC, Canada, May 20-24, 2012, and (2) Chen, T.; Kaiser, N. K.; Beu, S. C.; Blakney, G. T.; Quinn, J. P.; Hendrickson, C. L.; and Marshall, A. G., "Improving Radial and Axial Uniformity of the Excitation Electric Field in a Closed Dynamically Harmonized FT-ICR Cell", 61st Proceedings of Annual Conference of American Society for Mass Spectrometry, Minneapolis, Minn., USA, Jun. 9-13, 2013].

Using 120° excitation electrodes, the oscillating electric field in a quite large central region around the cell axis is homogeneous. As long as the ions remain in this zone a very good dipole excitation field is produced and virtually no drift of the cyclotron orbit is induced during the excitation process. In other words, the oscillating electric field used for cyclotron excitation does not excite or relax the ion's magnetron motion during the cyclotron excitation. If the ion is on an initial magnetron orbit prior to cyclotron excitation, the magnetron orbit retains its size during the cyclotron excitation.

The cross sectional view of an ICR cell 520 in FIG. 16*a* shows the equipotential lines 521 of the oscillating electric field applied to the 120° electrodes 522, 523 for the cyclotron excitation of ions. The remaining electrodes 524, 525 are 60° electrodes each. The equipotential lines in the relatively large area around the cell center are basically parallel straight lines. This part of the field looks similar to a field between two plane-parallel electrodes, as shown in FIG. 14*b*. In this zone, no drift of the cyclotron orbit during the resonant excitation process occurs. In the four other marked zones 527, 528, 529, 530, the drift during a cyclotron excitation is outward from the center. Cyclotron orbits are shifted in direction of the excitation or detection electrodes. In the areas between these circles, drifts perpendicular to the cell radius are expected.

In the central zone 526 with straight and parallel equipotential lines, since there is no remarkable drift of the cyclotron orbit during resonant excitation, there is also no excitation or relaxation of the magnetron motion, i.e., the magnetron orbit does not become larger or smaller after the cyclotron excitation of the ion. An oscillating post capture delay curve of the satellite peak of the second harmonic, as described in the afore-mentioned U.S. patent application Ser. No. 13/767,595, cannot be acquired if the ions are in this zone. In the zones outside this area, it is not too much different: close to the excite electrodes as well as detect electrodes, cyclotron orbits will be shifted towards those electrodes during a resonant excitation process, which also does not produce the oscillating PCD curve as known from the 90° excitation system.

In contrast, FIG. 16*b* shows a cross sectional view at a cylindrical cell 540 with two 120° 544, 545 and two 60° 542, 543 individual electrodes, where the excitation field in this case is generated between the two 60° individual electrodes. The equipotential lines 541 show a very inhomogeneous oscillating excitation field. A somewhat homogenous area is in the very middle of the cell in the dashed circle 546 in which the resonant cyclotron excitation would not induce a shift of the cyclotron orbit center, i.e., a change of the magnetron orbit size. This is indicated with the double sided arrow in the circle 546. There are two further small zones of nearly homogeneous field close to the 60° excitation plates 557, 558, which are not too relevant in this case. Operating in these zones would mean that the ion has a severely offset cyclotron motion, possibly as a result of an extremely large magnetron orbit around the cell axis or as a result of a smaller but severely offset magnetron orbit. In the even less relevant zones 555, 556 extremely close to the 60° excitation plates, the convexity of the equipotential lines shows that a cyclotron excitation in these zones would experience a center shift towards these excitation electrodes, but any cyclotron excitation of usable extent would cause ejection of any ion in this zone to the excitation electrodes. In the dashed ellipses 547, 548 in the quadrants of the 120° electrodes the resonant excitation of the ion cyclotron motion causes an orbit shift towards the 120° electrodes as shown with the arrows, which means an excitation of their magnetron orbit. In the dashed circles 549, 550 in the quadrants of the upper and lower 60° excitation plates the resonant excitation of the ion cyclotron motion causes an orbit shift towards the center of the cell, away from the excitation electrodes as shown with arrows, which means a relaxation (de-excitation) of their magnetron orbit. The arrows in the remaining dashed circles 551, 552, 553, 554 show the shift direction of the cyclotron orbit during a resonant excitation in each of these zones.

FIG. 17*a* shows a plot 560 demonstrating the effect of the cyclotron excitation on the magnetron orbit when the ion starts in the region of the excitation electrodes. The initial magnetron orbit diameter of the ion is 10% of the cell diameter. Curve 561 is obtained when an excitation using the 60° electrodes is simulated. It clearly shows the reduction of the magnetron orbit diameter. The curve 562 is obtained if an excitation using 90° electrodes is simulated. In this case the reduction of the magnetron orbit diameter is not as strong as in the case with excitation using the 60° electrodes. As the curves 562, 563 show, the reduction of the magnetron diameter at all excitation powers is stronger when excited with 60° electrodes, weaker when excited with 90° electrodes. The simulation of a cyclotron excitation using 120° electrodes is shown in curve 563. In this particular case the simulated curve shows practically no change of the magnetron radius. Simulations show, that depending on the initial phase of the ions and the initial phase of the exciting RF field the use of the 120° electrodes leads to no change or quite insignificant changes of the magnetron orbit.

FIG. 17*b* shows a plot 565 demonstrating the effect of the cyclotron excitation on the magnetron radius when the ion starts in the region of the detection electrodes. The initial magnetron orbit diameter of the ion is again 10% of the cell diameter. The curve 566 is obtained simulating an excitation using the 60° electrodes. This curve shows a significant increase of the magnetron orbit diameter. The curve 567 is obtained simulating an excitation using 90° electrodes. In this case the increase of the magnetron orbit diameter is not as strong as with the excitation using the 60° electrodes. As the curves 566, 567 show, the increase of the magnetron diameters at all excitation powers is stronger when excited with 60° electrodes, weaker when excited with 90° electrodes. The simulation of a cyclotron excitation using 120° electrodes is shown in curve 568. In this case the simulated curve shows an insignificant decrease of the magnetron radius.

In FIG. 17*c* the effect of the magnetron orbit center shift during the cyclotron excitation event is illustrated as simulated PCD curves for the excitation with 60° electrodes 571, 90° electrodes 572 and 120° electrodes 573. In all cases an initial magnetron orbit radius of 10% of the ICR cell radius on axis and the same final cyclotron excitation radius of 66% of the ICR cell radius is used for the simulations. The maxima 575, 576 directly correspond to one point on the curves 566, 567, 568 in FIG. 17*b*, the minima 577, 578 correspond to one point on the curves 561, 562, 563 in FIG. 17*a*. The distance 574 between two maxima 575, 576 is related to the magnetron frequency. The cyclotron excitation start phase (x-axis) is directly related to the post capture delay time in the measured PCD curve diagrams.

To have an ideal dipole excitation field in a relatively large zone at the center of the cell, as it is realized in the case of the 120° excitation electrodes, does not change the fact that the center of the radial DC field in the cell can be offset due to various reasons. The reasons can be chemical contamination and surface charging, mechanical misalignment, etc., as outlined above. A slightly offset radial DC field may be considered as negligible in the "picture" of the oscillating RF field, since the RF amplitude values are in the range of hundreds of volts, very high compared to the low DC voltages of the cell electrodes. In the absence of the oscillating electric field, when the cell acts as a trap only, even a slight offset, such as by 50 mV, can already be inacceptable and it can radially displace the magnetron motion by a significant amount.

In order to achieve a sensitive detection in an ICR cell with 120° excitation electrodes, the same 120° electrodes can be used for detection of the ions too, which is, although rarely used, a well-known technique. In addition, when detected with 120° electrodes the second and third harmonics are significantly suppressed and do not show up in the frequency or mass spectrum.

FIGS. 18*a-f* show a series of simulated spectra detected using 60°, 90°, and 120° electrodes of an FT-ICR cell. In these simulated spectra the frequency $v_M$ of the magnetron motion is chosen to be 10 frequency units (f.u., arbitrary), the reduced cyclotron frequency $v_R$ 100 frequency units (f.u., arbitrary) in order to achieve a better visualization. In reality the ratio of the cyclotron-to-magnetron frequency would be at least 1000. The leftmost peak 810 in the simulated spectra is the magnetron frequency $v_M$ and the second peak 820 is the reduced cyclotron frequency $v_R$.

FIG. 18*a* depicts the simulated spectrum detected with 90° mantle electrodes as in a classical FT-ICR cell. The excited cyclotron radius is at 75% of the FT-ICR cell radius, the on-axis magnetron motion (around the cell axis) has a radius that is 16% of the cell radius. Due to the on-axis magnetron motion, as a result of averaging, the second harmonic $2v_R$ 830 at 200 f.u. does not appear. Similarly, the fourth harmonic $4v_R$ peak 850 itself is also not visible in this spectrum, neither is the sixth harmonic $6v_R$ 870. Although all even harmonics do not appear in this spectrum due to the central magnetron orbit, the odd harmonics like $3v_R$ 840 at 300 f.u. and $5v_R$ 860 at 500 f.u. do appear.

The first sideband of the main cyclotron peak 820 is not visible in this spectrum but the second sideband 822 with the frequency of $v_R+2v_M$ is there. Although the second harmonics is not visible its first satellite peak with the frequency of $2v_R+v_M$ 831 does appear at 201 f.u. with some significant abundance. A trace of a further satellite peak at $2v_R+3v_M$ 833 is also visible. Also visible are the first satellite peaks 851, 871 of the not appearing fourth and sixth harmonics 850, 870, respectively. Traces of the third satellite peaks 853, 873 are visible in both cases. Also second satellite peaks of the odd harmonics like $3v_R$ and $5v_R$ appear with very low abundances.

FIG. 18*b* depicts the simulated spectrum detected again with 90° mantle electrodes as in a classical FT-ICR cell. The excited cyclotron radius is at 66% of the FT-ICR cell radius, the magnetron motion has a radius that is 16% of the cell radius and is off axis by 8% of the cell radius. Due to the off-axis magnetron motion the second harmonics $2v_R$ 830, as well as the fourth and the sixth harmonics $4v_R$ 850 and $6v_R$ 870 appear. The odd harmonics like $3v_R$ 840 and $5v_R$ 860 do also appear in the spectrum. The first sideband 821 of the main peak which was missing in the spectrum in FIG. 18*a*, as well as sidebands and satellite peaks off all harmonics are visible. An off axis magnetron orbit makes all harmonic peaks and their sidebands appear when detected with 90° mantle electrodes.

FIG. 18*c* depicts the simulated spectrum detected with 60° mantle electrodes. The excited cyclotron radius is at 75% of the FT-ICR cell radius, the on-axis magnetron motion (around the cell axis) has a radius that is 16% of the cell radius. Due to the on-axis magnetron motion, as a result of averaging, the second harmonic $2v_R$ 830 at 200 fu. does not appear here in contrast to FIG. 18*a*. Similarly, the fourth harmonic $4v_R$ peak 850 is also not visible in this spectrum, neither is the sixth harmonic $6v_R$ 870. The third harmonic with the frequency $3v_R$ 840 appears with a relatively high abundance and the fifth one with the frequency $5v_R$ 860 also appears.

The first sideband of the main cyclotron peak 820 is here also not visible in this spectrum but the second sideband 822 with the frequency of $v_R+2v_M$ is there. The first satellite peak $2v_R+v_M$ 831 of (not appearing) second harmonic appears with considerable abundance. A trace of a further satellite peak at $2v_R+3v_M$ 833 is also visible, while the first satellite peaks 851, 871 of the not appearing fourth and sixth harmonics 850, 870, respectively, are small. Traces of the third satellite peaks 853, 873 are visible in both cases. Also second satellite peaks of the odd harmonics like $3v_R$ and $5v_R$ appear with very low abundances.

FIG. 18*d* depicts the simulated spectrum detected again with 60° mantle electrodes in an FT-ICR cell. The excited cyclotron radius is here at 66% of the FT-ICR cell radius, the magnetron motion has a radius that is 16% of the cell radius and is off axis by 8% of the cell radius. Due to the off-axis magnetron motion all even harmonics like $2v_R$ 830, $4v_R$ 850 and $6v_R$ 870 appear in the spectrum. Also the odd harmonics $3v_R$ 840 and $5v_R$ 860 also appear in the spectrum. The first sideband 821 of the main peak which was missing in the spectrum in FIG. 18*a*, as well as sidebands and satellite peaks off all harmonics are visible. Using 60° mantle electrodes for detection, an off axis magnetron orbit makes all harmonic peaks and their sidebands appear with much larger relative abundances compared to the 90° mantle electrodes detection.

FIG. 18*e* depicts the simulated spectrum detected with 120° mantle electrodes in an FT-ICR cell. The excited cyclotron radius is at 75% of the FT-ICR cell radius, the on-axis magnetron motion (around the cell axis) has a radius that is 16% of the cell radius. Due to the on-axis magnetron motion, as a result of averaging, even harmonics like the second harmonic $2v_R$ 830, fourth harmonic $4v_R$ 850 and sixth harmonic $6v_R$ 870 do not appear. Odd harmonics like $3v_R$ 840 and $5v_R$ 860 do appear but they are extremely small. The sidebands 821, 822 of the main peak are not visible. Also the sidebands 831, 832 of the second harmonic 830 are vanishingly small. Visible are the second sideband (satellite) $3v_R+2v_M$ 842 of the third harmonic $3v_R$ 840, first satellite $4v_R+v_M$ 851 of the fourth harmonic $4v_R$ 850, the fifth harmonic itself $5v_R$ 860 and its second satellite peak $5v_R+2v_M$ 862, and first satellite peak $6v_R+v_M$ 871 of the sixth harmonic $6v_R$.

FIG. 18*f* depicts the simulated spectrum detected again with 120° mantle electrodes in an FT-ICR cell. The excited cyclotron radius is here at 66% of the FT-ICR cell radius, the magnetron motion has a radius that is 16% of the cell radius and is off axis by 8% of the cell radius. Despite the off-axis magnetron motion the even harmonic $2v_R$ 830 does not appear in the spectrum. Harmonics $4v_R$ 850 and $6v_R$ 870 are very small. Also the odd harmonic $3v_R$ 840 does not appear. Harmonics $5v_R$ 860 does appear but is very small. The sidebands 821, 822 of the main peak do not appear even here with the off-axis magnetron orbit. As a final remark, when detecting with 120° electrodes, even an off axis magnetron orbit cannot make all harmonic peaks and their sidebands appear, and if so, the abundance of these peaks is very low.

Table 1 in FIG. 19 focuses on the second harmonic peak and its most abundant (first) satellite when electrodes covering different angular ranges are used for excitation and detection. The entries in italics show cases which are not possible if specially divided cells with electrode mode (excitation/detection) switching are not used. As known from the simulated data displayed in FIGS. 18*a-f* the second harmonic peak does not appear in the spectrum if there is no magnetron orbit or if the magnetron orbit is around the cell axis. Additionally, when detected with 120° electrodes, neither the second harmonics nor their satellite peaks appear in the spectrum, regardless, which electrodes are used for excitation. Thus, the complete first row of the Table 1 shows no second harmonics and no first satellite peak. When excited using 90° electrodes, the detection with 90° electrodes does not result in a second harmonic peak if the magnetron orbit is around the cell axis. If the magnetron orbit is off axis, the second harmonic appears, but its intensity does neither vary nor oscillate with post capture delay time. If ions at an axial position or on an axial magnetron orbit are excited using 120° electrodes (or electrode groups) and detected with 60° electrodes (or electrode groups), still no second harmonics appear. A satellite peak of the second harmonics appears but it does not vary or oscillate with post capture delay time. If the ions are off axis the second harmonic peak and its satellite appears, but neither one of them does vary or oscillate with changing post capture delay time.

If ions at an axial position or on an axial magnetron orbit are excited using 60° electrodes and detected also with 60° electrodes, no second harmonic peak appears but the well-known satellite peak $2v_R+v_M$ appears and it oscillates with post capture delay time. In case of the off axis ions with the magnetron orbit off axis, the second harmonics and its satellite peak appear in the spectrum and the satellite peak oscillates with changing post capture delay time.

A 90° excitation possibility combined with 120° detection, 120° excitation and 90° detection, 60° excitation and 90° detection, as well as 90° excitation and 60° detection are also shown in the table. But they are special cases as they require a more complex division of the cell mantle electrodes or excitation/detection mode switching for the cell being capable of performing such particular applications.

As described above, the use of 120° excitation electrodes generates a homogeneous dipolar excitation field but it makes detection and correction of an offset electric DC field in the cell difficult. No drift of a radially offset cyclotron orbit will happen. Therefore, an electric field correction by observing and minimizing the harmonics will be difficult when using 120° electrodes for excitation and detection.

Due to the size of the electrodes, the detection with 60° electrodes (or electrode groups) leads to less abundant signals than the detection with 90° or 120° electrodes (or electrode groups). On the other hand, when detecting with 120° electrodes, a possible field axis displacement may not be detected since the even harmonics do not appear and remain here uncorrected. Therefore, a moderately sized, offset magnetron orbit cannot be corrected. A consequence of exciting and detecting with 120° segment electrodes is that the correction of a possible offset of the radial DC electric field in the ICR cell using the method according to the U.S. pending patent application Ser. No. 13/767,595 will not work.

SUMMARY OF THE INVENTION

A method of correcting for an asymmetry of an electric field in an FT-ICR cell in a radial direction relative to an axis thereof, includes: (a) providing an FT-ICR cell having a set of mantle electrodes; (b) supplying ions to the FT-ICR cell, wherein the ions are at least one of introduced into the FT-ICR cell, generated in the FT-ICR cell, and retained in the FT-ICR cell from a previous cycle; (c) applying an excitation voltage pulse to a first subset of the mantle electrodes so that the ions are excited onto a revolving orbit within the FT-ICR cell; (d) acquiring an image current transient with the aid of a second subset of the mantle electrodes, the image currents being induced by the revolving ions when passing the electrodes in the second subset; (e) transforming the image current transient into a frequency or mass spectrum and observing an intensity of at least one of the ion signals with frequencies of $nv_R$, $v_R$ being a reduced cyclotron frequency, and $nv_R \pm mv_M$, $v_M$ being a magnetron frequency, where n=2, 4, 6, . . . , and m=1, 2, 3, . . . ; and (f) repeating the steps (b) through (e) while adjusting DC voltages supplied to at least one of the mantle electrodes until adjusted DC voltage settings are found which result in a lower observed intensity of the ion signal(s) compared with an initial intensity.

In various embodiments, the mantle electrodes, in an unwound representation, have one of a rectangular shape, and leaf, half-leaf or inverse-leaf shape.

In various embodiments, at least one of the mantle electrodes is divided by transverse cuts along a longitudinal direction, each created segment being connected to a DC voltage source so that a DC voltage supplied thereto is tuned (e.g., independently) to provide each segment with an individual compensation voltage in order to allow for the correction of a non-uniform perturbation of the electric field axis in the FT-ICR cell.

In various embodiments, at least one of the mantle electrodes is divided by a longitudinal cut in order to allow for flexible forming of electrically coupled mantle electrode subsets.

In various embodiments, the first subset of mantle electrodes has no electrodes in common with the second subset of mantle electrodes. In alternative embodiments, the first subset of mantle electrodes has some or all electrodes in common with the second subset of mantle electrodes, further including operation of a switchable electrical circuit allowing for the mantle electrodes that are common to both the first and second subset to be switched from an excitation mode in step (c) to a detection mode in step (d). In still further embodiments, the second subset of mantle electrodes has some or all electrodes in common with the first subset of mantle electrodes, further including operation of a switchable electrical circuit as described above.

In various embodiments, the second subset of mantle electrodes comprises individual electrode groups or individual electrodes that have an angular extension around a circumference of the FT-ICR cell smaller than about 120°, preferably less than about 90°. In one preferred embodiment, the individual electrode groups or individual electrodes of the second subset, used for detection, have an angular extension of about 60°, and the individual electrode groups or individual electrodes of the first subset, used for excitation, have an angular extension of about one of 60° and 120°.

In various embodiments, step (f) further comprises varying a post capture delay time after introduction of the ions in step (b) as will be described in more detail further below.

In various embodiments, finding the adjusted DC voltage settings includes a disappearance of the observed intensity of the ion signal(s).

In various embodiments, step (f) comprises adjusting DC voltages at all mantle electrodes.

Another aspect includes an FT-ICR cell having mantle electrodes, wherein the mantle electrodes are configured such that they allow a formation of a first subset of the mantle electrodes, electrically coupled to be usable for an excitation of ions in the FT-ICR cell, and of a second subset of the mantle electrodes, electrically coupled to be usable for a detection of an image current transient, wherein an angular extension of individual electrode groups or individual electrodes of the second subset is smaller than 90°, and wherein at least one mantle electrode is connected to a DC voltage source so that a DC voltage supplied thereto is independently tunable as to provide the mantle electrode with an individual compensation voltage for correcting an asymmetric electric field in the FT-ICR cell.

In various embodiments, the FT-ICR cell comprises four individual mantle electrodes of which two have a width, in an unwound representation, which is twice as broad as that of the other two mantle electrodes, wherein the smaller mantle electrodes form the second subset used for the detection of an image current transient.

In various embodiments, the FT-ICR cell comprises six individual mantle electrodes of equal width, in an unwound representation, and further comprising an electrical circuit that electrically couples and decouples at least two opposing mantle electrodes each with one adjacent mantle electrode in order to form one of the first subset and second subset of the mantle electrodes.

In various embodiments, the mantle electrodes comprise inverse-leaf and leaf electrodes, in an unwound representation, wherein the inverse-leaf electrodes and adjacent leaf electrodes may be electrically coupled together as to form one of the first subset and second subset of mantle electrodes.

In various embodiments, the FT-ICR cell further comprises a switchable electrical circuit allowing for a variable electrical coupling of mantle electrodes to form one of the first subset and second subset.

In various embodiments, at least one of the mantle electrodes is divided by transverse cuts along a longitudinal direction, each segment thusly created being connected to a DC voltage source so that a DC voltage supplied thereto is independently tunable to provide each segment with an individual compensation voltage in order to allow for the correction of a non-uniform perturbation of the electric field axis in the FT-ICR cell.

In various embodiments, at least one of the mantle electrodes is divided by a longitudinal cut in order to allow for flexible forming of electrically coupled mantle electrode subsets (or individual electrode groups).

In various embodiments, each of the mantle electrodes is connected to a DC voltage source so that a DC voltage supplied thereto is independently tunable to provide each of the mantle electrodes with an individual compensation voltage for correcting an asymmetric electric field in the FT-ICR cell.

In various embodiments, a method for detecting an asymmetry of an electric field in an FT-ICR cell in a radial direction relative to an axis of the FT-ICR cell comprises, determining parameters indicative of a position or a diameter of a center axis of a magnetron motion for an ion with a reduced cyclotron frequency $v_R$ in the ICR cell by monitoring relative intensities (relative to the intensity of the main or fundamental peak with frequency $v_R$) of at least one of the ion signals with frequencies of $nv_R$ and $nv_R \pm mv_M$, n=2, 4, 6, . . . , and m=1, 2, 3, . . . , as a function of the ion's post capture delay time, and by evaluating maxima and minima of the relative intensities. The ±sign indicates that either a satellite peak shifted to higher frequencies or one shifted to lower frequencies, or also two or more of them simultaneously, can be monitored.

In various embodiments, a method for correcting an asymmetry of an electric field in an FT-ICR cell with mantle electrodes comprises determining parameters indicative of a position or a diameter of a center axis of a magnetron motion for an ion with frequency $v_R$ in the ICR cell by monitoring, over several measurements, relative intensities (relative to the intensity of the main or fundamental peak with frequency $v_R$) of at least one of the ion signals with frequencies of $nv_R$ and $nv_R \pm mv_M$, n=2, 4, 6, . . . , and m=1, 2, 3, . . . , as a function of the ion's post capture delay time, and by evaluating maxima and minima of the relative intensities, and minimizing an intensity of a maximum of at least one of an even-numbered harmonics peak for the ion with frequency $v_R$ with frequency $nv_R$ and a satellite peak with a frequency of $nv_R \pm mv_M$ by adjusting compensation voltages at one or more of the mantle electrodes of the FT-ICR cell.

As set out initially, normally the axis of the magnetron motion is expected to coincide with the FT-ICR cell axis, but occasionally the axis of the ionic magnetron orbit in an ion cyclotron resonance cell (FT-ICR cell) shows a radial offset from the geometric axis of the cell. An offset of the magnetron orbit negatively influences the cyclotron excitation process of the ions and their detection. It also impairs the detected signal, leads to an increase of the intensity of the peaks associated with the even-numbered (e.g., second) harmonics in the Fourier transformed spectrum and to more abundant sidebands of the ion signal. In extreme cases, ions can be lost during the cyclotron excitation when they are on large and offset magnetron orbits that are critically close to the cylinder mantle electrodes. A method (and a device) for the correction of asymmetric electric fields in an FT-ICR cell leads to offset magnetron orbits. The method helps identifying a displacement of the electric field axis and/or trimming the correspondingly displaced magnetron axis back to the cell axis.

One intrinsic property of a (fast) Fourier transform detection method is the appearance of harmonic frequencies of the measured (fundamental) mass peaks in a spectrum. In the ideal case of a perfectly symmetric electric field only odd-numbered harmonic frequencies, such as $3^{rd}$, $5^{th}$, etc., should appear in the spectrum due to a pure cyclotron motion around the center of the FT-ICR cell. The intensities and distribution of the odd-numbered harmonics depend on the ion cyclotron radius and the arrangement of the detection electrodes. Any distortion/asymmetry of the electric field or improper injection of an ion package into the FT-ICR cell, however, entails a magnetron motion of the ions in the FT-ICR cell. In such case, additional even-numbered harmonic frequencies of the main or fundamental ion signal appear in the spectrum.

In various embodiments, an electric field asymmetry in the ICR cell is detected by measuring the intensity of the second harmonic peak with the frequency $2v_R$ of a pseudomolecular ion peak with the reduced cyclotron frequency $v_R$ and a satellite peak with frequency $2v_R+v_M$. The intensities of these peaks are reduced (e.g., minimized) by the adjustment of compensation voltages at some of the mantle electrodes. Preferably, the starting time of the excitation has to be chosen correctly with regard to the phase of the slow magnetron motion.

In various embodiments, the FT-ICR cell is a dynamically harmonized FT-ICR cell with leaf and inverse-leaf electrodes wherein DC voltage values at the inverse-leaf electrodes are individually varied for the correction of the electric field asymmetry. In further embodiments, some of the leaf electrodes are split. In some embodiments, the DC voltage values at the inverse-leaf electrodes are varied independent of each other until a common minimum of the even-numbered harmonics peak with the frequency of $nv_R$ and its satellite peak with the frequency of $nv_R \pm mv_M$ is found. In another embodiment, the relative intensities of the peaks with the measured frequencies of $nv_R \pm mv_M$ and $nv_R$ are reduced/minimized in dependence of the ion's post capture delay time by changing the independently variable DC voltage values at the inverse-leaf electrodes and varying the post capture delay time. In various embodiments, the FT-ICR cell is a conventional FT-ICR cell with excitation and detection electrodes and DC voltage values at the excitation and detection electrodes are individually varied for the correction of the electric field asymmetry. In further embodiments, the FT-ICR cell is a conventional FT-ICR cell with excitation and detection electrodes, and the relative intensities of the peaks with the measured frequencies of $nv_R \pm mv_M$ and $nv_R$ are optimized in dependence of the post capture delay time for the correction of the electric field asymmetry by changing independently variable DC voltage values at the excitation and detection electrodes of the FT-ICR cell and varying the post capture delay time.

In various embodiments, a dynamically harmonized FT-ICR cell with leaf and inverse-leaf electrodes is suggested, wherein each inverse-leaf electrode is connected to a DC voltage source so that a DC voltage supplied thereto is tunable (e.g., independently) to provide each inverse-leaf electrode with an individual compensation voltage for correcting an asymmetric electric field in the FT-ICR cell.

In various embodiments, each inverse-leaf electrode is paired with one adjacent inverse-leaf electrode, and wherein each pair is jointly connected to a tunable DC voltage source as to provide each pair of inverse-leaf electrodes with an individual joint compensation voltage for correcting an asymmetric electric field in the FT-ICR cell. In further embodiments, the inverse-leaf electrodes are segmented by transverse cuts in the longitudinal direction, each segment being connected to a DC voltage source so that a DC voltage supplied thereto is independently tunable as to provide each segment with an individual compensation voltage for correcting an axially asymmetric electric field, or a non-uniform perturbation of the electric field axis, in the FT-ICR cell. In some embodiments, each segment of an inverse-leaf electrode is paired with a corresponding segment of one adjacent inverse-leaf electrode and jointly connected to a tunable DC voltage source as to provide each pair of segments with an individual joint compensation voltage for correcting an axially asymmetric electric field in the FT-ICR cell.

In various embodiments, an FT-ICR cell with excitation (first subset) and detection (second subset) electrodes is suggested, wherein each excitation and detection electrode is connected to a DC voltage source so that a DC voltage supplied thereto is independently tunable as to provide each excitation and detection electrode with an individual compensation voltage for correcting an asymmetric electric field in the FT-ICR cell.

In various embodiments, the excitation electrodes (first subset) are grouped in two or more pairs of adjacent excitation electrodes and the detection electrodes (second subset) are grouped in two or more pairs of adjacent detection electrodes. In further embodiments, the correction results in a pattern of compensation voltages applied to at least one of the excitation electrodes and detection electrodes that is not homogenous.

In various embodiments, an FT-ICR cell with excitation (first subset) and detection (second subset) electrodes is suggested, further comprising longitudinal correction electrodes positioned between the excitation and detection electrodes, each longitudinal correction electrode being connected to a DC voltage source so that a DC voltage supplied thereto is independently tunable as to provide each longitudinal correction electrode with an individual compensation voltage for correcting an asymmetric electric field in the FT-ICR cell.

In various embodiments, the correction electrodes between the excitation and detection electrodes are segmented by transverse cuts, each segment being connected to a DC voltage source so that a DC voltage supplied thereto is independently tunable as to provide each segment with an individual compensation voltage for correcting an axially asymmetric electric field, or a non-uniform perturbation of the electric field axis, in the FT-ICR cell. In further embodiments, the correction electrodes have a smaller width than the excitation and detection electrodes.

The scope of the present invention is intended to include a sensitive method for correcting an offset electric field in the FT-ICR cell, such as for magnetron orbit reduction, and still using the advantages of excitation and detection with wider than 90° excitation and detection individual electrodes or individual electrode groups, e.g. covering an angular range of about 120°.

In FT-ICR cells with unequally divided mantle electrodes or electrode groups (not 4×90°) which can be used for excitation as well as detection, the larger set of electrodes, i.e., the one covering a larger angular range, will preferably be used for excitation and detection in an analytical measurement. In case of the cell with two 120° and two 60° electrodes, or electrode groups that are electrically coupled to function as one integral electrode, during a 120° electrode cyclotron excitation event, a relatively large volume around the cell axis is exposed to a homogeneous electric RF excitation field. As a consequence, a possible ion's initial magnetron orbit will not be shifted, or only very slightly, depending on the cyclotron excitation amplitude. It cannot be reduced e.g. by choosing a proper post capture delay. Also, if for some reason, e.g., surface charging, the radial DC electric field center is off axis, the magnetron motion will also be off axis and not affected by the cyclotron excitation event.

On the other hand, a detection using 120° individual electrodes or individual electrode groups only produces very low intensity even-numbered harmonic peaks. A successful electric trapping field axis correction and reduction of the initial magnetron orbit using the method as described in the initially mentioned U.S. patent application Ser. No. 13/767,595 is here not possible as the relevant harmonics will most likely not show up.

The radial electric field center still needs to be moved back to the geometric cell center and the initial magnetron orbit needs to be reduced, specifically when a dynamically harmonized FT-ICR cell is used, since the ions experience a harmonic potential averaged over a cyclotron cycle. The dynamic harmonization is most efficient if the magnetron orbit is vanishingly small.

If two 120° individual electrodes or individual electrode groups are used for excitation and detection, the remaining two subsets of mantle electrodes consist of a 60° individual electrode or individual electrode group each. As FIG. 16*b* shows, the equipotential lines of the oscillating electric excitation field of 60° individual electrodes (or individual electrode groups) used for the resonant excitation of the cyclotron motion of ions are very inhomogeneous. When 60° cyclotron excitation is applied ions are exposed to very large forces generated by the pseudo potentials, much worse than in the case of 90° or 120° excitation. Therefore, the excitation with the 60° individual electrodes or individual electrode groups should not be used for the regular or analytical mass spectrometric measurements.

However, 60° individual electrodes or individual electrode groups can be used for the method of correction of the electric trapping field axis shift and reduction of the initial magnetron orbit as described in the afore-mentioned U.S. patent application Ser. No. 13/767,595. As FIGS. 18*c-d* show, using the 60° individual electrodes (or individual electrode groups) for the detection, now the relevant second harmonic peaks appear at much larger intensities compared to the 90° and 120° individual electrode or individual electrode group detection. In combination with the "bad" 60° individual electrode or individual electrode group excitation this method is much more sensitive to the detection and correction of the field axis shift as described in the patent application Ser. No. 13/767,595 than using 90° or 120° individual electrodes or individual electrode groups.

After the correction of the electric field axis shift and reduction of the magnetron orbit by using the 60° individual electrodes or individual electrode groups, the normal accurate measurement can be performed using the 120° individual electrodes or individual electrode groups for excitation as well as the detection.

As a more general rule, if the FT-ICR cell includes smaller and larger individual electrodes, or individual electrode groups that are electrically coupled to function as one integral electrode, the detection process for the electric field correction should be performed using the smaller angle electrodes or electrode group or the smaller angle electrode pair. The excitation can be conducted either with the smaller or correspondingly larger angle electrodes. The larger angle electrode pair can be used for the excitation and detection processes of the actual accurate or analytical mass spectrometric operation.

These and other objects, features and advantages of the present invention will become more apparent in light of the following detailed description of preferred embodiments thereof, as illustrated in the accompanying drawings.

BRIEF DESCRIPTION OF THE DRAWINGS

FIGS. 18*a-f* shows a series of simulated spectra representing the setting when the spectra are detected using 90°, 60° and 120° electrodes (second subset of mantle electrodes) of an FT-ICR cell for the discussion of the appearance of harmonic peaks and sidebands.

FIG. 19 is a table showing the occurrence of harmonic peaks and/or sidebands observed with FT-ICR cells having different angular electrode configurations and/or excitation and detection modes.

DETAILED DESCRIPTION OF THE INVENTION

In one embodiment, the present invention aims at detecting an electric field asymmetry in the ICR cell and eliminating it by compensating and correcting the electric field.

The existence of the magnetron motion in the cell produces normally very weak side-bands around the main ion cyclotron resonance signal of an ion measured at the frequency $v_R$ which are on the frequency scale, for instance, in a distance of the magnetron frequency $v_M$ and $2v_M$. Additionally, in the mass spectrum a peak with half the mass, i.e., with the doubled reduced cyclotron frequency $2v_R$ appears, this is the peak of the second harmonic. Another signal with comparable abundance appears in the direct vicinity of the $2v_R$ signal, which is a satellite peak with a frequency of $2v_R+v_M$. This satellite peak is separated from the second harmonics by just a magnetron frequency $v_M$. The mass difference is e.g. at m/z 351 about 0.007 Dalton. Depending on conditions, also other satellite signals with even less abundance can appear in distances of $mv_M$ (m=2, 3, 4, . . . ), which are of insignificant abundance under regular measurement conditions, however, can in principle also be used for the electric field correction if found to be sufficiently abundant. In the frequency spectrum or mass spectrum, these distances are extremely small since the magnetron frequency $v_M$ under the applied electric and magnetic field conditions is in general less than 10 Hz.

Figure 1:
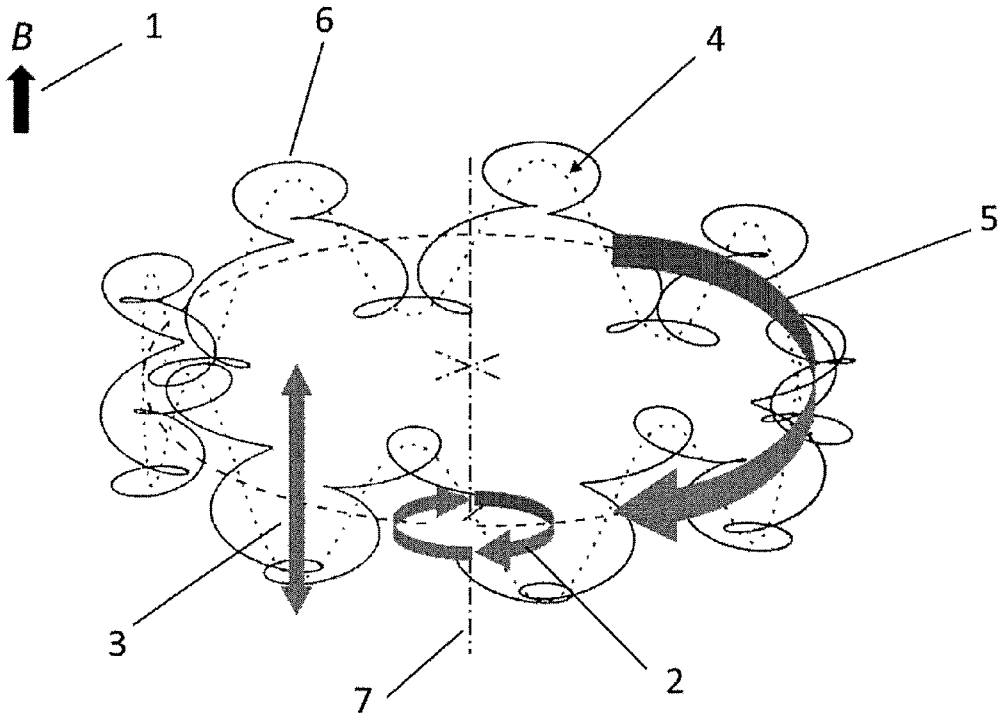
FIG. 1 shows the combined motion of the ions in an FT-ICR cell.
Figure 2A:
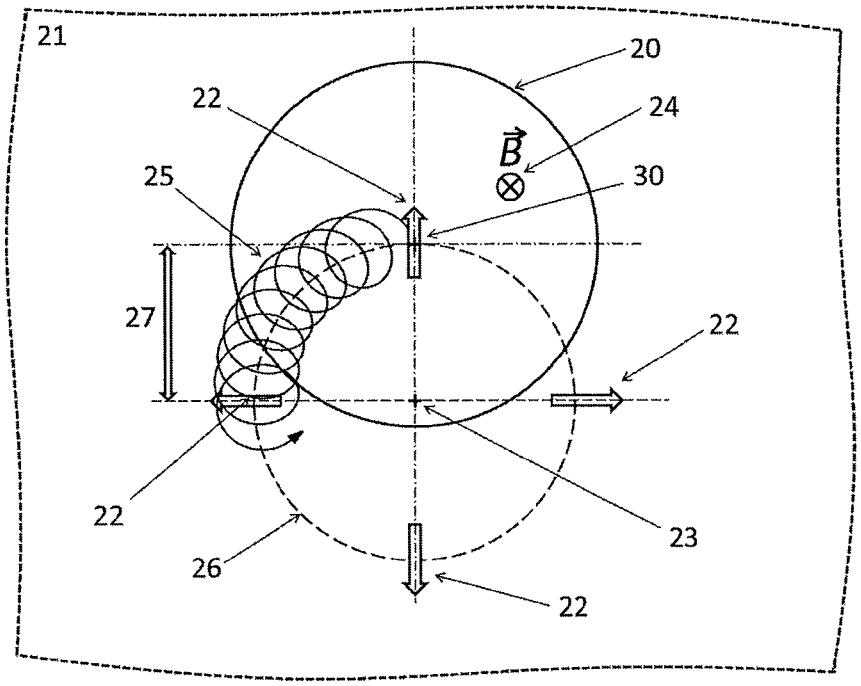
FIG. 2*a* shows the entrance hole within the trapping plate of an ICR cell with a strongly shifted electric field axis. It also shows the ion's starting magnetron orbit when it is introduced into the cell exactly on the cell axis.
Figure 2B:
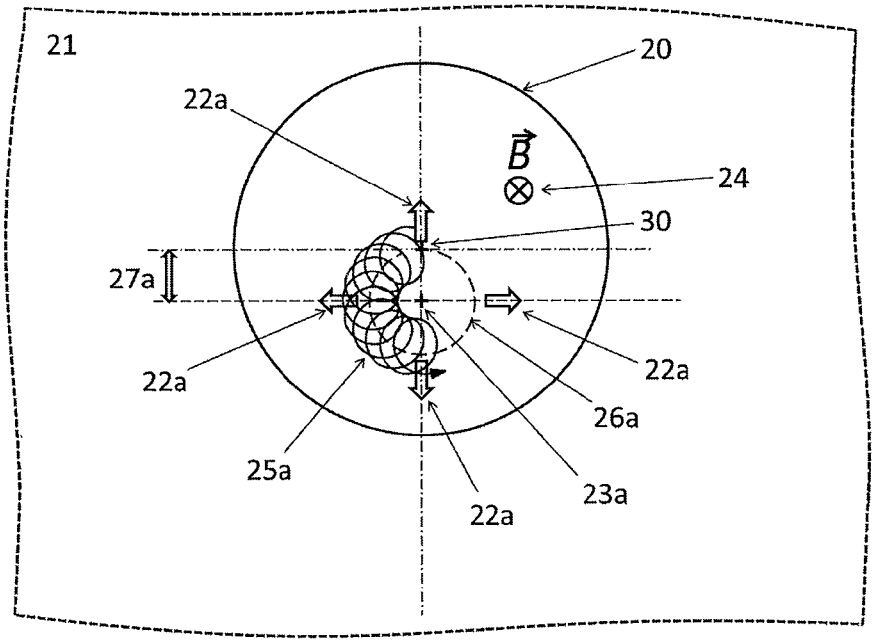
FIG. 2*b* shows the entrance hole of an ICR cell with a slightly shifted electric field axis. It also shows the ion's starting magnetron orbit when it is introduced into the cell exactly on the cell axis.
Figure 3A:
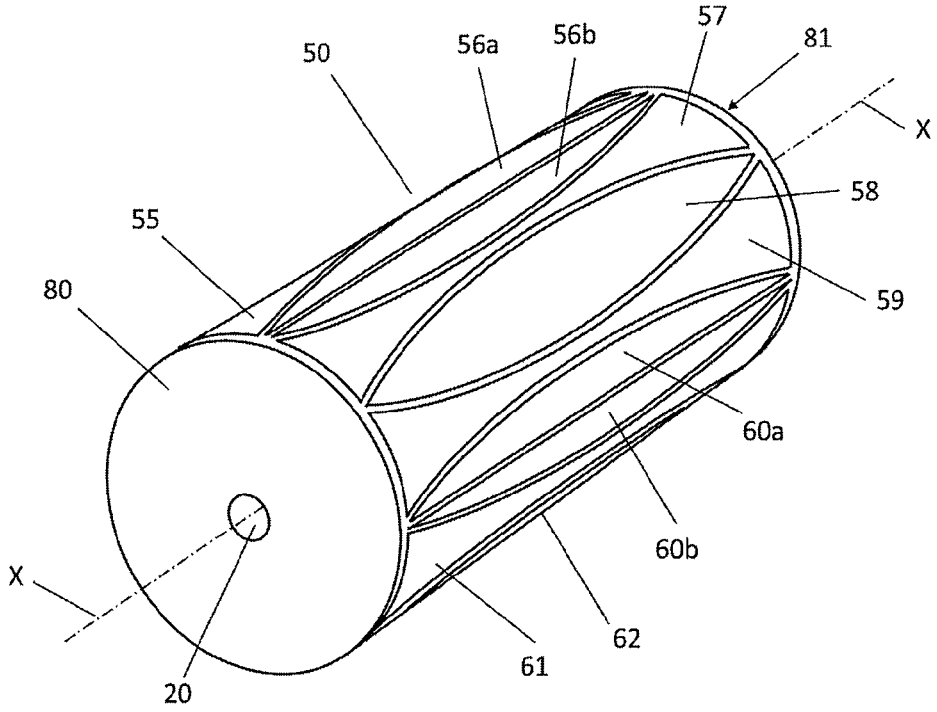
Fig. 3a (Prior Art)
FIG. 3*a* (prior art) presents a dynamically harmonized ICR cell with leaf shaped (integral and split) and inverse-leaf shaped electrodes.
Figure 3B:
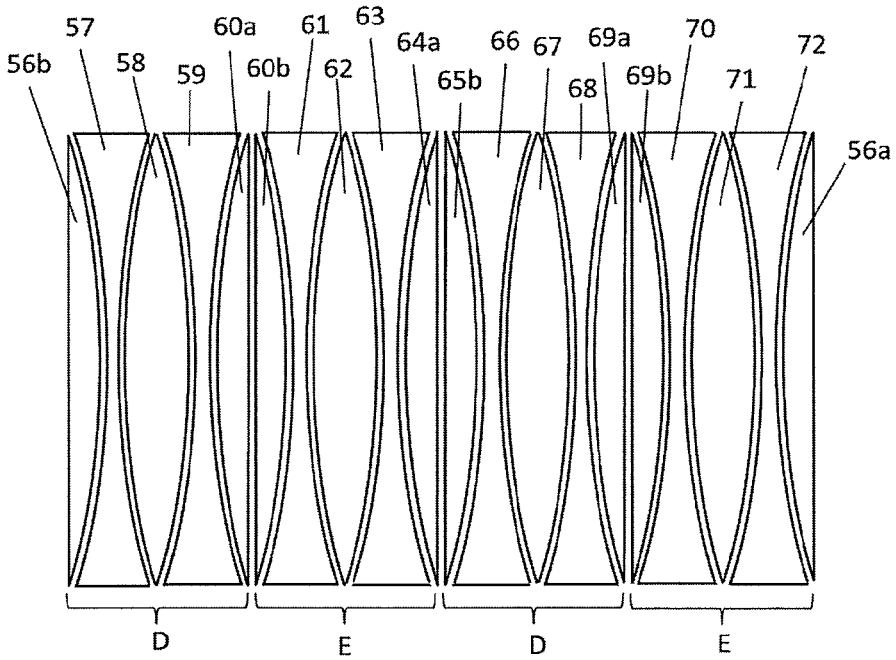
Fig. 3b (Prior Art)
FIG. 3*b* (prior art) depicts the unwound mantle electrodes.
Figure 4A:
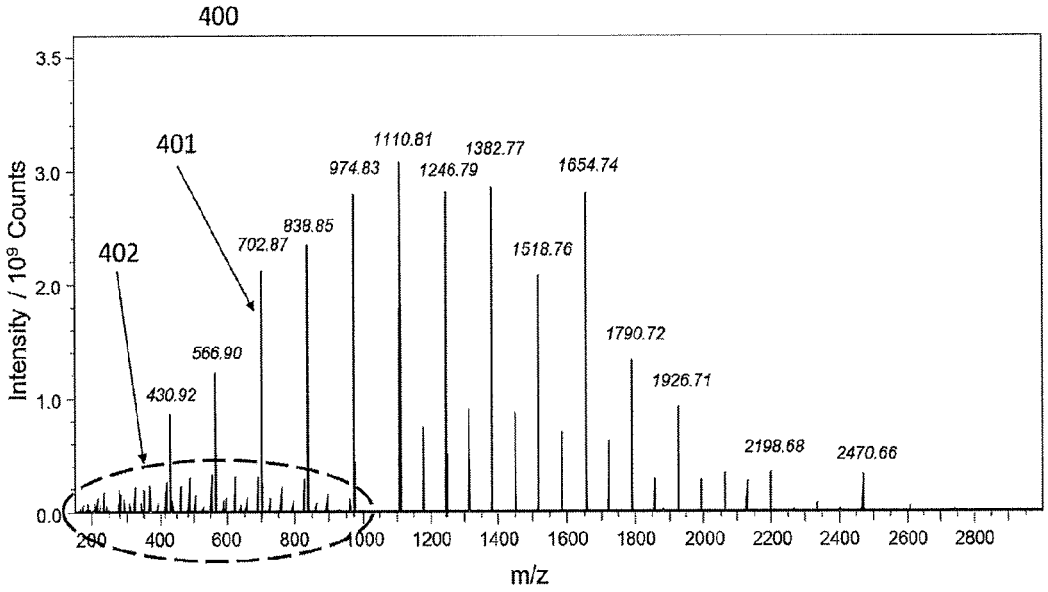
FIG. 4*a* shows a broadband FT-ICR mass spectrum of sodium trifluoroacetate (NaTFA) that mainly consists of a series of cluster ion peaks.

In FIGS. 4*a*-4*d* an example of unfavorable conditions in a dynamically harmonized ICR cell containing leaf and inverse-leaf electrodes is shown: an asymmetric electric field is here artificially generated by using a special set of voltages at the four pairs of the leaf electrodes (as shown in FIGS. 3*a*-3*b*). Under these circumstances ions circle on large and offset magnetron orbits. FIG. 4*a* shows the full FT-ICR mass spectrum 400 of sodium trifluoroacetate in the ICR cell with a slightly offset electric field axis and, thus, under unfavorable conditions in terms of position and size of the magnetron orbit to demonstrate the effect.

Figure 4B:
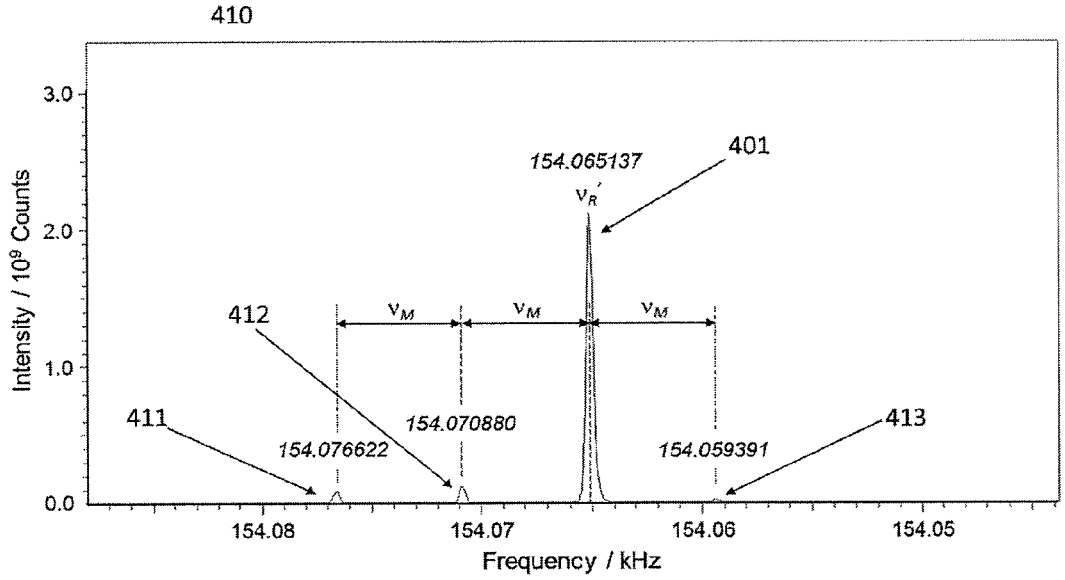
FIG. 4*b* displays a closer view of a selected peak (154.065137 kHz=>m/z 702.87) of the NaTFA spectrum with its sidebands.

The peak with m/z=702.87 Da 401 is selected for a closer view and displayed in FIG. 4*b*. On the abscissa of the spectrum in FIG. 4*b* the scale is converted from mass scale to a frequency scale (therefore the numbers increase to the left) and the peaks are shown with their measured cyclotron frequencies. The reduced cyclotron frequency of the selected main peak with m/z=702.87 Da 401 is called $v_R'$. It has three visibly abundant sidebands at frequencies $v_R'+v_M$ 412, $v_R'+2v_M$ 411, and $v_R-v_M$ 413. Sidebands indicate the existence of significantly large magnetron orbits and confirm the unfavorable conditions in the FT-ICR cell during the acquisition of these spectra.

Figure 4C:
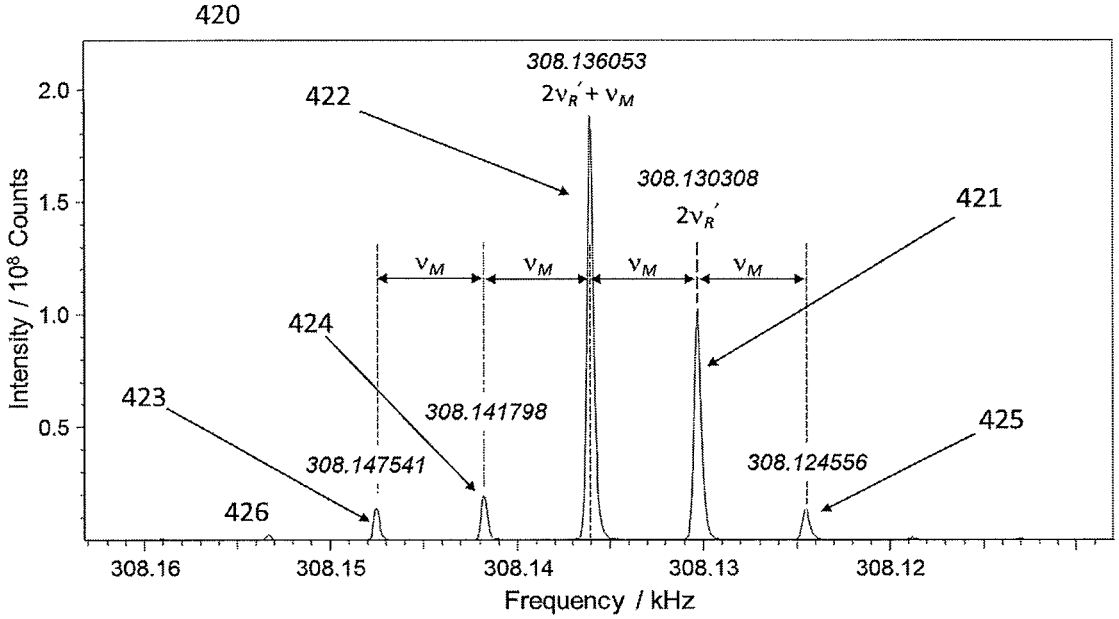
FIG. 4*c* shows a closer view of the second harmonics peak of this ion with the frequency $2v_R'$, its major satellite peak with the frequency $2v_R'+v_M$ and some minor satellite peaks. The FIGS. 4*a*-4*b* show measurements where no correction of an asymmetric electric field in the FT-ICR cell is applied.

FIG. 4*c* shows the second harmonics 421 of the main peak at m/z=702.87 Da 401 at twice its measured cyclotron frequency $2v_R'$, therefore, at the half of its m/z value. The abscissa of the spectrum in FIG. 4*c* is again converted to the frequency scale and all peaks are shown with their measured cyclotron frequencies. The second harmonics has a set of satellite peaks 422, 423, 424, 425 in distances equal to multiples of the magnetron frequency $v_M$. The satellite peak with highest abundance has the frequency $2v_R'+v_M$ 422) In principle, some or all of these satellite peaks 423, 424, 425 can be used to perform the electric field correction.

The intensity of the second harmonics peak with the frequency of $2v_R'$ is related to the position of the magnetron motion. If the center of the magnetron orbit approaches the cell axis, the intensity of the second harmonics is reduced. If the magnetron axis virtually coincides with the cell axis, the second harmonics peak virtually disappears, that is, is hardly detectable above the noise. Additionally, the intensity of the satellite peak with the frequency $2v_R'+v_M$ is related to the size of the magnetron orbit. If the magnetron radius is large, as in this example, this satellite peak is considerably abundant. A comparison of the scales of the ordinates of FIGS. 4*b*-4*c* shows that the second harmonics and its major satellite peak are by more than an order of magnitude smaller than the main signal. The distribution of the second harmonics peak 402 can even be seen in the broadband spectrum shown in FIG. 4*a* (see the dashed ellipse).

One aim of the electric field correction is that the ions in the cell circle on magnetron orbits that have a diameter as small as possible and are as central as possible. Simulations of the ion motion in the ICR cell show, for example, that the second harmonics with the frequency 2v; disappears if the magnetron orbit is concentric with the cell, i.e., if its center is on the cell axis. If the electric field axis does not coincide with the cell axis (e.g., if it is radially displaced) this will also shift the magnetron orbit radially and the second harmonics peak will appear. On the other hand, the intensity of the satellite peak $2v_R+v_M$ of the second harmonics increases with the magnetron radius. In order to achieve small magnetron orbits which are as central as possible, in an embodiment according to the present invention it is proposed correcting or compensating electric field conditions by using varying compensation voltages at the various mantle electrodes so that the intensities of the second harmonics and its satellite peak become as small as possible.

Ion motion simulations show that, during the cyclotron excitation process of an ion which is not at the cell axis, the center of the cyclotron motion shifts radially. If, at the start of the cyclotron excitation, the ion is located in the quadrant of an excitation electrode, the center of its cyclotron path is shifted away from the excitation electrode to the axis of the cell. This means the ion will continue orbiting on a slightly smaller magnetron orbit after the cyclotron excitation. The magnetron motion is de-excited or relaxed. If the ion, however, is located, at the start of the cyclotron excitation, in the quadrant of a detection electrode, the center of its cyclotron path is shifted in a direction to the detection electrode, away from the axis of the cell. This means, after this cyclotron excitation, the ion continues circling on a larger magnetron orbit. Its magnetron motion is excited during the cyclotron excitation period. An increase of the size (or diameter) of the magnetron orbit leads to a stronger satellite peak $2v_R+v_M$ of the second harmonics $2v_R$. Thus, in a complete magnetron cycle around the cell axis there are two phases where a cyclotron excitation increases the intensity of the satellite peak $2v_R+v_M$ and two phases where a cyclotron excitation decreases the intensity of the satellite peak $2v_R+v_M$.

Figure 5A:
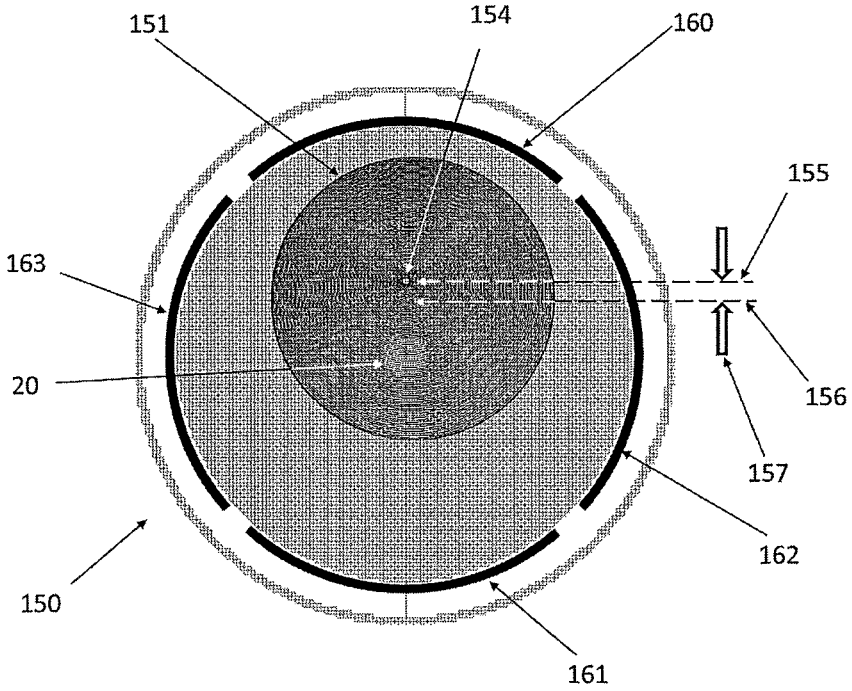
FIG. 5*a* shows, in a cross sectional view of an ICR cell, the simulated cyclotron excitation of an off axis ion in the quadrant of an excitation electrode.

FIG. 5*a* shows the result of a simulation. In the cross sectional view 150 of a cylindrical ICR cell with excitation electrodes 160, 161 forming a first subset and detection electrodes 162, 163 forming a second subset of the mantle electrodes, a simulated cyclotron path 151 is depicted. Prior to its cyclotron excitation, the ion is not on axis of the ICR cell, but on a position 154 in the quadrant of one of the excitation electrodes 160 due to its large and excited, or offset, magnetron orbit. After the cyclotron excitation the center of the excited cyclotron orbit is no longer at the same position 154 but it is now somewhat closer to the center of the cell. The difference 157 is shown between the two dashed lines 155 and 156 in FIG. 5*a*.

Figure 5B:
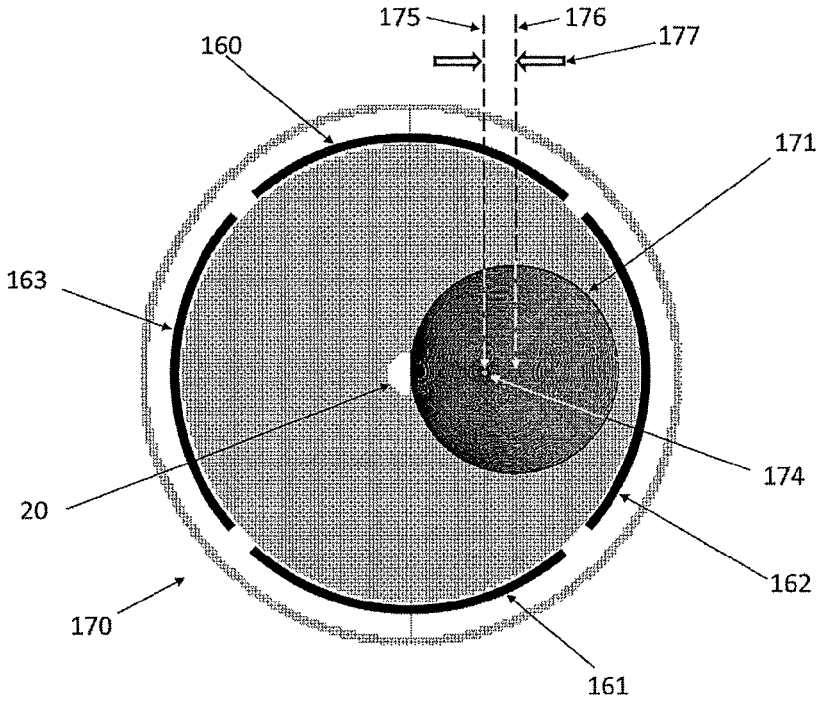
FIG. 5*b* shows, in the same cross sectional view of the ICR cell, the simulated cyclotron excitation of an off axis ion in the quadrant of a detection electrode.
Figure 6:
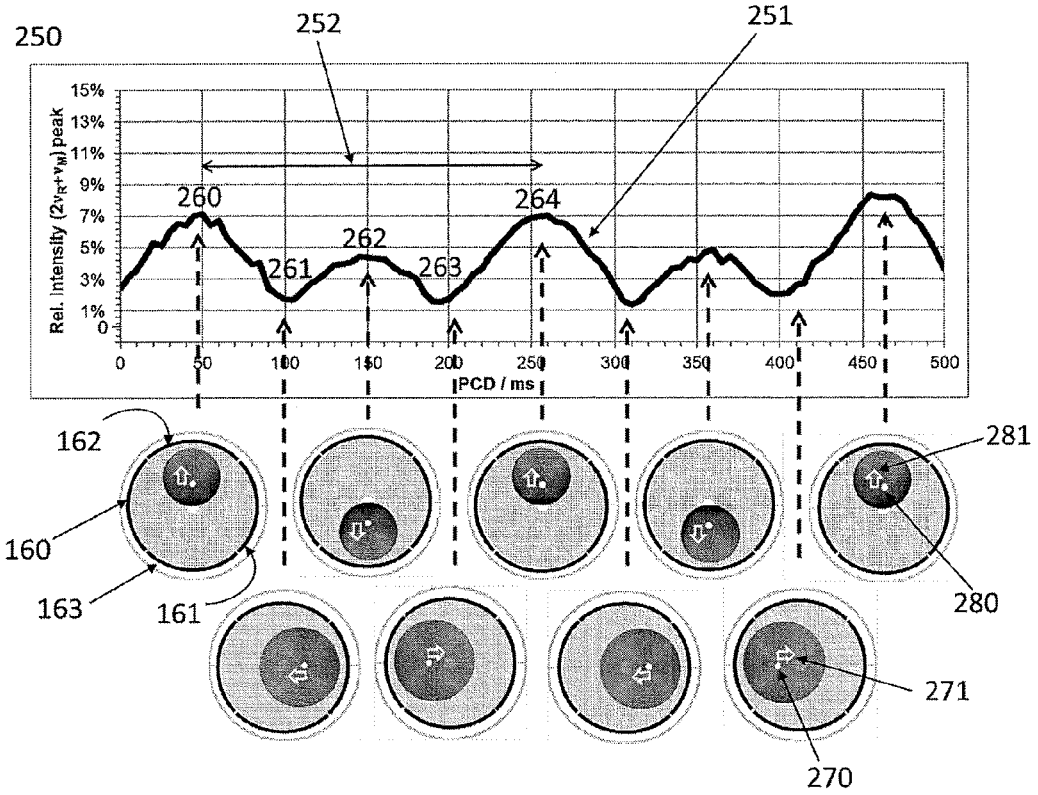
FIG. 6 depicts a post capture delay (PCD) curve with maxima and minima, the reference numbers of which are explained in the text further below, and with corresponding phases of the motion of the ions.

FIG. 5*b* also shows the result of a simulation. In the cross section view 170 of a cylindrical ICR cell with excitation electrodes 160, 161 forming a first subset and detection electrodes 162, 163 forming a second subset of the mantle electrodes, a simulated cyclotron path 171 is depicted. Prior to its cyclotron excitation, the ion is not on axis of the ICR cell, but at a position 174 in the quadrant of one of the detection electrodes 162 due to its large and excited, or offset, magnetron orbit. After the cyclotron excitation, the center of the excited cyclotron orbit is no longer at the same position 174 but it is now somewhat closer to the detection electrode 162. The difference 177 is shown between the two dashed lines 175, 176 in FIG. 5*b*.

Compared to the cyclotron motion, the magnetron motion is very slow. Thus, when an ion is cyclotron-excited on its magnetron orbit, after the excitation, the ion practically does not move further on its magnetron path. If, in accordance with one embodiment, between the capture of the ion in the cell and the excitation of the cyclotron motion a variable delay (post capture delay, PCD) is inserted into the experiment sequence, the ion can be monitored on its magnetron orbit with the satellite peak $nv_R+mv_M$ of an even-numbered harmonics, such as the second harmonic with n=2. If after a certain post capture delay time the ion arrives in the quadrant of a detection electrode, where the resonant cyclotron excitation takes place, the monitored intensity of the $2v_R+v_M$ peak increases to a maximum. After a still larger post capture delay time the ion arrives in the quadrant of an excitation electrode, when the resonant cyclotron excitation takes place, and the monitored intensity of the $2v_R+v_M$ peak decreases for example to a minimum.

In some embodiments, the measured dependence of the relative intensity of the $2v_R+v_M$ peaks on the post capture delay (PCD) can be used to obtain information about the displacement (or shift) of the magnetron orbit and about the symmetry of the DC electric field in the cell. PCD diagrams of ions on magnetron orbits around the cell axis show two equally high maxima and two equally high minima within one magnetron period. If the maxima are not equally high, this is a sign that the magnetron orbit is shifted, i.e., that the electric field axis does no longer coincide with the cell axis. Relatively small magnetron orbits result in flat and shallow PCD curves with low intensity. Larger magnetron orbits are responsible for the higher maxima and deeper minima. Magnetron orbits which are shifted completely to one side of the cell result in PCD curves with one single maximum and one single minimum within a magnetron period. Very small magnetron orbits which are completely off axis and shifted to a quadrant of the cell, which however, due to their small size still are very close to the cell axis, form flat PCD curves with a single maximum and a single minimum within a magnetron period and still deliver good FT-ICR spectra. It has to be noted that the relative intensity of the $2v_R+v_M$ peak changes often very strongly with the variation of the post capture delay time, while the relative intensity of the second harmonics $2v_R$ shows no significant change vs. the variation of the post capture delay time.

The magnetron orbit not circling around the cell axis is an indicator that the electric field axis is shifted. By compensating the shifted electric field, the field axis can be moved back close to the geometric axis of the cell, in the best case even such that it coincides with the geometric axis.

Figure 7:
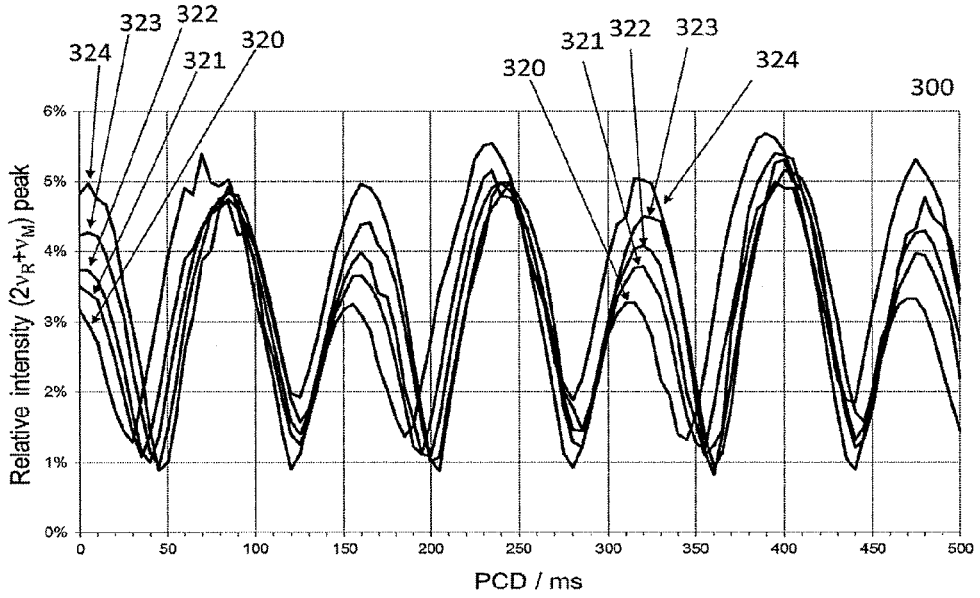
FIG. 7 depicts five post capture delay curves showing an electric field axis correction by varying the voltage of one pair of inverse-leaf electrodes in a dynamically harmonized ICR cell.

In one embodiment, for correcting an asymmetric electric field inside a dynamically harmonized ICR cell, the inverse-leaf electrodes are used, which anyway carry a common DC potential. This DC potential can be re-adjusted in order to shim the shifted electric field axis back to the geometric axis of the cell. FIG. 7 shows the effect of an embodiment of the electric field correction in a dynamically harmonized ICR cell 50 from FIG. 3*a* on a different PCD diagram 300. The first PCD curve 320 shows alternating low and high maxima. Prior to plotting this curve in a dynamically harmonized ICR cell, a DC voltage of 1500 mV is connected to all inverse-leaf shaped electrodes of the cylinder mantle. For the electric correction, the voltage applied to a pair of the inverse-leaf electrodes during the excitation (61, 63 in FIG. 3*b*) is varied, while the others are kept at 1500 mV. Before plotting the curve 321 the voltage of the electrode pair 61, 63 is reduced to 1485 mV. Upon this change the lower maxima become little higher. The curves 322, 323 are plotted with voltages of this electrode pair at 1475 mV and at 1465 mV, respectively. Finally, at 1450 my a PCD curve 324 is observed, which contains approximately equally high maxima. The field compensation in this embodiment is accomplished and the axis of the magnetron orbit is now close to concentric with the cell axis.

Figure 8:
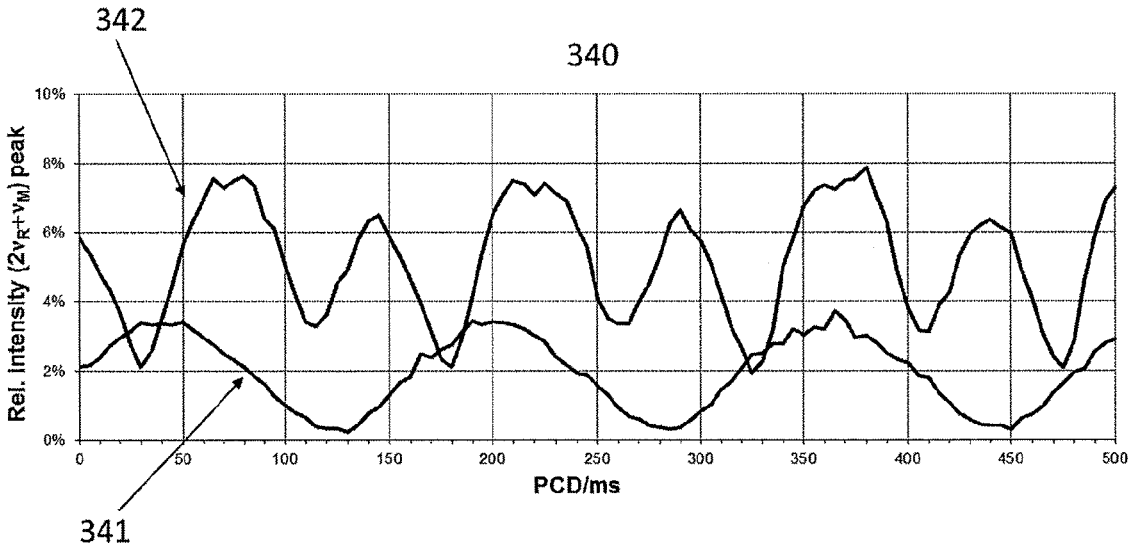
FIG. 8 shows a PCD curve having a single maximum within a magnetron period in comparison to another PCD curve having double maxima within a magnetron period.

As mentioned above, a PCD curve with all equally sized maxima is a sign for a central magnetron motion, i.e., a practically central electric field axis. However, it can also be desirable that the magnetron orbit has a relatively small radius. Thus, the intensity of the satellite peak with frequency e.g., $2v_R+v_M$ needs to be as small as possible, which in turn means the intensity of the PCD curve must be as small as possible. Experience shows that PCD curves which remain within an intensity range of a few percent, such as up to 2-3% or even more, are a sign for an acceptable field correction state of the ICR cell. Even a small magnetron orbit which is a little shifted away from the cell axis, and is completely in the quadrant of e.g., a detection electrode so that it produces a PCD curve with a single maximum within a magnetron period, is also an acceptable compromise. FIG. 8 shows a PCD diagram 340 with the curve 341, which shows only one maximum and one minimum within a magnetron period after a field correction is applied. In the same figure, as a comparison, another PCD curve 342 is shown which contains, after a different compensation voltage adjustment, two maxima and two minima within a magnetron period.

FIGS. 9*a*-9*d* show the effect of an embodiment of the field correction on the FT-ICR spectrum in a dynamically harmonized ICR cell. The spectrum 410 with the selected peak 401 before the application of the field correction is known from FIG. 4*b*. As mentioned above, this spectrum is shown to illustrate the effects under unfavorable electric field conditions in the ICR cell. The sidebands 411, 412, 413 are an indication of a significantly large magnetron orbit.

Figure 9A:
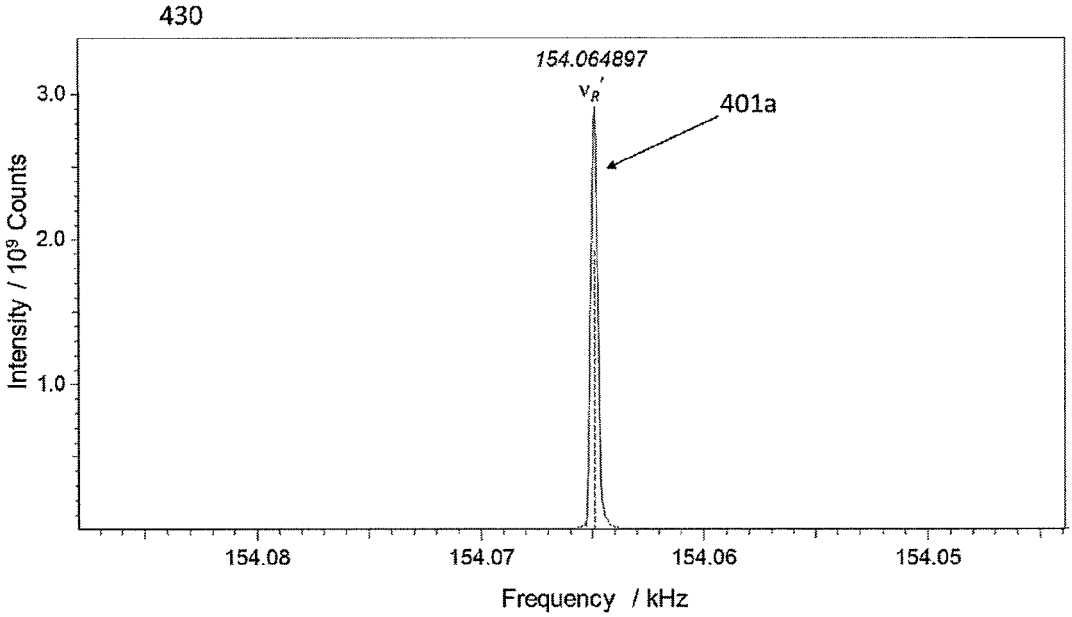
FIG. 9*a* shows the selected peak (154.064897 kHz=>m/z 702.87) from NaTFA spectrum, which was already displayed in FIG. 4*b*, after the electric field correction in the FT-ICR cell.
Figure 9B:
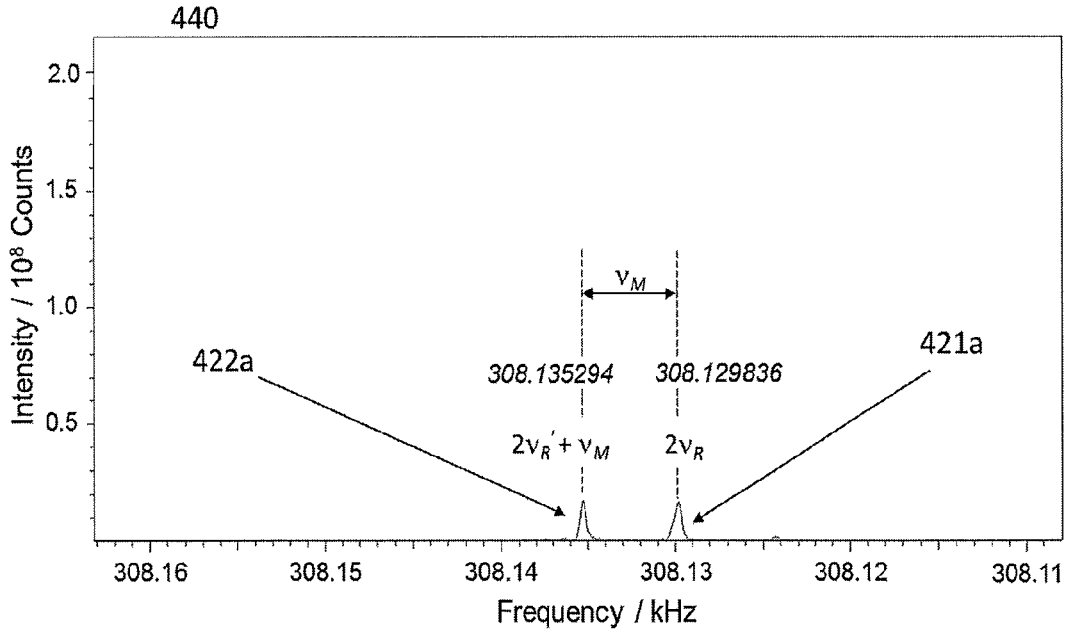
FIG. 9*b* shows the second harmonics peak of this selected ion and its satellites (on a frequency scale) after the field correction, FIG. 9*c* displays the full NaTFA FT-ICR mass spectrum after the field correction.

FIG. 9*a* shows the same part of the FT-ICR spectrum 430 after the application of a field correction according to an embodiment of the invention. Voltage differences applied to the inverse-leaf electrodes for correction were: −10 mV at the electrode pair 57, 59, −100 mV at electrode pair 61, 63, +10 mV at the electrode pair 66, 68, and +100 mV at the electrode pair 70, 72 (numerals as in FIG. 3*b*). The only visible peak in the spectrum after this correction is the main peak with the frequency $v_R'$ 401*a*, the sidebands are no longer visible. Furthermore, the absolute intensity of the main peak $v_R'$ 401*a* is here larger than before the correction (401; FIG. 4*b*). With the reduced magnetron radius, possible ion losses during cyclotron excitation are avoided. FIG. 4*c* depicts a spectrum 420 of the second harmonics $2v_R'$ 421 and its satellite peaks 422, 423, 424, 425 before field correction. FIG. 9*b*, on the other hand, depicts a spectrum 440 after field correction according to one embodiment of the invention. There are only two peaks left, the second harmonics 421*a* now less than a fifth of 421 in FIG. 4*c*, and the largest satellite peak 422*a*, now about 10% of the corresponding peak 422 in FIG. 4*c*.

Figure 9C:
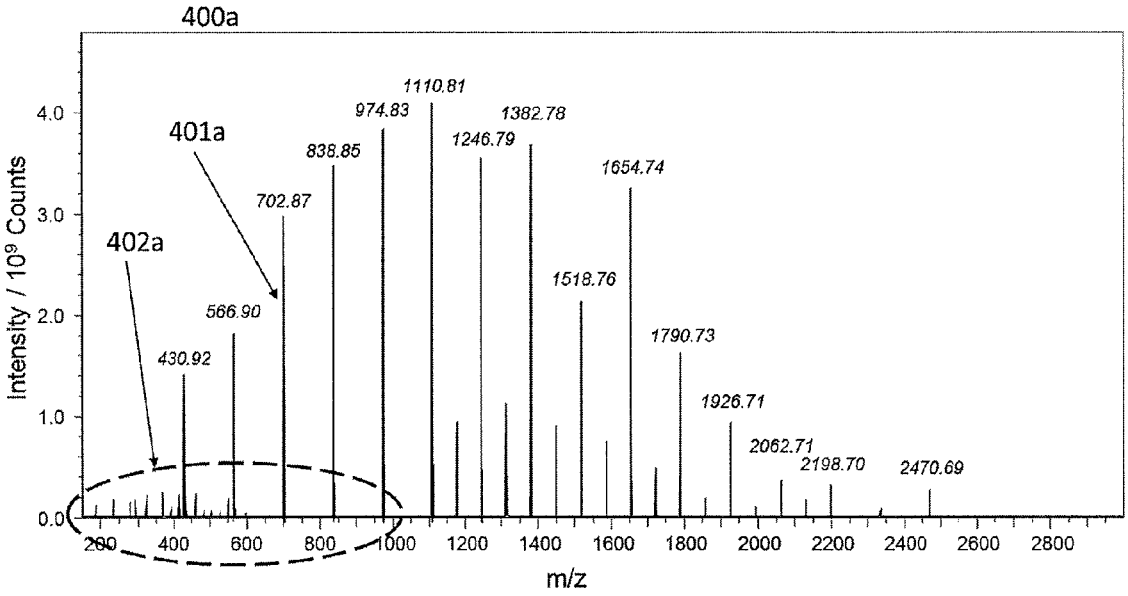
FIG. 9*d* depicts the second harmonics and its satellites at three states: Before field correction, at a point with symmetric inverse-leaf voltages and finally after the full correction.

FIG. 9*c* shows the full FT-ICR mass spectrum 400*a* of NaTFA after the field correction according to one embodiment of the invention. Not only is the intensity of the selected peak 401 increased, but also all other peaks are more abundant after the field correction. The intensity of the second harmonics peaks group 402 below m/z 1,000 is also reduced (402*a*; dashed ellipse) in the field-corrected spectrum 400*a*.

Figure 9D:
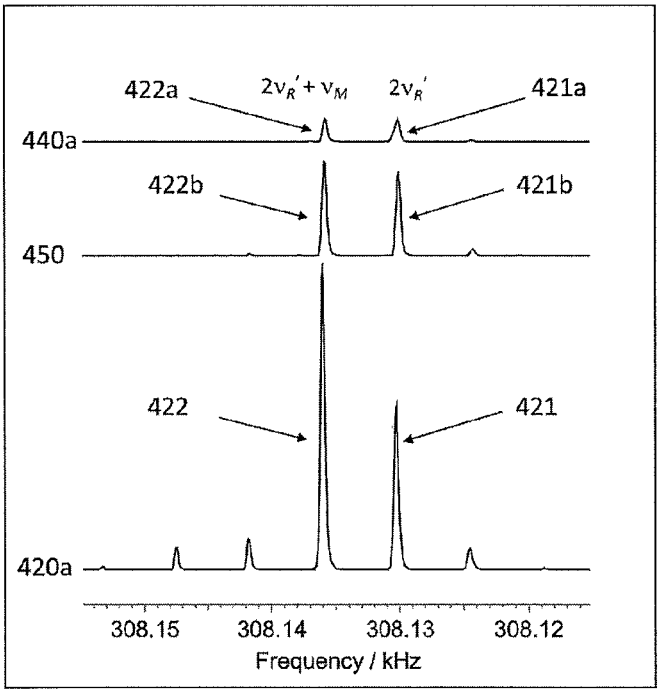

FIG. 9*d* summarizes the changes at the second harmonics peak and its satellites during the field correction on the same intensity scale. The extracted partial spectrum 420*a* at the bottom shows the second harmonics 421 of the ion with m/z 702.87 Da (on a frequency scale) and its major satellite peak 422 in artificially generated asymmetric field conditions. The partial spectrum 450 in the middle shows the situation during the field correction when the voltages of all inverse-leaf electrodes are exactly the same (+1.5 V), i.e. a perfectly symmetric voltage case. The intensities of the second harmonics 421*b* and its satellite 422*b* are already much less. The top spectrum 440*a* shows the two peaks when the field correction is accomplished. The second harmonics 421*a* and its satellite 422*a* are significantly smaller than in the starting spectrum 420*a*.

An interesting point here is that after the accomplished field correction and reducing (e.g., minimizing) the second harmonics and its satellite peak, the final voltage setting is not symmetric either. However, they are differently asymmetric than the initial setting. In other words, the pattern of compensation voltages is not homogeneous over the set of different electrodes.

The unfavorable starting conditions (FIG. 4*b, c*) were due to an artificial asymmetric voltage setting in the cell. These initial voltage values before field correction were: 1.50 V at the electrode pair 57, 59, 1.55 V at the electrode pair 61, 63, 1.50 V at the electrode pair 66, 68, and 1.45 V at the electrode pair 70, 72 (numerals as in FIG. 3*b*). The final voltage values after field correction were: 1.49 V at the electrode pair 57, 59, 1.45 V at the electrode pair 61, 63, 1.51 V at the electrode pair 66, 68, and 1.55 V at the electrode pair 70, 72. Since this setting is providing the smallest second harmonics $2v_R'$, smallest satellite peak $2v_R'+v_M$ and the smallest sidebands of the main peak, it is obviously the preferred way for forming a (virtually) symmetric electric field when the axis coincides (or nearly coincides) with the cell axis.

The experience shows that the correction voltages usually deviate from the previous uncorrected voltage settings between about ±10 and 100 mV, but can also be higher or lower in individual cases.

As regards the afore-mentioned specific embodiments of the invention, it has been observed that the amplitude of the irradiated RF electric field for the excitation of the ion cyclotron motion also influences the shape of the PCD curves. PCD curves with equally high maxima within a magnetron period can start showing low and high maxima if the excitation amplitude is changed, e.g., doubled. Therefore, it is advantageous to perform field correction processes at the excitation amplitudes which will be used in an actual experiment series.

Figure 10A:
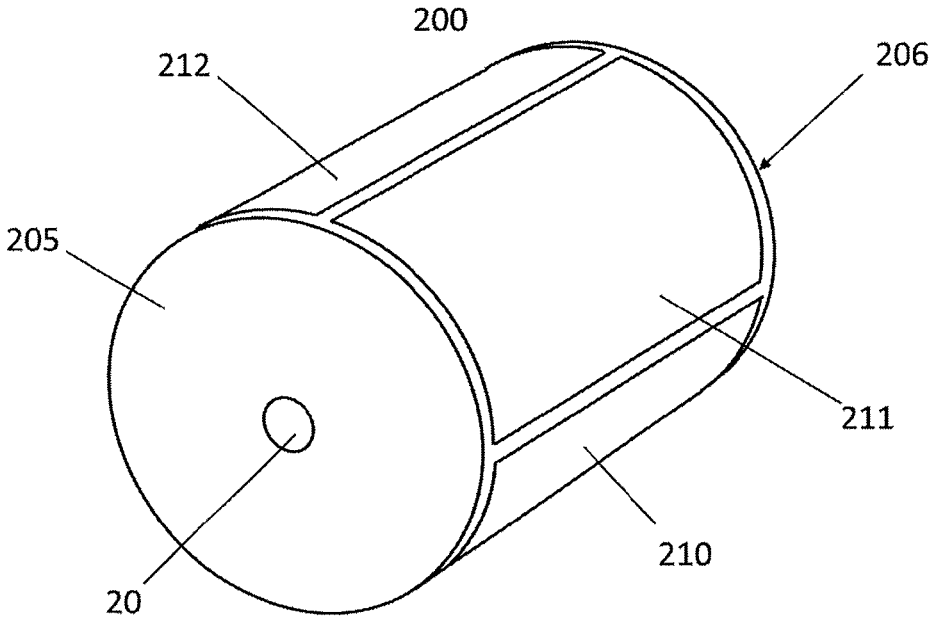
Fig. 10a (Prior Art)
FIG. 10*a* (prior art) shows a conventional cylindrical FT-ICR cell with two excitation and two detection and two end electrodes for axial trapping.

A shift of the electric field axis is not only observed in dynamically harmonized ICR-cells. Also conventional cylindrical ICR-cells, as shown at 200 in FIG. 10*a*, can have a shifted electric field axis. An asymmetrically contaminated trapping electrode in a classical ICR cell, for instance, can cause a slightly asymmetric electric field. Since in the conventional ICR cells no extra longitudinal electrodes exist to which DC voltages are connected, the correction or compensation of the asymmetry is different here. In these cells, according to further embodiments of the invention, the electric field correction can be performed by connecting variable voltages to the excitation electrodes (one of them visible, 211) fowling the first subset and to the detection electrodes 210, 212 forming the second subset of the mantle electrodes. Detection electrodes are usually sensitive and often generate a noisy signal if a DC voltage is applied to them. However, if a battery is used as power source, for example, the noise can be minimized also in this case due its very stable output.

Figure 10B:
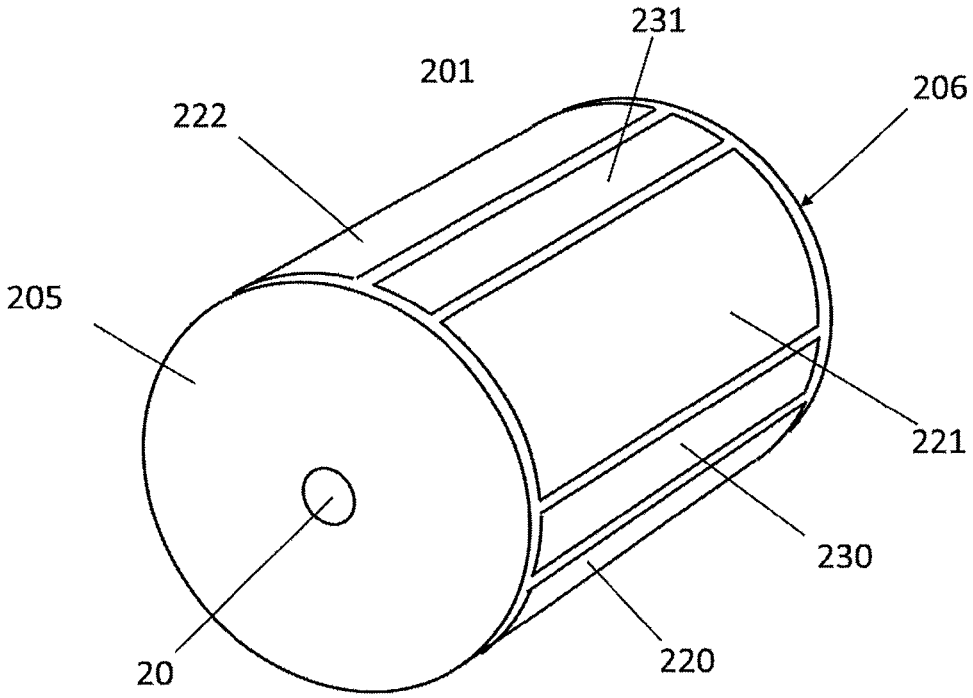
FIG. 10*b* depicts a modified conventional cylindrical cell in which between each excitation and detection electrode of the cylinder mantle a correction electrode is placed.

Another alternative embodiment according to the invention would be to modify a conventional cylindrical ICR cell with additional electrodes that carry the necessary DC voltage for an electric field axis correction. Since most of the voltages used for a successful correction are less than 100 mV, a disturbance of the ICR cell operation would be minimal. The embodiment in FIG. 10*b* shows such a cylindrical cell 201 with a total of four longitudinal correction electrodes (e.g., 230, 231) between excitation electrodes (one of them visible, 221) of a first subset of mantle electrodes and detection electrodes 220, 222 of a second subset of mantle electrodes. Four longitudinal correction electrodes, in this case symmetrically arranged about the cell axis at 90° intervals, can basically move the electric field axis back to the geometric cell axis if the field axis was uniformly shifted in a radial direction. Uniform means here that the general form of the electric field is conserved. It is just shifted in the radial direction but the electric field axis remains essentially parallel to the geometric axis. In this simplest case, the field axis is not bent, rippled or tilted.

In some cases FT-ICR cells with a larger number of excitation (first subset) and/or detection (second subset) electrodes are used. Using multiple pairs of detection electrodes helps acquiring higher resolution FT-ICR spectra. In the cells for these applications also a larger number of correction electrodes can be used. In an FT-ICR cell with four excitation and four detection electrodes, also eight correction electrodes can be placed between each of these FT-ICR mantle (excite and detect) electrodes. Even if the cell is not used for higher frequency detection, excitation and detection electrodes can still be divided longitudinally into two or more parts and a thin longitudinal correction electrode can be placed between each of them.

Figure 10C:
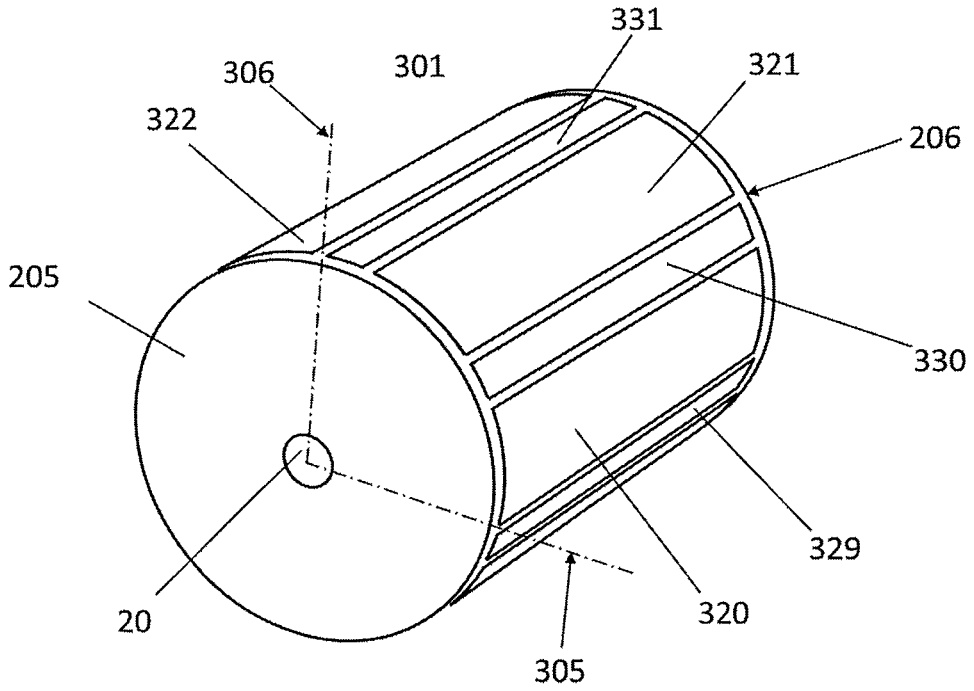
FIG. 10*c* shows a modified cell containing two pairs of excitation electrodes and two pairs of detection electrodes in which between each individual cylinder mantle electrode a correction electrode is placed.

FIG. 10*c* shows as example a cell 301 with eight FT-ICR mantle electrodes with longitudinal correction electrodes (total of eight) placed between each of them. In this figure in a 90° angle between the dashed-dotted lines 305 and 306 an excitation electrode 320, a correction electrode 330, a detection electrode 321, and a second correction electrode 331 are fitted. The electrode 322 is another excitation, and 319 another detection electrode while 329 is again a correction electrode. 205 and 206 are the axial trapping electrodes of the ICR cell.

Unfortunately, sometimes electric field disturbances in the ICR cell appear which are more complicated than just a simple linear shift of the field axis. The reason could be a more complex distribution of the electrode surface charging which not only shows a radial non-uniformity but also an axial one. In this non-linear case a linear axis correction, e.g., using the inverse-leaf electrodes 61, 63 of a dynamically harmonized cell 50 as shown in FIG. 3*b*, cannot be successful, as these longitudinal electrodes are parallel to the cell axis. Using these electrodes only a radial field correction can be made, but not an axial one.

Figure 11:
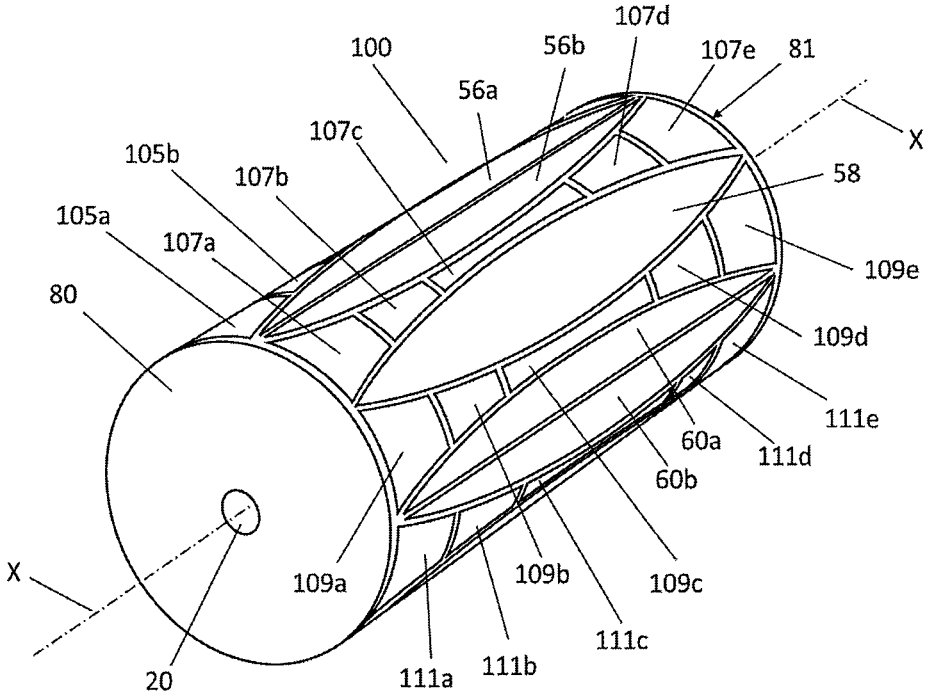
FIG. 11 depicts a dynamically harmonized ICR cell modified according to an embodiment of the present invention by dividing each inverse-leaf electrode into five segments using transverse cuts in order to be able to also correct axial components of the electric field disturbances.

In order to also correct field errors with axial components, the use of segmented (correction) electrodes in the ICR cell is suggested. Segmented electrodes can also be used to correct the electric field, if the field axis is perturbed non-uniformly, such as by bending, rippling or tilting. A bent, rippled or tilted electric field axis is formed, for instance, if at different axial positions the center of the electric field is radially shifted by different amounts. In a dynamically harmonized cell 50 as shown in FIGS. 3*a*-3*b* the inverse-leaf shaped electrodes (e.g., 57) can be segmented by transverse cuts. FIG. 11 shows, according to another embodiment of the invention, a modified dynamically harmonized cell 100 in which the inverse-leaf shaped cylinder mantle electrodes are divided by transverse cuts. Divided inverse-leaf electrodes visible in this figure have the partial electrodes 107*a*, 107*b*, 107*c*, 107*d*, 107*e*, and 109*a*, 109*b*, 109*c*, 109*d*, 109*e*, as well as 111*a*, 111*b*, 111*c*, 111*d*, 111*e*. Only two partial electrodes 105*a*, 105*b* are visible from a further inverse-leaf electrode group 105*a*-105*e*. Each of these partial electrodes can be supplied with an independent and variable DC voltage. The configuration depicted in FIG. 11 is one of the possible embodiments and contains inverse-leaf electrodes divided in five parts. Inverse-leaf electrodes consisting of more parts can be made. In this configuration leaf electrodes (e.g., 58) as well as the half-leaf electrodes (e.g., 56*a*, 56*b*) remain unchanged as in the original version of the dynamically harmonized cell 50 in FIG. 3*a*.

Figure 12:
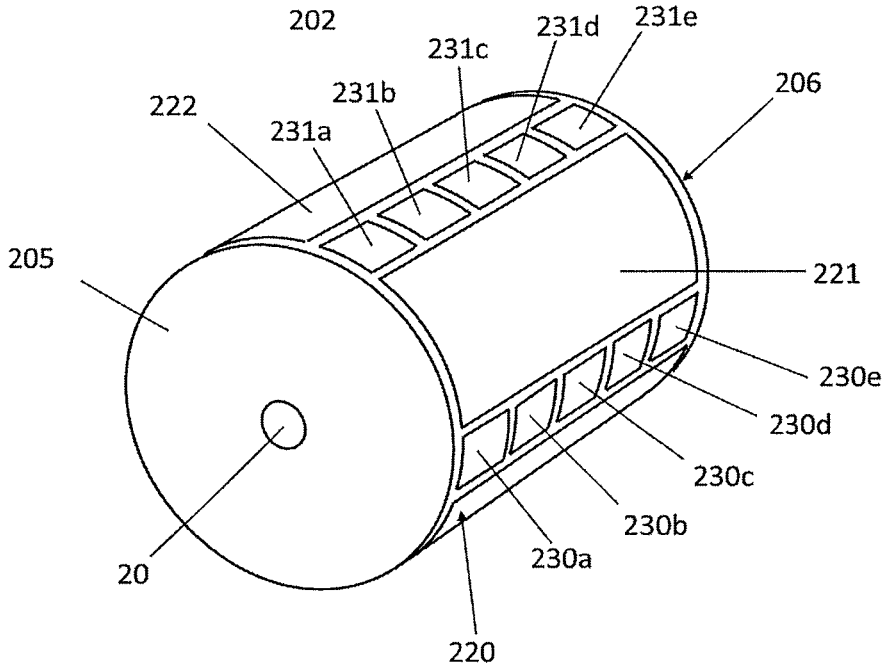
FIG. 12 shows a modified cylindrical cell according to an embodiment of the present invention in which correction electrodes between the excitation and detection electrodes are divided each into five segments by transverse cuts in order to be able to also correct axial components of the electric field disturbances.

In order to correct non-linear field distortions in a modified cylindrical ICR cell 201 as shown in FIG. 10*b* this can be further modified by dividing the correction electrodes 230, 231. Such a further modified cell 202 is shown in FIG. 12 as another embodiment according to the invention. Axial distortion components of an asymmetric electric field can be compensated using these correction electrodes which are in this particular embodiment divided into five segments 230*a*, 230*b*, 230*c*, 230*d*, 230*e* and 231*a*, 231*b*, 231*c*, 231*d*, 231*e*. To each segment of the divided correction electrodes an independently variable DC voltage can be connected. The number of electrode segments is not limited to the number five, as in this embodiment, but can be varied.

Figure 13:
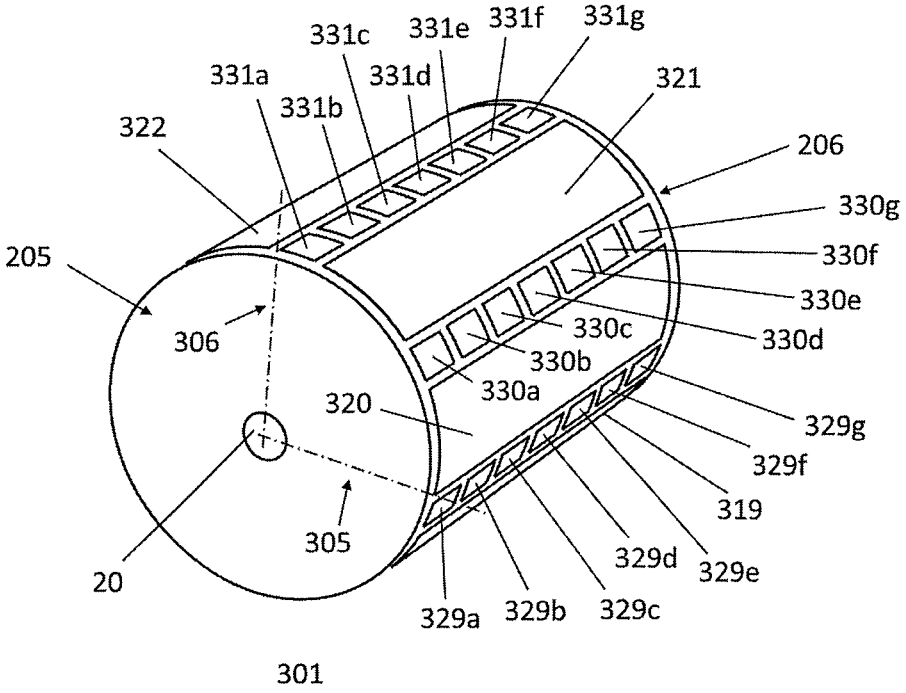
FIG. 13 shows a modified cylindrical cell according to an embodiment of the present invention in which correction electrodes between eight straight mantle electrodes are divided into seven segments each by transverse cuts, again in order to be able to correct axial components of the electric field disturbances.
Figure 14A:
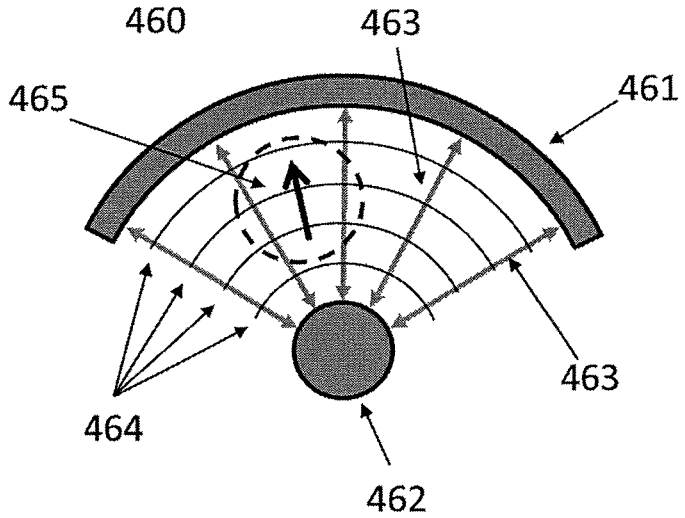
FIG. 14*a* shows the inhomogeneous oscillating (RF) electric field in form of a sector of a circle. An ion moves in direction of the arrow if it is exposed to this inhomogeneous field. As a comparison.
Figure 14B:
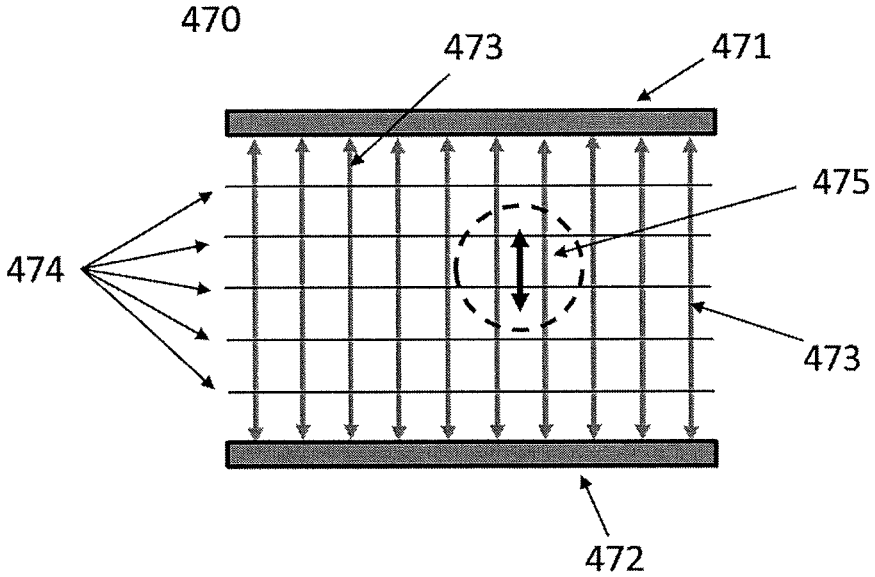
FIG. 14*b* shows a setting with two (infinite) plane-parallel flat electrodes.
Figure 15:
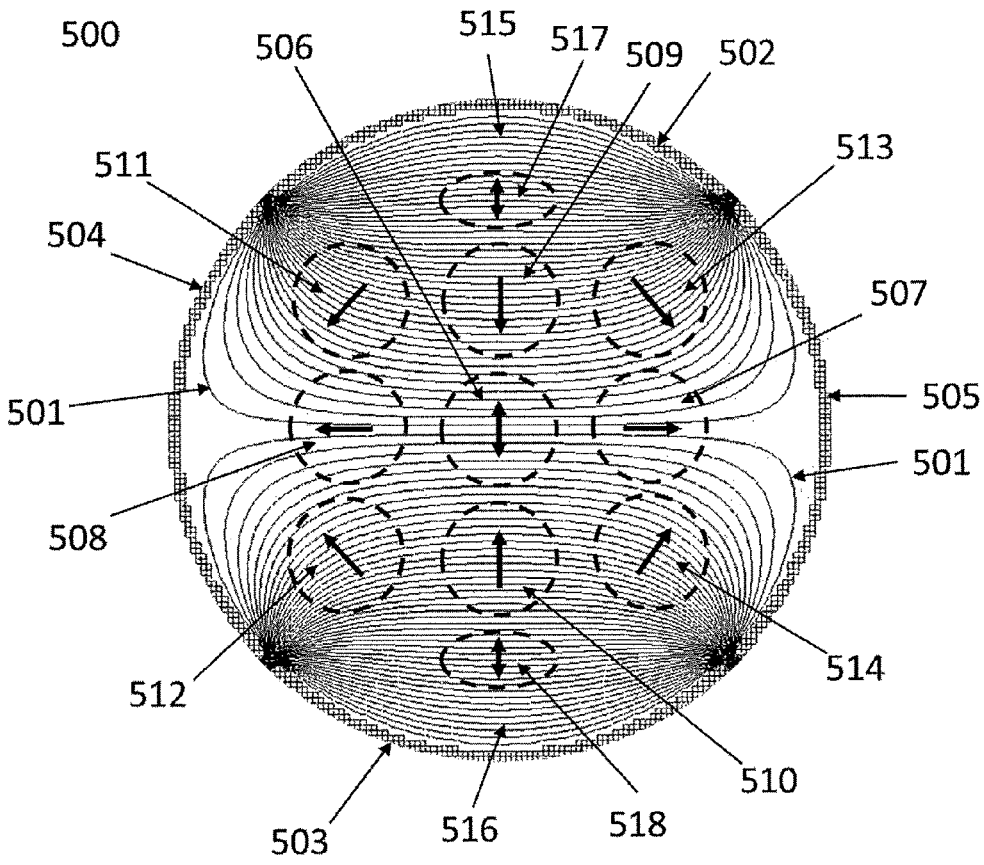
FIG. 15 shows, in a cross section view of an FT-ICR cell with four 90° cylinder mantle electrodes, the equipotential lines of the RF excitation field in a momentary view. Here, the excitation electrodes (first subset) are at the top and at the bottom, the detection electrodes (second subset) are on both sides. When the ions are cyclotron-excited in the areas indicated with dashed circles they drift in direction of the arrows. The double sided arrows are in the areas where no drift occurs during the cyclotron excitation.
Figure 16A:
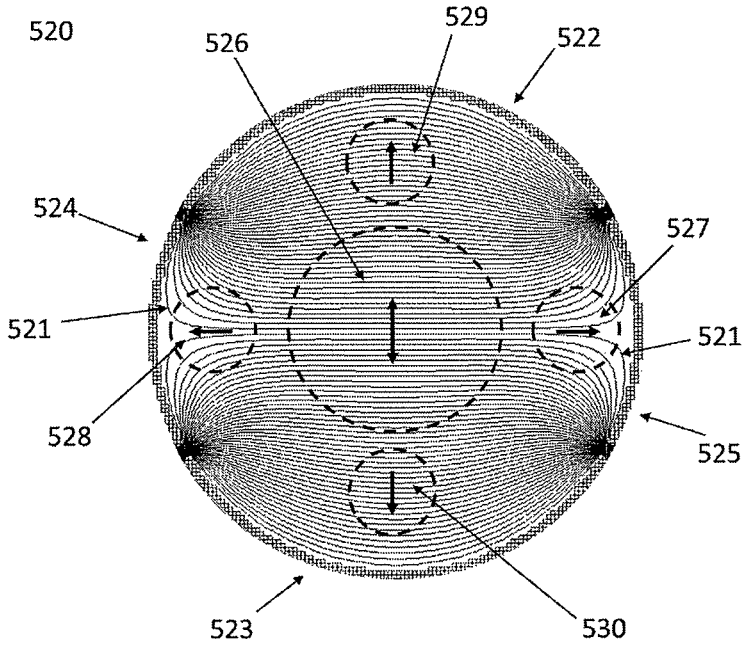
FIG. 16*a* shows a cross section view of an FT-ICR cell with two 120° and two 60° cylinder mantle electrodes. Equipotential lines of the RF excitation field are shown (momentary view) when the 120° electrodes at the top and at the bottom are used as excitation electrodes (first subset of mantle electrodes).
Figure 16B:
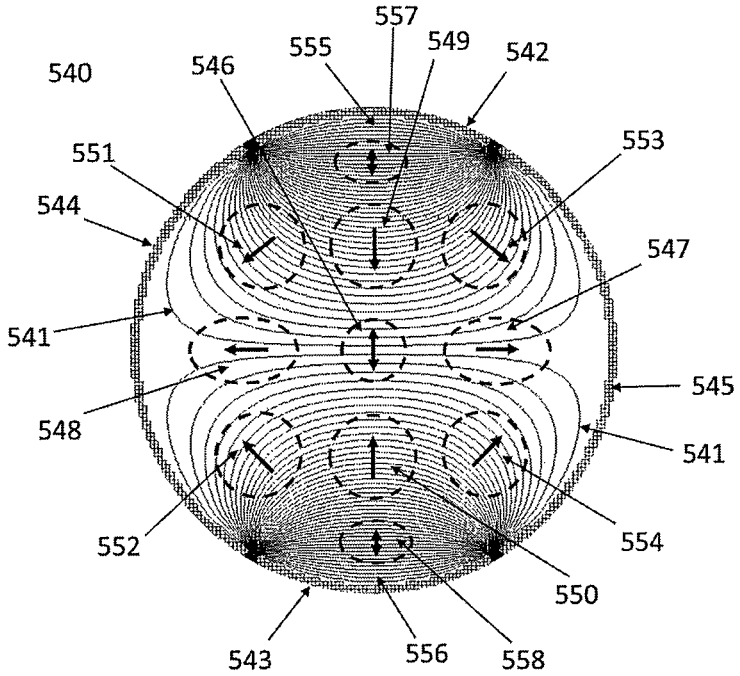
FIG. 16*b* shows a cross section view of an FT-ICR cell with two 120° and two 60° cylinder mantle electrodes. Equipotential lines of the RF excitation field are shown (momentary view) when the 60° electrodes at the top and at the bottom are used as excitation electrodes (first subset of mantle electrodes).

FIG. 13 shows as an example a cylindrical ion cyclotron resonance cell 301 with two pairs of excitation electrodes (first subset) and two pairs of detection electrodes (second subset) and longitudinal correction electrodes (total of eight) placed between each of them. Each correction electrode in this figure is divided into seven segments. The excitation electrode 320, a segmented correction electrode with the segments 330*a*, 330*b*, 330*c*, 330*d*, 330*e*, 330*f*, 330*g*, a detection electrode 321 and a second segmented correction electrode with the segments 331*a*, 331*b*, 331*c*, 331*d*, 331*e*, 331*f*, 331*g* are fitted within a 90° angle between the dashed-dotted lines 305, 306. Electrode 322 is another excitation electrode and electrode 319 another detection electrode, while the electrode divided in segments 329*a*, 329*b*, 329*c*, 329*d*, 329*e*, 329*f*, 329*g* is again a correction electrode.

The process of the asymmetry correction of the electric field can be performed beginning with standard voltage settings at the (correction) electrodes. Initially, an FT-ICR spectrum is acquired and one of the major peaks of interest is chosen as the object of the optimization. In various embodiments, further FT-ICR spectra are then acquired under varied post capture delay times until a PCD-diagram for the relative intensity of the satellite peak of an even-numbered harmonics with the frequency of $nv_R \pm mv_M$, such as $2v_R \pm 1v_M$, for over at least two periods of the magnetron motion is completed. It is to be mentioned here that the chosen ion does not have to be isolated for the iteration. Measurements can proceed with all available ions within the ICR cell. The PCD curve shows maxima and minima. A delay time in the PCD diagram at or near a maximum of the curve is selected. Keeping this PCD time, now all (correction) electrode voltages are varied in a multidimensional search in order to find an optimum voltage combination that leads to a common minimum of the relative intensities of the even-numbered harmonics with the frequency $nv_R$ and its satellite peak with the frequency $nv_R \pm mv_M$, such as n=2: the second harmonics and m=1: the closest satellite peak. After finding this local common minimum, the obtained voltage values corresponding to this minimum are used and the post capture delay time is varied again, a partial or complete PCD curve is acquired. Then it is checked if the relative intensities of the even-numbered harmonics and the satellite peak at the maxima of the curve are reduced below the values obtained with the previous voltage setting. If they are not reduced in this PCD diagram, one has to go back and pick another point near a maximum at the initial PCD curve and start over again. If the relative intensities of the even-numbered harmonics and the satellite peak at the maxima of the curve are reduced, one starts with another iteration at the new curve's maximum. Again here, a maximum of this PCD curve is selected and the variation of the voltages for a multidimensional search is repeated and optimized again. These iterations are repeated until the global common minimum of the two peaks is found, i.e. the even-numbered harmonics with the frequency $nv_R$ and its satellite peak with the frequency e.g. $nv_R+mv_M$.

The process of the asymmetry correction of the electric field can be automated. A computer program can be used with an algorithm that begins with standard voltage settings at the (correction) electrodes. It acquires FT-ICR spectra and selects one of the major peaks of interest. In various embodiments, the post capture delay time is varied, FT-ICR spectra are again acquired until it completes a PCD-diagram for the relative intensity of the satellite peak of an even-numbered harmonics with the frequency of $nv_R \pm mv_M$, e.g., n=2 and m=1, for over at least two periods of the magnetron motion. The PCD curve shows maxima and minima The algorithm selects a delay time in the PCD diagram at or near a maximum of the curve. Keeping this PCD time, it now varies all (correction) electrode voltages in a multidimensional search to find an optimum voltage combination that leads to a common minimum of the relative intensities of the even-numbered harmonics with the frequency $nv_R$ and its satellite peak with the frequency $nv_R \pm mv_M$. After finding this local common minimum it uses the obtained voltage values corresponding to this minimum, goes back and varies the post capture delay time, acquires a complete PCD curve, and checks if the relative intensities of the even-numbered harmonics and the satellite peak at the maxima of the curve are reduced below the values obtained with the previous voltage setting. If they are not reduced in this PCD diagram, the program goes back and picks another point near a maximum in the initial PCD curve and starts over again. If the relative intensities of the even-numbered harmonics and the satellite peak at the maxima of the curve are reduced, the program starts another loop at the new curve's maximum. The program again selects a maximum of this PCD curve and repeats the variation of the voltages for a multidimensional search and the optimization again. It repeats these iterative loops until it finds the global common minimum of the two peaks, i.e. the even-numbered harmonics with the frequency $nv_R$ and its satellite peak with the frequency e.g., $nv_R \pm mv_M$.

A slightly different method of the optimization, preferably performed in an automated manner, would be the following: the program acquires FT-ICR spectra, selects one of the major peaks of interest and checks the intensities of an even-numbered harmonics $nv_R$ and the satellite peaks $nv_R \pm mv_M$ of the even-numbered harmonics therein in dependence of the compensation voltages. By independently varying the compensation voltages of all available (correction) electrodes the algorithm performs a multidimensional search for a common minimum of these two peaks. After finding the voltages for obtaining minimal peaks, the algorithm goes back and changes now the post capture delay time, then repeats the multidimensional voltage search again and finds the common minimum of the peaks now in dependence of this new delay time, and so on. These iterative loops continue until the global common minimum of the two peaks, i.e., the even-numbered harmonics with the frequency $nv_R$ and its satellite peak with the frequency $nv_R \pm mv_M$ is found.

In complex cases where also axial components of the distorted electric field need to be compensated, the correction algorithm will include the voltage values of the individual segments (created by the transverse cuts) of the corresponding electrodes.

Such an optimization program can always be applied, if an electric field asymmetry is suspected. Automated runs can also be implemented for diagnostic purposes. In various embodiments, the program would acquire in periodic times a post capture delay curve just for testing the size (or diameter) and the symmetry of the magnetron motion and deriving the conclusion about the position of the axis of the electric field in the ICR cell.

Figure 20A:
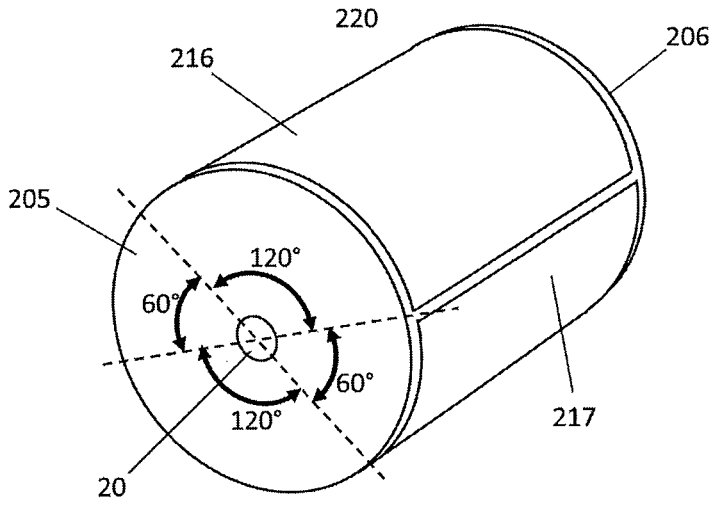
FIG. 20*a* shows a cylindrical FT-ICR cell with two 120° and two 60° mantle electrodes (individual electrodes).
Figure 20B:
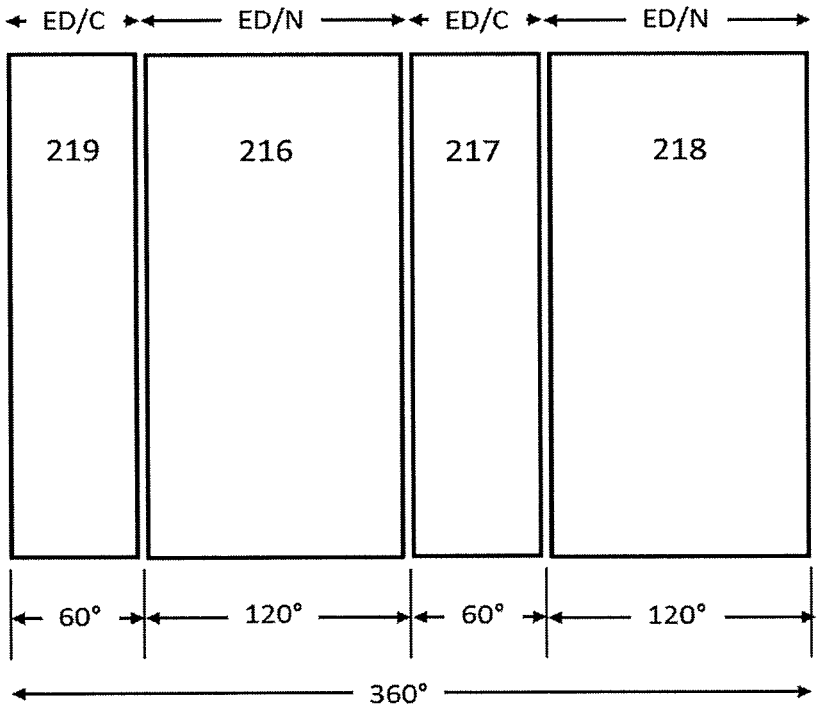
FIG. 20*b* depicts the mantle electrodes of this cell in an unwound configuration.

FIG. 20*a* shows another embodiment having a cylindrical FT-ICR cell with two 120° and two 60° cylinder mantle electrodes (individual electrodes). Only one of the 120° mantle electrodes 216 and one of the 60° mantle electrodes 217 are visible in this figure. FIG. 20*b* shows the cylinder mantle of this cell in the unwound configuration. Both of the 120° electrodes 216, 218 and both of the 60° electrodes are visible here. Additional DC voltages on at least one, preferably all, of the excitation and detection electrodes of this 120°/60° segmented cylindrical ICR cell are used to correct and shift back the axis of the radial electric field to coincide with the geometric axis of the ICR cell. To avoid electrical noise, batteries but also voltage generators providing very stable (but tunable) DC voltages can be used to generate the correction voltages.

As described above, the 120° detection does not show the harmonic peaks with the aid of which the field correction is normally carried out. Therefore, for the field correction the detection is preferably performed using the 60° electrodes (second subset). Furthermore the cyclotron excitation using the 120° electrodes generates a considerably large volume of homogeneous excitation field in which the ions do not show a radial drift during a cyclotron excitation process. This means the magnetron radii will mostly not be excited or de-excited during a cyclotron excitation. Thus, the excitation using the 120° electrodes does not show magnetron phase dependent oscillating behavior of the satellite peaks of the even-numbered harmonics, e.g., the peaks with the frequency of $2v_R+v_M$. For specific embodiments of the invention, a useful PCD curve cannot be recorded in this case. Therefore, for the electric field asymmetry corrections the 60° mantle electrodes are preferably used for excitation as well as for detection (first as well as second subset of mantle electrodes).

Figure 17A:
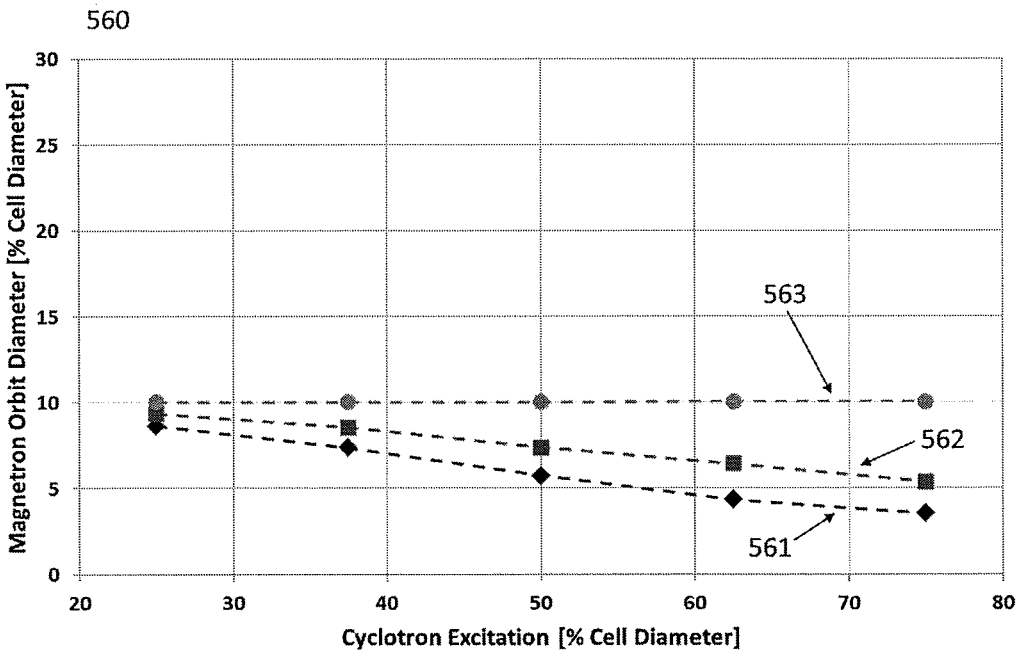
FIG. 17*a* shows a diagram displaying the simulated magnetron orbit diameter change (=magnitude of ion drift) when excited at a magnetron orbit diameter of 10% of the cell diameter in the quadrant of an excitation electrode.
Figure 17B:
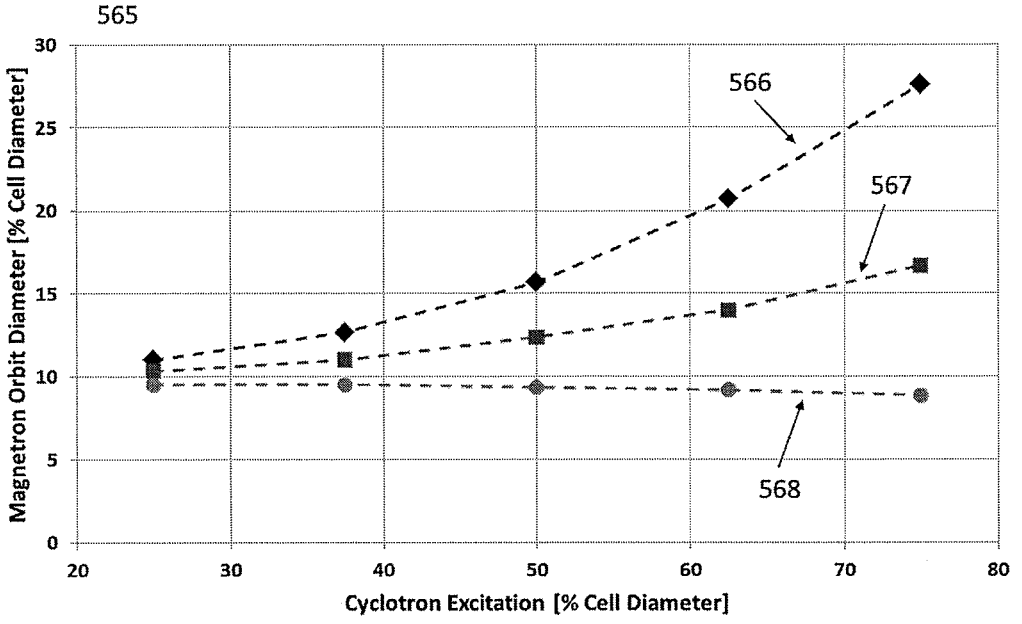
FIG. 17*b* shows a diagram displaying the simulated magnetron orbit diameter change (=magnitude of ion drift) when excited at a magnetron orbit diameter of 10% of the cell diameter in the quadrant of a detection electrode. In both of the diagrams the excitation is simulated for 60°, 90° and 120° excitation electrodes (first subset of mantle electrodes).
Figure 17C:
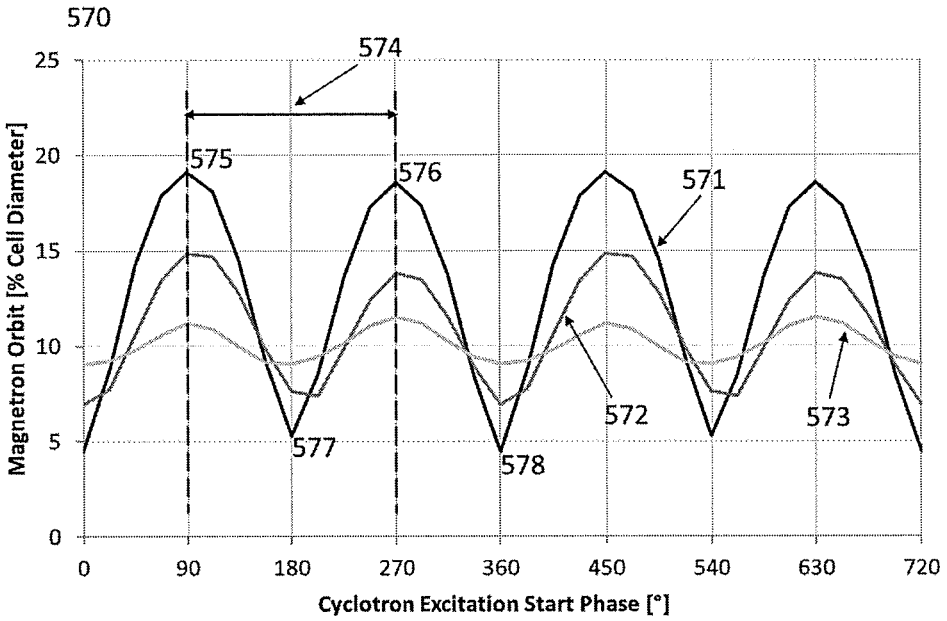
FIG. 17*c* shows a diagram displaying simulated PCD curves.
Figure 18A:
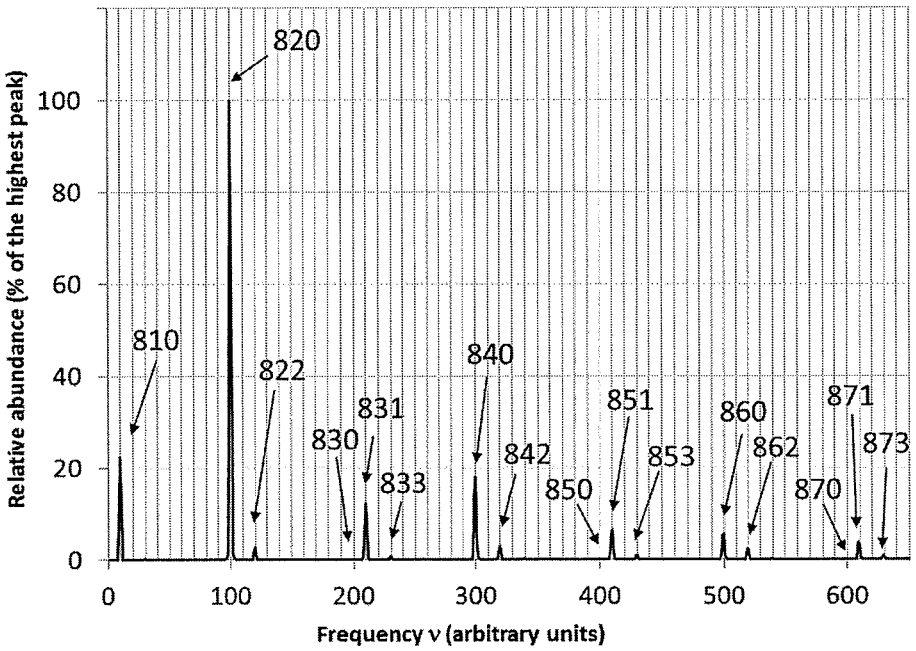
Figure 18B:
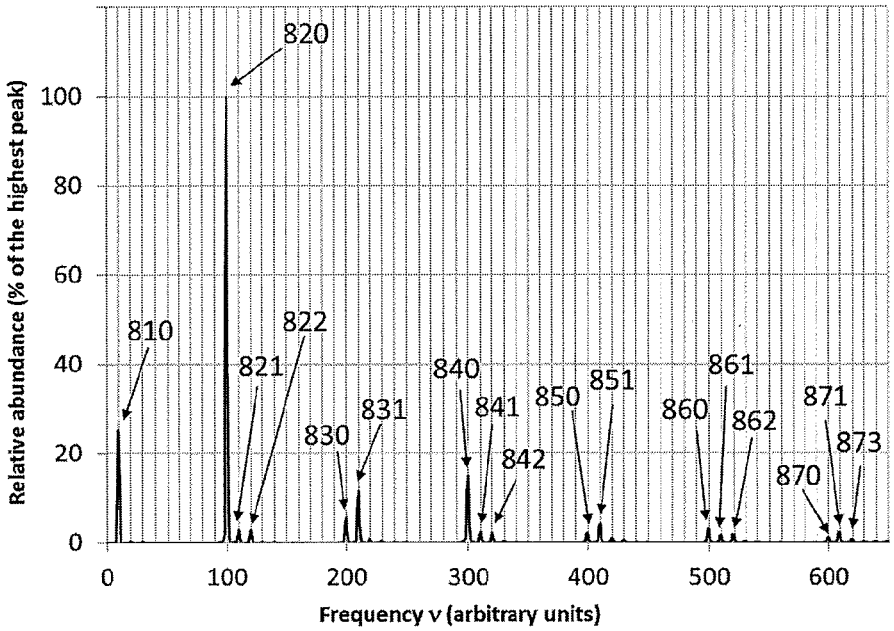
Figure 18C:
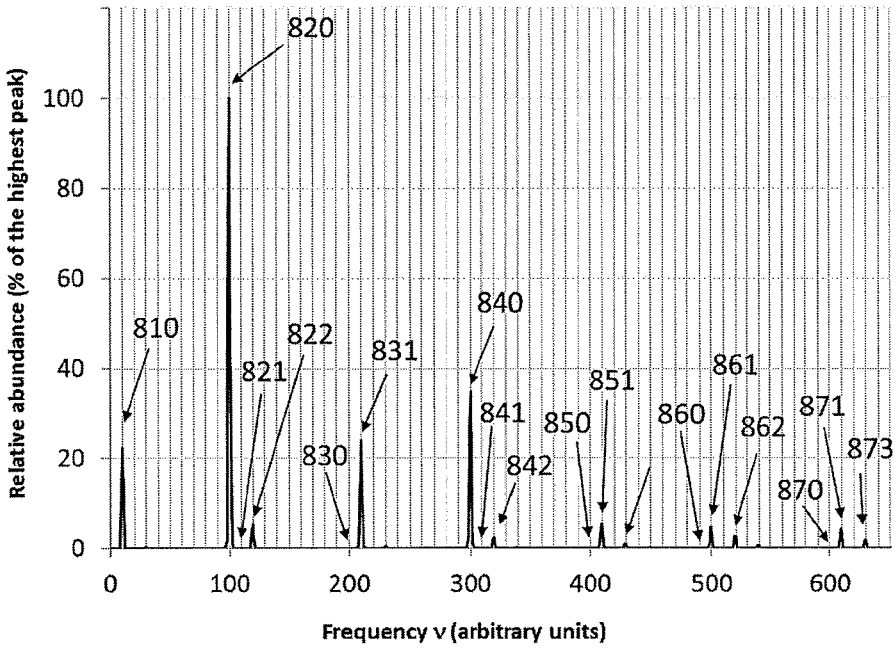
Figure 18D:
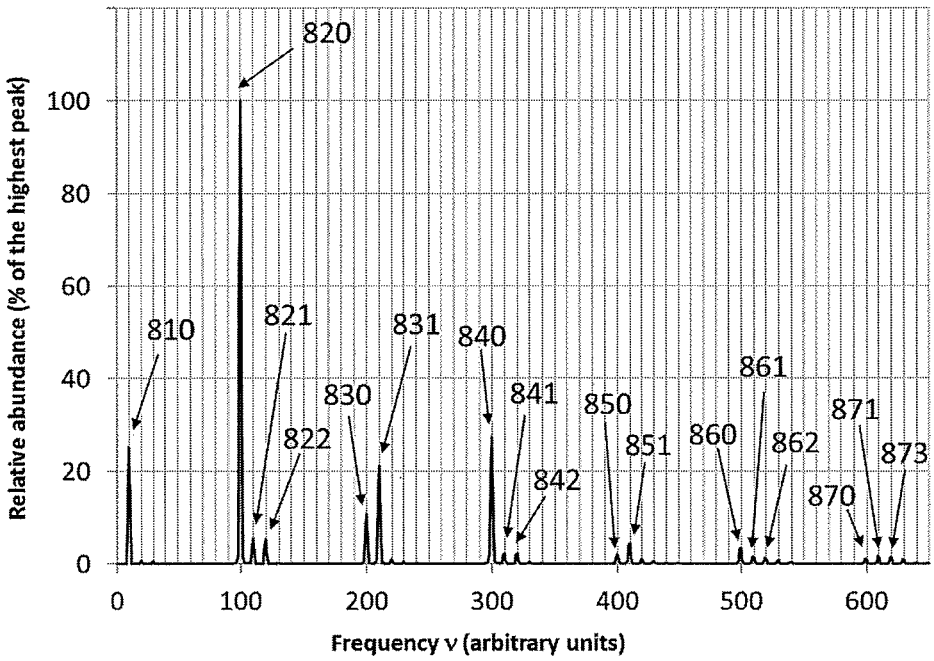
Figure 18E:
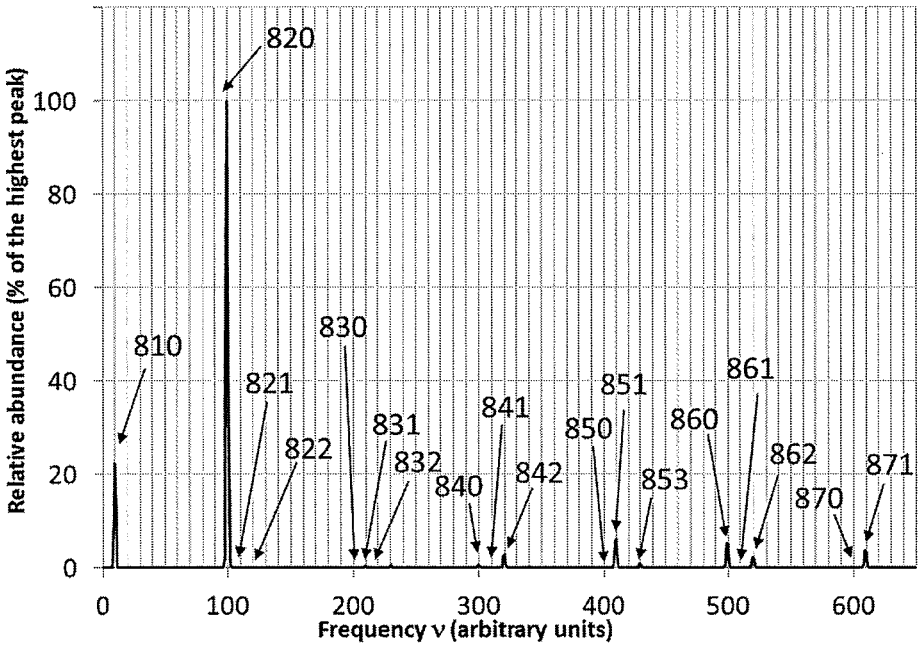

As the FIGS. 17*a-b* show that the largest drift of an ion during the cyclotron excitation occurs when 60° electrodes are used for excitation (first subset). This means for specific embodiments of the invention that the PCD curves with largest amplitudes appear when 60° electrodes are used (shown in FIG. 17*c*), which allows the best correction possibility, and, in particular embodiments, to find the post capture delay for the magnetron minimum. The ED/C notation above the 60° electrodes of the unwound mantle electrodes in FIG. 20*b* means that these electrodes can be most advantageously used for excitation and detection during the field correction operation, which requires an electrical switching between these two modes. After the correction, the FT-ICR cell is preferably driven in 120° excitation and 120° detection mode for high performance mass spectrometric operation. The ED/N notation above the 120° electrodes of the unwound mantle electrodes in FIG. 20*b* means that these are most advantageously used for excitation and detection in the normal operation of the cell, likewise requiring the capability to electrically switch.

Figure 21A:
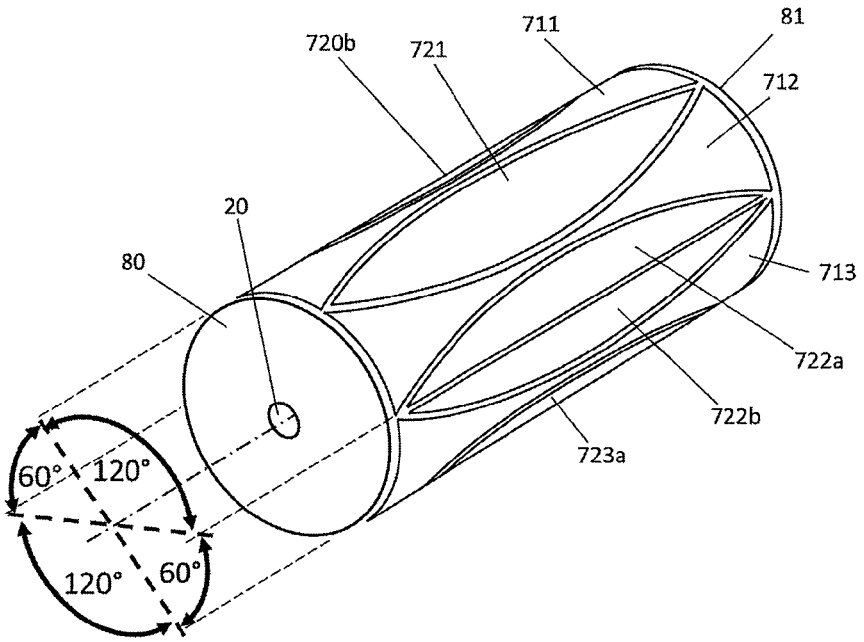
FIG. 21*a* depicts a dynamically harmonized FT-ICR cell with two 120° and two 60° (individual) electrode groups. This cell has six leaf and six inverse-leaf electrodes. Four of the leaf electrodes are split into two halves.
Figure 21B:
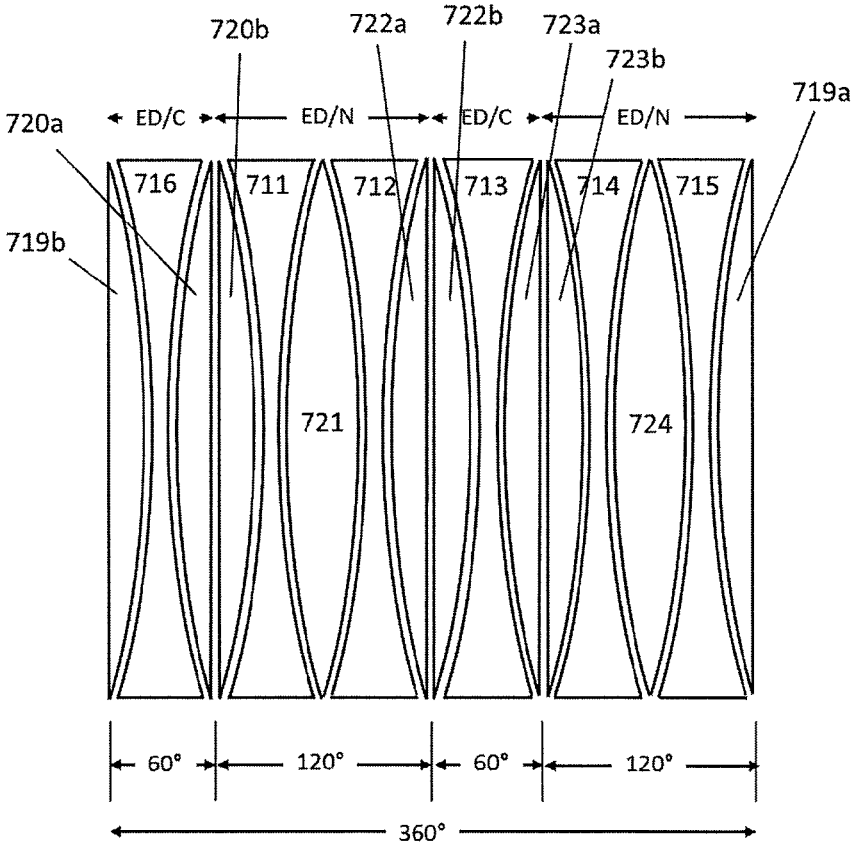
FIG. 21*b* depicts the mantle electrodes of this cell in an unwound configuration.

Similar to the FT-ICR cell with integral 120°/60° cylinder mantle electrodes described above, a dynamically harmonized cell can be designed with 120°/60° electrode groups, like the cylinder mantle segments of the conventional cell. FIG. 21*a* depicts such a dynamically harmonized cell with six leaf-shaped electrodes and six inverse-leaf shaped electrodes. FIG. 21*b* depicts the cylinder mantle unwound. Four of the six leaf electrodes are divided into two halves in order to form the 120° and 60° group segments. These split leaf electrodes are 719*a*, 719*b*, 720*a*, 720*b*, 722*a*, 722*b*, and 723*a*, 723*b*. The remaining two leaf electrodes 721, 724 are not split but remain integral. The inverse-leaf electrodes are 711, 712, 713, 714, 715, 716. The end electrodes 80, 81 are in the same configuration as in the regular dynamically harmonized cell with four 90° cylinder mantle sections and eight leaf electrodes as shown in FIG. 3*b*.

During the normal operation of this dynamically harmonized cell the two 120° electrode groups 720*b*, 711, 721, 712, 722*a* and 723*b*, 714, 724, 715, 719*a* may be used for excitation (first subset of mantle electrodes). The ED/N notation above the 120° electrode group of the unwound mantle electrodes in FIG. 21*b* means that these are preferably used for excitation and detection in the normal analytical operation of the cell, which requires an electrical switching between these two modes. For detection, the (half) leaf electrodes 720*b*, 721, 722*a* and 723*b*, 724, 719*a* in the same 120° electrode groups are preferred. The inverse-leaf electrodes that carry DC voltages are normally avoided to be used as detection electrodes as they normally introduce noise to the detected signal. If one uses a battery as a DC voltage source, or voltage generators with very stable output, this would not be a problem and all five electrodes in a 120° detection segment can be used.

During the electric field correction, for the same reasons described above, it is preferred to use the 60° mantle electrode groups for excitation as well as for the detection, which likewise requires the capability to electrically switch. These electrodes are the group 719*b*, 716, 720*a*, and the group 722*b*, 713, 723*a*. These 60° mantle electrode groups consist of two half-leaf electrodes and one inverse-leaf one. The ED/C notation above the 60° electrode group of the unwound mantle electrodes in FIG. 21*b* reflects this point.

Figure 22A:
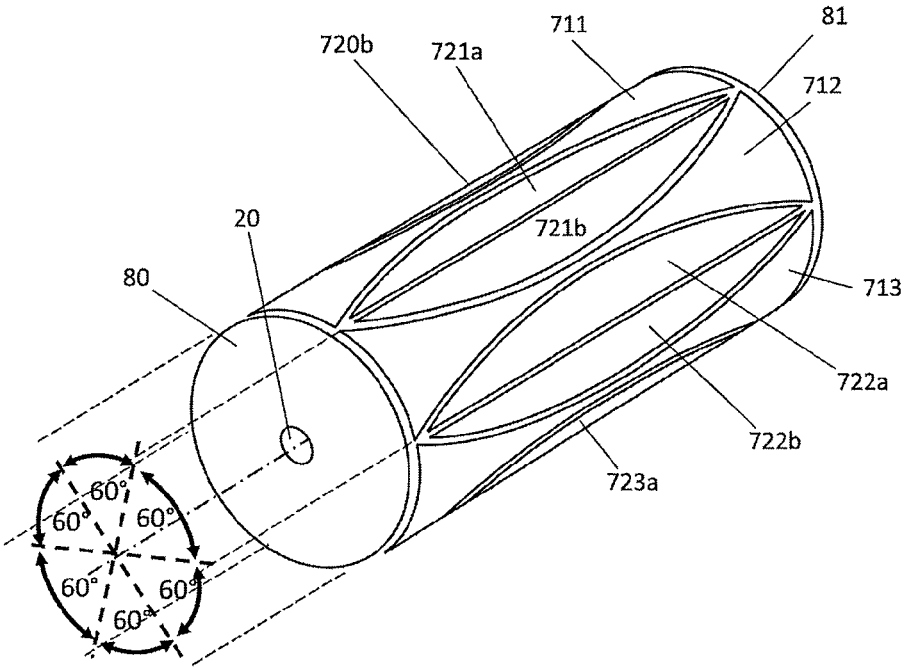
FIG. 22*a* shows an alternative dynamically harmonized FT-ICR cell with six 60° (individual) electrode groups, where all leaf electrodes are split.
Figure 22B:
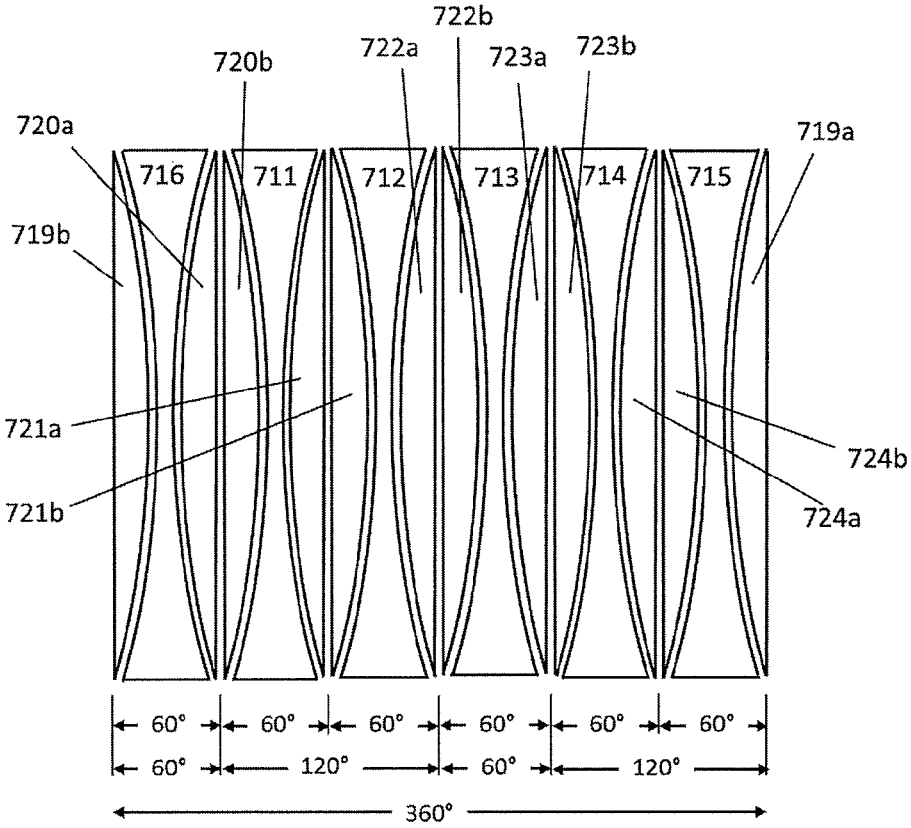
FIG. 22*b* depicts the mantle electrodes of this cell in an unwound configuration.

FIGS. 22*a-b* show a different version of the dynamically harmonized cell with six leaf electrodes. This cell is so far the same as the cell in FIG. 21*a*, except that here all of the leaf electrodes are split in half. FIG. 22*a* shows a perspective view of this cell with the end electrodes 80, 81, and split leaf electrodes that are visible in this figure 720*a*, 720*b*, 721*a*, 721*b*, and 722*a*, 722*b*. Not all of the cylinder mantle electrodes are visible in FIG. 22*a*. As a difference to FIG. 21*a* the leaf electrodes 721, 724 for the FIG. 22*a* became here split leaf electrodes 721*a*, 721*b*, and 724*a*, 724*b*. Having six 60° sections of the mantle electrode groups gives a larger freedom to operate as all six electrode groups can be used as excitation and detection electrodes (first as well as second subset of mantle electrode).

The electric field correction action by using pairs of inverse-leaf electrodes in a dynamically harmonized cell with eight leaf and eight inverse-leaf electrodes is described as a possible embodiment in the afore-mentioned U.S. patent application Ser. No. 13/767,595. Four pairs of adjacent inverse-leaf electrodes (FIG. 3: 55, 57; 59, 61; 63, 65; 67, 69) provide the control over two orthogonal dimensions which are perpendicular to the cell axis X.

The electric field correction action by using pairs of inverse-leaf electrodes in a dynamically harmonized cell with six leaf and six inverse-leaf electrodes is performed by using two pairs of adjacent inverse-leaf electrodes (711, 712, and 714, 715 in FIGS. 21*a*-21*b*). Electrodes 711, 712 and the remaining two single inverse-leaf electrodes (713, 716 in FIGS. 21*a-b*) provide the control over two orthogonal dimensions which are perpendicular to the cell axis X.

In an ICR cell with multi segment electrodes, the division of the cell mantle electrodes may allow the excitation and detection at different electrodes during a regular mass spectrometric operation. The excitation can for instance be performed using 120° electrode groups and the detection using 90° electrode groups, where some of the electrodes in the electrode groups need to be switched from excitation mode to detection mode.

Figure 23A:
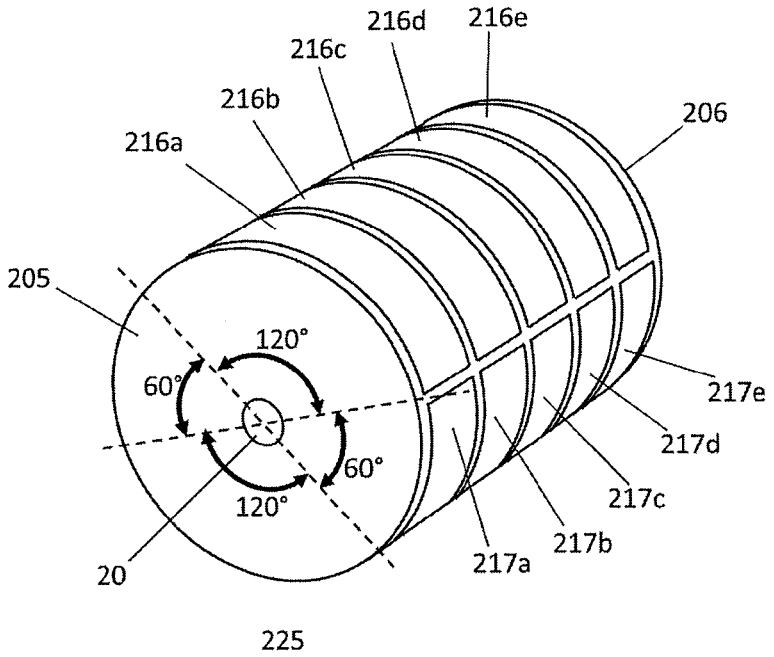
FIG. 23*a* shows a cylindrical ICR cell with two 120° and two 60° mantle electrodes (individual electrode groups) which are divided into five segments by transverse cuts.

FIG. 23*a* depicts a cylindrical ICR cell with two 120° and two 60° mantle electrodes which are segmented by transversal cuts. In this particular example each mantle electrode consists of five segments. Each segment can be driven with individual voltage sources as to supply them with individually tunable DC voltages. The segmentation allows a correction of the nonlinear asymmetric electric field along the cell axis. The unsegmented version is only successful in correcting shifted linear field axes, while the segmented electrodes being supplied with individually controllable voltages can be used for the correction of tilted and/or rippled and/or bent electric field axes. One of the 120° mantle electrode groups includes the five segments 216*a-e*, the other 120° mantle electrode group, which is not visible in the figure, has the segments 218*a-e*. One of the 60° mantle electrode groups includes the five segments 217*a-e*, the other one, which is not visible in the figure, includes the segments 219*a-e*. One of the trapping electrodes 205 is at the front end with the ion entrance hole 20 and the other one 206 at the back end of the cell.

Figure 23B:
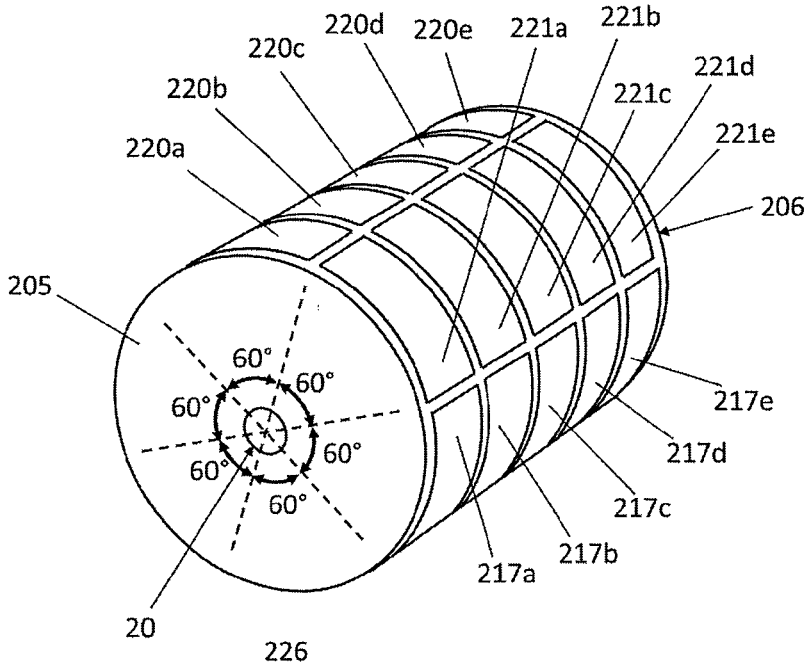
FIG. 23*b* shows a cylindrical ICR cell with six 60° mantle electrodes (individual electrode groups) which are divided into five segments by transverse cuts.

FIG. 23*b* shows a cylindrical ICR cell with six 60° mantle electrodes which are segmented by transversal cuts. In this particular example each mantle electrode includes five segments. Each segment can be driven with individual voltage sources as to supply them with individually tunable DC voltages. The segmentation allows a correction of the nonlinear asymmetric electric field along the cell axis. The unsegmented version is only successful in correcting shifted linear field axes, while the segmented electrodes being supplied with individually controllable voltages can be used for the correction of tilted and/or rippled and/or bent electric field axes. One of the 60° mantle electrode groups visible includes the five segments 220*a-e*, the next one 221*a-e*, and the next one includes the segments 217*a-e*. The three 60° electrode groups which are not visible in the figure are 221*a-e*, 222*a-e* and 219*a-e*. One of the trapping electrodes 205 is at the front end with the ion entrance hole 20 and the other one 206 at the back end of the cell.

Figure 24:
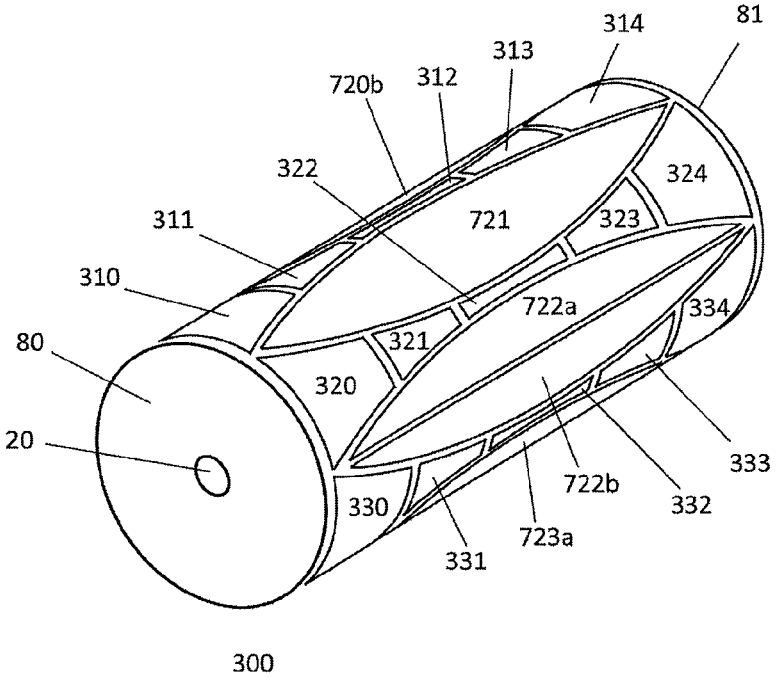
FIG. 24 depicts the dynamically harmonized FT-ICR cell with two 120° and two 60° electrode groups from FIG. 21. This cell has six leaf and six inverse-leaf electrodes. Four of the leaf electrodes are split into two halves with a longitudinal cut and the inverse-leaf electrodes are divided into five segments by transverse cuts.

FIG. 24 depicts a special version of the dynamically harmonized FT-ICR cell with two 120° and two 60° electrode groups and with segmented inverse-leaf electrodes. The segmentation of these electrodes allows for a correction of the nonlinear asymmetric electric field along the cell axis. The unsegmented version can only be used to correct the shifted linear field axes, while the segmented inverse-leaf electrodes being supplied with individually controllable voltages can be used for the correction of tilted and/or rippled and/or bent electric field axes. This cell has two full leaf electrodes which are 721, 724 (the latter not visible in the figure), and four other leaf electrodes that are split into two halves with a longitudinal cut which are 720*a* (not visible in the figure) and 720*b*, 722*a*, 722*b*, 723*a*, 723*b* (the latter two not visible in the figure), 725*a* (not visible in the figure), 725*b* (not visible in the figure). Also this cell has six inverse-leaf electrodes all of which are segmented by four transversal cuts in five parts which are 310-314, 320-324, 330-334, 340-344, and 350-354.

Figure 25:
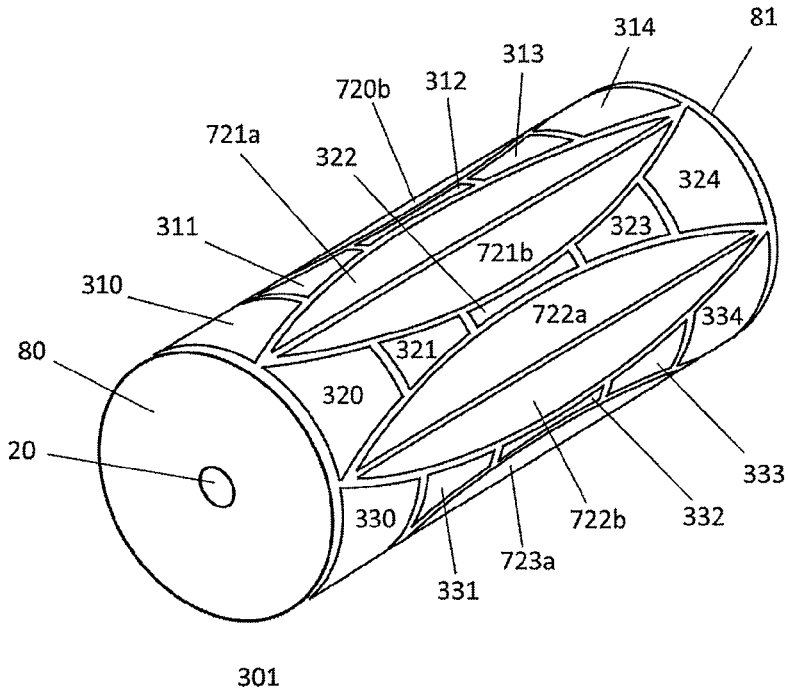
FIG. 25 depicts the alternative dynamically harmonized FT-ICR cell design from FIG. 22 with six 60° electrode groups as a special design with segmented inverse-leaf electrodes. As the FIG. 22 already showed, all leaf electrodes of this cell are split into two halves with a longitudinal cut.

FIG. 25 depicts a special version of the dynamically harmonized FT-ICR cell with six 60° electrode groups and with segmented inverse-leaf electrodes. The purpose of the inverse-leaf electrodes is to correct nonlinear asymmetric electric fields along the cell axis. While the unsegmented version can only be used to correct the shifted linear field axes, the segmented inverse-leaf electrodes being supplied with individually controllable voltages can be used for the correction of tilted and/or rippled electric field axes. All six leaf electrodes of this cell are split which are 720*a* (not visible in the figure) 720*b*, 721*a*, 721*b*, 722*a*, 722*b*, 723*a*, and 723*b* (not visible in the figure), 724*a* (not visible in the figure), 724*b* (not visible in the figure), 725*a* (not visible in the figure), 725*b* (not visible in the figure). The cell has also six inverse-leaf electrodes all of which are segmented by four transversal cuts in five parts which are 310-314, 320-324, 330-334, 340-344, and 350-354.

FIGS. 21*a-b*, 22*a-b*, 24, and 25 illustrate examples of a dynamically harmonized FT-ICR cell with a specific number of six leaf (some or all of them split) and six inverse-leaf electrodes. It goes without saying, however, that the number can be varied within the scope of technical feasibility. For instance, a dynamically harmonized FT-ICR cell may comprise twelve leaf (some or all of them split) and twelve inverse-leaf electrodes which would allow the formation of even finer electrode subsets, covering smaller angular extensions below 60°, such as 30° or even less. The embodiments described here shall in no way be interpreted restrictive in this regard.

The invention has been described with reference to various embodiments. It will be understood, however, that various aspects or details of the invention may be changed, or various aspects or details of different embodiments may be arbitrarily combined, if practicable, without departing from the scope of the invention. Generally, the foregoing description is for the purpose of illustration only, and not for the purpose of limiting the invention which is defined solely by the appended claims.

Although the present invention has been illustrated and described with respect to several preferred embodiments thereof, various changes, omissions and additions to the form and detail thereof, may be made therein, without departing from the spirit and scope of the invention.

What is claimed is:

1. A method of correcting for an asymmetry of an electric field in an FT-ICR cell in a radial direction relative to an axis thereof, comprising:

(a) providing an FT-ICR cell having a set of mantle electrodes;

(b) supplying ions to the FT-ICR cell, wherein the ions are at least one of introduced into the FT-ICR cell, generated in the FT-ICR cell, and retained in the FT-ICR cell from a previous cycle;

(c) applying an excitation voltage pulse to a first subset of the mantle electrodes so that the ions are excited onto a revolving orbit within the FT-ICR cell;

(d) acquiring an image current transient with the aid of a second subset of the mantle electrodes, the image currents being induced by the revolving ions when passing the electrodes in the second subset;

(e) transforming the image current transient into a frequency or mass spectrum and observing an intensity of at least one of the ion signals with frequencies of $nv_R$, $v_R$ being a reduced cyclotron frequency, and $nv_R \pm mv_M$, $v_M$ being a magnetron frequency, where n=2, 4, 6, . . . , and m=1, 2, 3, . . . ; and (f) repeating the steps (b) through (e) while adjusting DC voltages supplied to at least one of the mantle electrodes until adjusted DC voltage settings are found which result in a lower observed intensity of the ion signal(s) compared with an initial intensity.

2. The method of claim 1, wherein the mantle electrodes, in an unwound representation, have one of a rectangular shape, leaf, half-leaf or inverse-leaf shape.

3. The method of claim 1, wherein at least one of the mantle electrodes is divided by transverse cuts along a longitudinal direction, each segment thusly created being connected to a DC voltage source so that a DC voltage supplied thereto is independently tuned to provide each segment with an individual compensation voltage to allow for the correction of a non-uniform perturbation of the electric field axis in the FT-ICR cell.

4. The method of claim 1, wherein at least one of the mantle electrodes is divided by a longitudinal cut in order to allow for flexible forming of electrically coupled mantle electrode subsets.

5. The method of claim 1, wherein the first subset of mantle electrodes has no electrodes in common with the second subset of mantle electrodes.

6. The method of claim 1, wherein the first subset of mantle electrodes has one of some and all electrodes in common with the second subset of mantle electrodes, further including operation of a switchable electrical circuit allowing for the mantle electrodes that are common to both the first and second subset to be switched from an excitation mode in step (c) to a detection mode in step (d).

7. The method of claim 1, wherein the second subset of mantle electrodes comprises one of individual electrode groups and individual electrodes that have an angular extension around a circumference of the FT-ICR cell smaller than about 120°.

8. The method of claim 7, wherein the angular extension is smaller than 90°.

9. The method of claim 7, wherein the individual electrode groups or individual electrodes of the second subset have an angular extension of about 60°, and the individual electrode groups or individual electrodes of the first subset have an angular extension of about one of 60° and 120°.

10. The method of claim 1, wherein the step of repeating further comprises varying a post capture delay time after introduction of the ions in the step of supplying ions.

11. The method of claim 1, wherein finding the adjusted DC voltage settings includes a complete disappearance of the observed intensity of the ion signal(s).

12. The method of claim 1, wherein the step of repeating comprises adjusting DC voltages at all mantle electrodes.

13. An FT-ICR cell having mantle electrodes, wherein the mantle electrodes are configured such that they allow a formation of a first subset of the mantle electrodes, electrically coupled to be usable for an excitation of ions in the FT-ICR cell, and of a second subset of the mantle electrodes, electrically coupled to be usable for a detection of an image current transient, wherein an angular extension of individual electrode groups or individual electrodes of the second subset is smaller than 90°, and wherein at least one mantle electrode is connected to a DC voltage source so that a DC voltage supplied thereto is independently tunable as to provide the mantle electrode with an individual compensation voltage for correcting an asymmetric electric field in the FT-ICR cell.

14. The FT-ICR cell of claim 13, comprising four individual mantle electrodes of which two have a width, in an unwound representation, which is twice as broad as that of the other two mantle electrodes, wherein the smaller mantle electrodes form the second subset usable for the detection of an image current transient.

15. The FT-ICR cell of claim 13, comprising six individual mantle electrodes of equal width, in an unwound representation, and further comprising an electrical circuit that allows to electrically couple and decouple at least two opposing mantle electrodes each with one adjacent mantle electrode in order to form one of the first subset and second subset of the mantle electrodes.

16. The FT-ICR cell of claim 13, wherein the mantle electrodes comprise inverse-leaf and leaf electrodes, in an unwound representation, wherein the inverse-leaf electrodes and adjacent leaf electrodes may be electrically coupled together as to form one of the first subset and second subset of mantle electrodes.

17. The FT-ICR cell of claim 13, further comprising a switchable electrical circuit allowing for a variable electrical coupling of mantle electrodes to form one of the first subset and second subset.

18. The FT-ICR cell of claim 13, wherein at least one of the mantle electrodes is divided by transverse cuts along a longitudinal direction, each segment thusly created being connected to a DC voltage source so that a DC voltage supplied thereto is independently tunable as to provide each segment with an individual compensation voltage in order to allow for the correction of a non-uniform perturbation of the electric field axis in the FT-ICR cell.

19. The FT-ICR cell of claim 13, wherein at least one of the mantle electrodes is divided by a longitudinal cut in order to allow for flexible forming of electrically coupled mantle electrode subsets.

20. The FT-ICR cell of claim 13, wherein each of the mantle electrodes is connected to a DC voltage source so that a DC voltage supplied thereto is independently tunable as to provide each of the mantle electrodes with an individual compensation voltage for correcting an asymmetric electric field in the FT-ICR cell.

* * * * *

UNITED STATES PATENT AND TRADEMARK OFFICE

CERTIFICATE OF CORRECTION

PATENT NO. : 8,766,174 B1
APPLICATION NO. : 14/096847
DATED : July 1, 2014
INVENTOR(S) : Baykut et al.

It is certified that error appears in the above-identified patent and that said Letters Patent is hereby corrected as shown below:

In the Specification

Column 27
Line 5, please delete “my” and insert --mV--

Column 28
Line 59, please delete “fowling” and insert --forming--

Signed and Sealed this
Second Day of September, 2014

Michelle K. Lee

Michelle K. Lee
*Deputy Director of the United States Patent and Trademark Office*